US011760396B2

(12) United States Patent
Ghaly

(10) Patent No.: US 11,760,396 B2
(45) Date of Patent: Sep. 19, 2023

(54) METHOD AND APPARATUS FOR AN AUXILIARY TRAIN CONTROL SYSTEM

(71) Applicant: Nabil N. Ghaly, Huntington Station, NY (US)

(72) Inventor: Nabil N. Ghaly, Huntington Station, NY (US)

( * ) Notice: Subject to any disclaimer, the term of this patent is extended or adjusted under 35 U.S.C. 154(b) by 1240 days.

(21) Appl. No.: 14/545,286

(22) Filed: Apr. 16, 2015

(65) Prior Publication Data

US 2015/0307119 A1 Oct. 29, 2015

Related U.S. Application Data

(60) Provisional application No. 61/995,982, filed on Apr. 25, 2014.

(51) Int. Cl.

| | |
|---|---|
| ***B61L 25/06*** | (2006.01) |
| ***B61L 27/20*** | (2022.01) |
| ***B61L 27/33*** | (2022.01) |
| ***B61L 27/53*** | (2022.01) |
| ***B61L 23/00*** | (2006.01) |
| ***B61L 3/12*** | (2006.01) |
| ***B61L 1/16*** | (2006.01) |

(52) U.S. Cl.

CPC ..... *B61L 25/06* (2013.01); *B61L 23/007* (2013.01); *B61L 27/20* (2022.01); *B61L 27/33* (2022.01); *B61L 27/53* (2022.01); *B61L 1/16* (2013.01); *B61L 3/125* (2013.01); *B61L 2027/204* (2022.01)

(58) Field of Classification Search

CPC .... B61L 25/06; B61L 23/007; B61L 27/0038; B61L 27/0066; B61L 27/0088; B61L 1/16; B61L 3/125; B61L 2027/005

See application file for complete search history.

(56) References Cited

U.S. PATENT DOCUMENTS 2,283,998 A * 5/1942 Kemmerer ..... B61L 23/22 246/33
2005/0253689 A1* 11/2005 Mollet ..... B61L 27/0005 340/286.01

(Continued)

FOREIGN PATENT DOCUMENTS

CA 2660867 C * 9/2012 ..... B61L 25/023
WO WO-2015027356 A1 * 3/2015 ..... B61B 1/00

*Primary Examiner* — Hunter B Lonsberry
*Assistant Examiner* — Elizabeth Yang

(57) ABSTRACT

A method and an apparatus for a train control installation are disclosed, and are based on the absolute permissive block concept. The train control installation employs a plurality of generic absolute block signal units (ABSU), wherein each signal unit includes means for detecting the crossing of a train passed a discrete point, means for exchanging data with adjacent ABSUs, means for generating and communicating a movement authority limit to a train, means for generating and displaying a signal indication, and means for enforcing a stop aspect. The train control installation can be used in conjunction with a communication based train control (CBTC) system to provide a degraded mode of operation without impacting the availability and the reliability of the CBTC system. Further, the train control installation has a self-healing feature to maintain train service during an ABSU failure.

10 Claims, 74 Drawing Sheets

(56) References Cited

U.S. PATENT DOCUMENTS

| | | | | |
|---|---|---|---|---|
| 2006/0161416 | A1* | 7/2006 | Tramontana | B61L 27/0055 703/22 |
| 2007/0137514 | A1* | 6/2007 | Kumar | F02D 41/0025 105/26.05 |
| 2010/0063656 | A1* | 3/2010 | Knott | B61L 23/18 701/19 |
| 2010/0090069 | A1* | 4/2010 | Degouge | B61L 27/0061 246/3 |
| 2010/0258682 | A1* | 10/2010 | Fries | B61L 5/1881 246/1 C |
| 2011/0276285 | A1* | 11/2011 | Alexander | B61L 1/20 702/58 |
| 2014/0054424 | A1* | 2/2014 | Xu | B61L 25/026 246/122 R |
| 2014/0117168 | A1* | 5/2014 | Itagaki | B61L 1/10 246/34 R |
| 2014/0180509 | A1* | 6/2014 | Goldman | B61L 27/0072 701/19 |
| 2016/0200327 | A1* | 7/2016 | Liu | G07B 15/00 105/8.1 |

* cited by examiner

METHOD AND APPARATUS FOR AN AUXILIARY TRAIN CONTROL SYSTEM

This utility application benefits from provisional application of U.S. Ser. No. 61/995,982 filed on Apr. 25, 2014.

BACKGROUND OF THE INVENTION

Field of the Invention

This invention relates generally to train control systems, and more specifically to an auxiliary train control system that can be integrated with a primary train control system to provide a backup mode of operation during primary system failures. The auxiliary train control system is based on a generic architecture that employs a configuration of conventional train control equipment.

During the Twentieth Century, train control systems evolved from the early fixed block, wayside technologies, to various fixed block, cab-signaling technologies, and in recent years to communications based train control (CBTC), A.K.A. moving block technologies. In a CBTC system, a train receives a movement authority from a wayside device, and generates a stopping profile that governs its movement from its current position to the limit of the movement authority. Although CBTC can operate independent of fixed block train detection, it does require external means for detecting trains during CBTC system initialization, train initialization, as well as during CBTC system failures if a backup mode of operation (degraded mode of operation) is desired.

The current industry practice is to use an auxiliary wayside signal (AWS) system based on a secondary train detection system (track circuits or axle counters configured to detect trains within a fixed block). The functions of the AWS system could range from secondary train detection to providing safe train separation and in some cases limited over-speed protection. When integrated with CBTC, AWS is used during CBTC system initialization to detect unequipped and non-communicating trains. AWS is also used during the initialization of a train in CBTC operation to sweep the territory in front of the train before the train is issued a movement authority limit.

However, the current architecture for an AWS system has a number of disadvantages. First, the use of fixed block detection in conjunction with CBTC has the disadvantage of interrupting CBTC operation during a fixed block detection failure. Normally, a restricted movement authority (a movement authority with restricted speed) is used to operate a train through a failed train detection block. Second, if wayside signals with automatic train stops are used to provide safe train separation function during CBTC system failures, it is the custom and practice to override wayside signal aspects and associated automatic stops during normal CBTC operation. This practice increases the cost of CBTC installations, and introduces additional interruptions in CBTC operation during failures associated with wayside signals and associated automatic train stops. Also, while CBTC operation is normally automated, operation under AWS protection is normally manual. This results in operational constraints during certain failure modes (for example) of driverless systems.

Alternatively, if CBTC is installed without an auxiliary wayside system, it is very difficult to maintain train service during CBTC failures. It is also very challenging to initialize CBTC without AWS. Normally, the initialization is performed manually under operating rules and procedures. Accordingly, there is a need for a new architecture for an auxiliary wayside system that can be integrated with CBTC, and which provides compatible distance-to-go operation without the additional high capital & maintenance costs, and the operational disadvantages of the current industry practice.

Description of Prior Art

In a fixed block wayside signal system, the tracks are divided into a plurality of blocks, wherein each block includes a train detection device such as a track circuit or axle counters to detect the presence of a train within the block. Vital logic modules employ train detection information to activate various aspects at a plurality of wayside signals in order to provide safe train separation between trains. An automatic train stop is normally provided at each wayside signal location to enforce a stop aspect.

Cab-signaling technology is well known, and has evolved from fixed block, wayside signaling. Typically, a cab-signal system includes wayside elements that generate discrete speed commands based on a number of factors that include train detection data, civil speed limits, train characteristics, and track geometry data. The speed commands are injected into the running rails of the various cab-signaling blocks, and are received by trains operating on these blocks via pickup coils. A cab-signal system also includes car-borne devices that present the speed information to train operators, and which ensure that the actual speed of a train does not exceed the safe speed limit received from the wayside.

CBTC technology is also known in the art, and has been gaining popularity as the technology of choice for new transit properties. A CBTC system is based on continuous two-way communications between intelligent trains and Zone controllers on the wayside. An intelligent train determines its own location, and generates and enforces a safe speed profile. There are a number of structures known in the art for a train to determine its own location independent of track circuits. One such structure uses a plurality of passive transponders that are located on the track between the rails to provide reference locations to approaching trains. Using a speed measurement system, such as a tachometer, the vital onboard computer continuously calculates the location and speed of the train between transponders.

The operation of CBTC is based on the moving block principle, which requires trains in an area to continuously report their locations to a Zone Controller. In turn, the Zone Controller transmits to all trains in the area a data map that contains the topography of the tracks (i.e., grades, curves, super-elevation, etc.), the civil speed limits, and the locations of wayside signal equipment. The Zone controller, also, tracks all trains in its area, calculates and transmits to each train a movement authority limit. A movement authority is normally limited by a train ahead, a wayside signal displaying a stop indication, a failed track circuit, an end of track, or the like. Upon receiving a movement authority limit, the onboard computer generates a speed profile (speed vs. distance curve) that takes into account the limit of the movement authority, the civil speed limits, the topography of the track, and the braking characteristics of the train. The onboard computer, also, ensures that the actual speed of the train does not exceed the safe speed limit.

The current invention provides a new architecture for an auxiliary wayside signal system that can be integrated with CBTC. The new architecture is based on a generic installation that does not employ train detection blocks, requires minimum application design efforts, provides operation compatible with CBTC, enables the initialization of CBTC equipment, provides a backup mode of operation during CBTC failures, and is transparent to CBTC operation (i.e. its operation is autonomous and its failure modes have no impact on CBTC operation).

OBJECT OF THE INVENTION

This invention relates to train control systems, and in particular to an auxiliary wayside signal (AWS) system that can be integrated with CBTC to provide a backup mode of operation during CBTC system failures. The new AWS system employs a generic signal structure (or generic signal assembly), defined as an Absolute Block Signal Unit ("ABSU"), which has an architecture that is based on conventional signal equipment. Accordingly, it is an object of the current invention to provide a method for an auxiliary wayside signal system that is founded on a plurality of a generic signal structure located along the track (or right of way), and which are linked by a data communication network.

It is another object of this invention to provide an auxiliary wayside signal system that is based on a generic signal structure that is located at a plurality of locations along the track, wherein said signal structure includes a data radio to communicate with CBTC equipped trains.

It is a further object of this invention to provide an auxiliary wayside signal system that is based on a generic signal structure that is located at a plurality of locations along the track, wherein said signal structure includes a communication module, which operates over a fiber optic network, to exchange data with similar structures.

It is also an object of this invention to provide an auxiliary wayside signal system that is based on a generic signal structure that is located at a plurality of locations along the track, wherein said signal structure includes means for detecting certain attributes associated with passing trains.

It is a further object of the current invention to provide an auxiliary train control system, which is based on a generic signal structure that is located at a plurality of locations along the track, wherein the auxiliary train control system employs a unique "signature" for each train that includes the number of axles on the train and a unique train identification, and wherein said generic signal structure is designed to detect said unique signature.

It is also an object of this invention to provide a train control system, which is based on a generic signal structure that is located at a plurality of locations along the track, wherein the train control system employs a unique "signature" for each train provided by a plurality of tags (transponders) mounted on the train that provide in turn a unique train identification, and wherein said generic signal structure is designed to detect said unique signature.

It is another object of this invention to provide an auxiliary wayside signal system, which is based on a generic signal structure that is located at a plurality of locations along the track, wherein the auxiliary train control system employs a unique "signature" for each train that includes the number of axles on the train and a unique train identification, wherein the unique train identification is based on a plurality of transponders, wherein the configuration of axle counters and transponders is provided to achieve detection and correction of certain failures/errors, and wherein said generic signal structure is designed to detect said unique signature.

It is a further object of this invention to provide an auxiliary wayside signal system that is based on a generic signal structure that is located at a plurality of locations along the track, wherein said structure is designed to detect the crossing of a train past its location, and wherein the function of detecting the crossing of a train is performed in to presence of certain failure conditions.

It is still an object of this invention to provide an auxiliary wayside signal system that is based on a generic signal structure that is located at a plurality of locations along the track, wherein said generic structure can generate a movement authority limit (MAL) and transmit it to an approaching train, and wherein the MAL is based on the absolute permissive block signaling concept.

It is a further object of this invention to provide an auxiliary wayside signal system that tracks the number of axles of a train as it moves throughout the AWS territory.

It is another object of this invention to provide an auxiliary wayside signal system that is based on a generic signal structure that is located at a plurality of locations along the track, wherein said generic structure can provide a signal indication to an approaching train.

It is also an object of this invention to provide an auxiliary wayside signal system that is based on a generic signal structure that is located at a plurality of locations along the track, wherein said generic structure can provide automatic train stop enforcement for an approaching train.

It is yet another an object of this invention to provide an auxiliary wayside signal system that is based on a generic signal structure that is located at a plurality of locations along the track, wherein said generic structure is implemented by a generic absolute block signal unit, wherein the signal unit includes an axle counter, a data radio, an active transponder, a transponder reader, a signal and associated automatic train stop.

It is still an object of this invention to provide an auxiliary wayside signal system that can be integrated with a CBTC system, and which can operate in a standby mode of operation and in an active mode of operation, wherein during standby mode the AWS is transparent to CBTC operation, and wherein during active mode the AWS provides certain functions in support of CBTC operation.

It is a further object of the invention to provide an auxiliary wayside signal system that can be integrated with a CBTC system, wherein during normal CBTC operation the AWS system operates in a standby mode.

It is also an object of this invention to provide an auxiliary wayside signal system that can be integrated with a CBTC system, wherein upon the detection of a CBTC failure, the AWS system operates in an active mode.

It is another object of this invention to provide an auxiliary wayside signal system that can be integrated with a CBTC system, and which is based on a generic signal structure that is located at a plurality of locations along the track, wherein upon the failure of a signal structure at one of said plurality of locations, the AWS system is automatically reconfigured without the failed signal structure, and with or without functional assistance of the CBTC system.

It is still an object of this invention to provide an auxiliary wayside signal system that is based on a generic signal structure that is located at a plurality of locations along the track, wherein a generic signal structure includes a radio module to communicate with other generic signal structures, with approaching trains, and with CBTC zone controllers.

It is a further object of this invention to provide an auxiliary wayside signal system that is based on a generic signal structure that is located at a plurality of locations along the track, wherein a generic signal structure includes an axle counter (or a wheel detector) to count the number of axles of a passing train.

It is still also an object of this invention to provide an auxiliary wayside signal system that is based on a generic signal structure that is located at a plurality of locations along the track, wherein a generic signal structure includes an active transponder that transmits control data to an approaching train.

It is also an object of this invention to provide an auxiliary wayside signal system that is based on a generic signal structure that is located at a plurality of locations along the track, and which provides a degraded mode of operation for a CBTC installation, wherein the auxiliary wayside signal system operates autonomously of CBTC and has no impact on CBTC operation.

It is another object of this invention to provide an auxiliary wayside signal system that is based on a generic signal structure that is located at a plurality of locations along the track, wherein a generic signal structure includes a transponder reader that detects the train identification of a passing train.

It is yet another object of this invention to provide an auxiliary wayside signal system that is based on a generic signal structure that is located at a plurality of locations along the track, wherein a generic signal structure includes a visual display that provides a signal aspect indication to an approaching train, wherein said signal aspect indication is based on color light and/or position light.

It is also an object of this invention to provide an auxiliary wayside signal system that is based on a generic signal structure that is located at a plurality of locations along the track, wherein a generic signal structure includes an automatic train stop mechanism that enforces a "stop" aspect, and wherein said train stop mechanism is of the mechanical type, magnetic type, or is based on a transponder type operation.

It is a further object of this invention to provide an auxiliary wayside signal system that operates based on monitoring and/or processing a stack of trains within a section of the railroad.

It is still another object of this invention to provide an auxiliary wayside signal system that communicates with an interlocking control device to receive information related to the statuses of interlocking equipment.

It is yet another object of this invention to provide an auxiliary wayside signal system that is installed in a rail section that includes an interlocking installation, and which is based on a generic signal structure that is located at a plurality of locations along the track, wherein the interlocking installation performs certain functions of the generic signal structure.

It is also an object of this invention to provide an auxiliary wayside signal system that is integrated with a CBTC system, which is based on a generic signal structure that is located at a plurality of locations along the track, and which interfaces with an Automatic Train Supervision (ATS) subsystem.

It is another object of this invention to provide an auxiliary wayside signal system that is integrated with a CBTC system, which is based on a generic signal structure that is located at a plurality of locations along the track, and which is coordinated with traffic direction on said rack.

It is a further object of this invention to provide a primary train control system, which is based on a generic signal structure that is located at a plurality of locations along the track, and which operates using the absolute permissive block signaling concept.

It is yet another object of this invention to provide an auxiliary train control system, which is based on a generic signal structure that is located at a plurality of locations along the track, and which employs the absolute permissive block signaling concept to control the movement of a manual train through the territory.

It is still an object of the current invention to provide an auxiliary train control system, which is based on a generic signal structure that is located at a plurality of locations along the track, wherein said generic signal structure is designed to fail in alternate failure states depending on certain attributes of the train approaching the location of the generic signal structure.

It is also an object of the current invention to provide an auxiliary train control system, which is based on a generic signal structure that is located at a plurality of locations along the track, wherein said generic signal structure is designed to fail in a "stop" failure state if the approaching train is a manual train operating without speed restriction, and wherein in this failure state, the signal structure displays a "stop" aspect and controls its automatic train stop to the tripping position.

It is a further object of the current invention to provide an auxiliary train control system, which is based on a generic signal structure that is located at a plurality of locations along the track, wherein said generic signal structure is designed to fail in an "override" failure state if the approaching train is an equipped train, and wherein in this failure state, the signal structure displays an "override" aspect and controls its automatic train stop to the clear position.

It is another object of the current invention to provide an auxiliary train control system, which is based on a configuration of a plurality of generic signal structures that are located at a plurality of locations along the track, wherein the design of said auxiliary train control system includes a self-healing feature that would reconfigure said plurality of generic signal structures during a failure.

It is also an object of the current invention to provide an auxiliary train control system, which is based on a configuration of a plurality of generic signal structures that are located at a plurality of locations along the track, wherein the design of said auxiliary train control system includes an overlap section at each ABSU location, wherein the overlap section is implemented using a second set of wheel detector (axle counter)/transponder reader configuration to detect the crossing of a train at a "release" point past the ABSU location, and wherein the distance between the ABSU location and the release point location represent an overlap distance to protect against a manual train violating a stop aspect at the ABSU location.

BRIEF SUMMARY OF THE INVENTION

The foregoing and other objects of the invention are achieved in accordance with a preferred embodiment of the invention that provides an auxiliary wayside signal (AWS) system that is based on a generic Absolute Block Signal Unit (ABSU) that is installed at a plurality of locations along the track. The spacing between consecutive ABSUs is a design choice, and is based on the desired headway (or throughput) needed from the AWS installation. The AWS can be integrated with a CBTC system to provide a number of CBTC related functions including initialization of zone controllers, initialization of CBTC equipped trains into CBTC operation, as well as a backup mode of operation during CBTC failures. The ABSU provides operation that is compatible with CBTC operation (i.e. distance-to-go operation).

The ABSU operates based on the absolute permissive block concept, wherein a train is given a movement authority to proceed through a block from the entering boundary of the block to its exit boundary provided that the entire block is vacant. Conventional signaling installations use a plurality of track circuits or other means of train detection within an absolute block to determine the status of the absolute block, i.e. vacant or occupied. During CBTC operation, trains operate close together and it is likely that a plurality of trains operate within an area defined as an absolute permissive block. While CBTC tracks the number of trains and the location of each train operating within an area, this tracking function is lost during a CBTC failure. Conventional technologies that employ fixed block train detection are not able to determine the exact number of trains within an area impacted by a CBTC failure. The proposed AWS system has the capability to determine the number of trains operating within an area or section of the railroad.

The proposed AWS system employs a unique "signature" for each train. A signature is defined as one or a plurality of attributes that are associated with a train. Although a single attribute is sufficient to operate the proposed AWS system, it is desirable to use two attributes to define a signature for an equipped train. Accordingly, the preferred embodiment uses the number of axles in a train, and a unique train ID embedded in a tag or transponder to define the signature of an equipped train. A tag or a transponder could be a passive transponder that stores a fixed train ID, or could be an active transponder that stores a variable train ID (i.e. the train ID is different for each train trip). Another design alternative is for the train ID to include two parts: a fixed part and a variable part that is based on the train trip. What is important is that the train ID remains fixed during a trip from an originating terminal to a destination terminal.

For the preferred embodiment, wherein the AWS system is integrated with CBTC, and in order to facilitate CBTC system initialization, the CBTC system stores a train signature as part of the train consist information. The on-board CBTC equipment also includes a structure that determines the number of axles in the train consist, and provisions for storing the train signature (the number of axles and the train ID). Further each CBTC train is able to communicate and verify its signature to zone controllers. Also, each zone controller tracks the signatures of the CBTC trains within its territory.

It should be noted that for an application wherein the ABSUs are used to provide a primary train control system and wherein trains could include freight trains, there is a need to provide an alternate way other than the number of axles in a train to identify trains and track them as they move past each ABSU. An alternate structure is based on using plurality of transponders installed on the train consist to form a unique pattern that can be used as a train signature. Each transponder holds part of a train signature code, and collectively the plurality of transponders provide the unique train signature.

It should also be noted that another design choice for train signature is to use a configuration of number of axles and two tags (transponders), such that one transponder is located on the first car of the train consist, and the second transponder is located on the last car of the train consist. The purpose of the second transponder is to provide a confirmation that the entire train has passed an ABSU location. Although detecting the number of axles in a train provides such assurance, the second transponder can provide a self-correcting mechanism in the event of an error in detecting an axle of the train crossing an ABSU location. Similarly, detecting the full complement of axles included in a train signature can provide assurance that the entire train has crossed an ABSU location even though the ABSU reader may have missed or misread one of the two transponders. In effect the configuration of number of axles and the two transponders provides redundant/fault tolerant means for detecting the crossing of a train by an ABSU location. Conversely, in the event the full number of axles and at least one transponder are not detected, this will indicate a potential problem with train integrity, i.e. a train losing one or more cars from its consist.

The ABSU has two modes of operation: a "standby" mode and an "active" mode. During the standby mode, the ABSU monitors the number of trains within an absolute block section. Then during the active mode, the ABSU controls the movement of an approaching train into the absolute block section. Under normal CBTC operating conditions, the ABSUs operate in the standby mode. Alternatively, when CBTC experiences a zone controller or a train failure, the ABSUs operate in the active mode. One main characteristic of an ABSU is that it operates autonomously of the CBTC system. During the "standby" mode, the ABSU is simply monitoring CBTC train movements and is tracking the relative positions of CBTC trains. Further, during the "active" mode, the ABSU employs the information compiled during the "standby" mode to control train movements. In both the standby and active modes, the ABSU operates independently of the CBTC system.

In general, the ABSU performs three main functions. The first function is performed during both the "standby" and "active" modes to detect that a train has completely crossed over the point where the ABSU is located. As part of this function, the ABSU confirms that a specific train identified by a train signature has crossed its location. In the event that a train without a train signature crosses the ABSU location, it is detected and is assigned a provisional train signature by the ABSU. However, if the ABSU is operating in the active mode, and if it cannot confirm that the train is an equipped train, it considers such train to be a manual train operating without speed restriction, and triggers an ABSU overlap function to provide sufficient breaking distance to the manual train.

The second function is also performed when the ABSU is operating either in the "standby" or active" mode. Upon detecting a crossing of a train at its location, the ABSU updates the number of trains within its absolute permissive block, and tracks the associated train signatures within that block section. The third function is performed only when the ABSU is operating in the active mode. Under this function, the ABSU controls the movement of an approaching train into the associated absolute permissive block section. More specifically, when in the active mode, and if the approaching train is an equipped train, the ABSU permits the approaching train to enter the absolute permissive block section if it is vacant. Alternatively, if the approaching train is unequipped and operating in a manual mode, the ABSU permits the approaching train to enter its absolute permissive block section only if the two permissive blocks ahead of its location are vacant.

To accomplish these functions, an ABSU communicates with adjacent ABSUs as follows: First, it receives the signature of an approaching train from the ABSU in the approach to its location ("Approach ABSU"). Second, it transmits to the "Approach ABSU" that a specific train (defined by its signature) has completely crossed the ABSU location. Third, it transmits to the ABSU ahead of its location ("Ahead ABSU") the signature of the train approaching the Ahead ABSU. Fourth, it receives from the Ahead ABSU that a specific train (defined by its signature) has completely crossed the location of the Ahead ABSU.

Additional functions performed by an ABSU include sending a movement authority limit to an approaching train (when operating in the active mode). Further, for certain applications, when a failed train is approaching an ABSU location, the ABSU transmits to the train a civil speed limit that must not be exceeded when the train operates within the absolute permissive block limits. In addition, an ABSU communicates with associated zone controller to exchange operating data, as well as with the ATS subsystem to provide status information.

When an ABSU is located in the approach to an interlocking, it is necessary to provide additional operating data to the ABSU. First, the interlocking needs to confirm to the ABSU that a route has been established for the approaching train. Second, the interlocking must provide the destination track to the ABSU in order to establish communication with the correct ABSU ahead. To accomplish these requirements, it is necessary that the interlocking maintains communication with the ABSU at all times. In the event of a loss of communication between the ABSU and the interlocking, the ABSU is not able to issue a movement authority to an approaching train. Further, if a train has already received a movement authority limit prior to the loss of communication between the ABSU and the interlocking, it is very difficult to rescind or cancel such movement authority, especially if there is no radio communication established with the train.

In view of the objective to simplify the architecture of the proposed AWS system, and because of the design and operating challenges associated with issuing a train a movement authority limit that overlaps an interlocking, the preferred embodiment is designed such that the ABSU functions are integrated with the interlocking functions. This should not be difficult, since it is customary to replace or modernize the interlocking controls as part of a new CBTC project.

In a conventional interlocking with wayside signals, the ABSU functions are made effective at the home signal located on the various tracks at the boundaries of the interlocking. In effect, each of these home signals incorporates ABSU functions in addition to performing the functions normally associated with a home signal. As such, each home signal location includes an axle counter, an active transponder and a transponder reader. However, since the ABSU control logic is implemented as part of the interlocking control logic, only one radio module is needed for the entire interlocking (a plurality of radios could be provided if needed for availability). In that respect, to the AWS, the interlocking appears as a single ABSU logical entity ("ABSU-IXL"), with one geographical address location for each entrance to, and exit from the interlocking. For an ABSU in the approach to the interlocking, the ABSU-IXL functions as the "ABSU Ahead." Alternatively, for an ABSU ahead of the interlocking, the ABSU-IXL functions as the "Approach ABSU." As such, the ABSU-IXL detects the crossing of a specific train twice. The first crossing is when the train exits the absolute permissive block in the approach to the interlocking and enters the interlocking territory at a home signal location. The second crossing is when the train exits the interlocking territory and enters the absolute permissive block ahead of the interlocking. The ABSU-IXL maintains a protected stack for each route, and keeps track of a specific train (as defined by the train signature) exiting the interlocking. Further, the ABSU-IXL generates and sends a MAL to an approaching train to enable the train to move along a protected route within the interlocking limits. The ABSU-IXL uses either the radio module or an active transponder to transmit a MAL to an approaching train. The functions performed by the ABSU are implemented in the interlocking control device. As such, any route from a home signal entering the interlocking through a home signal exiting the interlocking is considered an internal absolute block. The interlocking control device then performs additional logic functions for each route (i.e. internal absolute block), relying on the ABSU equipment installed at the entry and exit points of the interlocking (axle counters, transponder readers and active transponders), wherein the logic functions include detecting a train crossing an entry point of the interlocking, detecting a train crossing an exit point of the interlocking, determining the number of trains within an internal route, and tracking the signatures of all trains operating at the interlocking.

It should be noted that the integration of the ABSU functions with the interlocking functions has the benefits of simplifying the architecture of the ABSU and its functionality. A generic ABSU can be used at any location on a line, including locations in the approach to an interlocking. Also, the functions performed by the ABSU are independent of the internal interlocking routes. It should also be noted that this integration approach is being set forth for the purpose of describing the preferred embodiment, and is not intended to limit the invention hereto.

To perform the above described ABSU functions, the ABSU architecture for the preferred embodiment is based on a configuration of conventional train control equipment that include axle counter to detect the crossing of a train, a transponder reader to read the ID of a passing train, an active transponder to transmit data to an approaching train, a wayside signal module and associated automatic train stop to control the movement of an approaching train into an absolute permissive block, and a radio module to communicate with adjacent ABSUs, zone controllers, approaching trains, ATS subsystem (if required), and an interlocking control device (if required).

It should be noted that the above architecture is set forth herein for the purpose of describing the preferred embodiment and is not intended to limit the invention hereto. As would be understood by a person with ordinary skills in the art, the ABSU could be based on a different architecture and/or different set of train control equipment. For example, optical detectors could be used in lieu of axle counters. Also, a data communication module operating over a fiber optic communication network could be used in lieu of a radio module to communicate with adjacent ABSUs, zone controllers, ATS subsystem and interlocking control devices. Further, an ABSU can be located at a CBTC radio location, and can leverage the CBTC communication resources at that radio location to satisfy its data communication needs. This will reduce the cost of an ABSU implementation. In addition, the use of a wayside signal as part of the ABSU could be optional. An on-board indicator could be activated through the active transponder at the ABSU location.

As indicated above, when integrated with CBTC, the ABSU is used to initialize zone controllers and CBTC equipped trains into CBTC operation. During normal CBTC operation, the ABSUs included in the AWS system operate in a standby mode, and keep track of the number of trains and the sequence of train signatures within each absolute block. Upon a failure of a zone controller, the ABSUs in the AWS continue to track of the number of trains and their signatures within each absolute block. Further, the ABSUs control train movements to an eventual operational configuration of a single train per absolute block. Upon the re-initialization of the failed zone controller, the ABSUs within the AWS provide the current train operational data to the zone controller (i.e. data related to the number of trains and their signatures within each absolute block). For the preferred embodiment the number of trains and their signatures within each absolute block is defined as the "protected stack."

The zone controller uses data included in the protected stack to verify that there is no undetected non-communicating train within its territory. During the initialization process, and upon establishing communication with CBTC trains, the Zone controller compares the signatures of communicating trains with the data provided by the ABSUs to determine if there are trains included in the protected stacks that have not established communication with the zone controller. The zone controller can also determine the positions of non-communicating trains relative to the trains that did establish communication. In the event of detecting a non-communicating train within a protected stack, the zone controller will not issue a movement authority limit to the train that is located behind the non-communicating train. However, when and where the protected stack data confirms that all trains within a stack have established communications with the zone controller, the initialization process becomes simple. Upon the localization of a communicating CBTC train, the zone controller can issue a movement authority limit to the train based on the location of the train ahead.

There are two main operating scenarios associated with the initialization of the proposed AWS system that employs a plurality of ABSUs. In the first scenario, it is assumed that the CBTC system is operating without a failure at the time when the AWS is initialized. Under this scenario, the CBTC operating data is used to initialize the various ABSUs. More specifically, train tracking data within zone controllers is used to initialize the protected stacks data, including the number of trains within a stack and associated train signatures. In addition, the data needed to customize the ABSUs to geographic locations could be uploaded from the zone controllers to the ABSUs.

During the second operating scenario, it is assumed that the CBTC system is not operational. Under this scenario, the initialization process is based on at least one train sweeping the territory of the absolute block in order to initialize the associated ABSU. Once an ABSU is initialized, it can operate in an active mode to control the movement of trains, or in a standby mode as described above.

One of the main objectives of the preferred embodiment is to minimize the application engineering effort to customize an ABSU to a particular geographic location. In that respect, the proposed ABSU architecture is based on a generic operational approach that detects train movements at discrete points rather than continuous monitoring of train movements throughout an entire section of the railroad. As such, the proposed architecture requires a very limited set of geographical data to customize an ABSU to a particular geographic location. More specifically, each ABSU requires the geographical locations data for the two ABSUs ahead of its own location, as well as the ABSU in the approach to it. The ABSU also requires the lowest civil speed limit data within the boundaries of the absolute block it protects. All other data needed for ABSU functionalities is dynamically acquired during the standby and active modes of operation. This simple customization process enables easy initialization of the AWS system, and allows for a simple procedure to reconfigure an AWS installation in the event of an ABSU failure. As a consequence of the above described ABSU characteristics, the proposed AWS is totally independent of, and transparent to CBTC operation.

In the event an ABSU fails while it is operating in a standby mode, and in accordance with the preferred embodiment, the CBTC system detects such failure, and removes the failed ABSU from the AWS configuration. In effect, the protected stack of the failed ABSU is combined with the protected stack of the "Approach ABSU." The reconfiguration of the AWS results in a longer absolute permissive block that maps the territories of the two absolute permissive blocks in the approach to and ahead of the failed ABSU. It should be noted that this reconfiguration process is transparent to, and has no impact on CBTC operation. It should also be noted that one of the main benefits of the proposed AWS architecture is that during normal CBTC operation, the ABSUs have no impact on the reliability and availability of CBTC operation, even when a component of an ABSU or an entire ABSU location fails. This is accomplished without the use of any redundancies within the AWS system. Further, it should be noted that another design alternative is to perform the reconfiguration of the ABSUs without using data from the zone controller. This is possible by establishing communication between the ABSU ahead of, and the ABSU in the approach to the failed ABSU. However, under such design alternative, each ABSU communicates all data related to the trains in its protected stack to the ABSU Ahead.

Alternatively, if the ABSU fails while it is in the active mode, trains located within its protected stack will continue to operate under previously issued operating parameters (i.e. movement authority limit and/or speed restriction). However, trains approaching the failed ABSU will not receive updated operating parameters at the failed ABSU location. This means that if the first approaching train has a MAL, it will stop at the failed ABSU location. Alternatively, if the first approaching train is operating under a restricted speed, it can continue to move passed the failed ABSU location if the signal and associated automatic train stop at the failed ABSU location permit such restricted speed movement.

To manage this failure scenario, the design of the ABSU incorporates a failure management feature that is associated with active mode operation, and which enables trains to continue to move with minimum interruption to service in the event of an ABSU failure. The preferred embodiment provides a unique ABSU design feature that, while in the active mode, it pre-conditions the device to transition into one of two failure states in the event of a failure. The first failure state is identified as an "override" failure state, and is selected if the train approaching the ABSU is an equipped train. Under this failure state, the ABSU is designed to automatically display an "override" aspect and to drive the automatic stop to a clear position. Further, the active transponder defaults to transmitting a special failure code to an approaching train. The second failure state is identified as "stop" failure state, and is selected when the ABSU cannot determine if the approaching train is equipped. Under this failure state, the ABSU is designed to automatically display a "stop" aspect and to drive the automatic stop to a tripping position.

It should be noted that under normal AWS operating conditions, an equipped train approaching an ABSU is operating under the protection of either a MAL or a restricted speed. This is the case because when a CBTC element fails, affected trains, including a failed train, operate with restricted speed until the failure is corrected or an affected train is given a movement authority by an ABSU. Further, an equipped train normally has a train signature and is able to communicate with the ABSUs. As such, when the ABSU fails in the "override" failure state, it allows an approaching train with a speed restriction to continue to move past its location with the restricted speed. In the event the approaching train has a MAL that ends at the location of the failed ABSU, the default code generated at the active transponder of the failed ABSU authorizes the approaching train to move under a speed restriction.

Under rare operating conditions, a manual train may operate in the ABSUs territory without a speed restriction. The preferred embodiment includes a design feature that enables the manual train to move with limited signal protection by providing an overlap distance at each ABSU location. As such, when an ABSU is not able to determine that an approaching train is equipped, it preconditions its internal logic to fail in the "stop" fail state. This ensures that the approaching manual train stops at the failed ABSU location. There are two design choices for providing said overlap distance at each ABSU location. The first design choice is based on using the ABSU ahead as a "release" point for the manual train. A "release" point is defined as the location at which a train operating ahead of a manual train must be detected before allowing the approach ABSU to release the manual train to move past its location. The second design choice is to install a second configuration of axle counter/transponder reader ahead of the ABSU location to detect the crossing of the train ahead of the manual train. In this case, the location of the second configuration is the "release" point, and the distance between the ABSU location and the release point represents the needed overlap distance. It should be noted that the overlap distance is based on the breaking distance for the manual train under worst operating conditions (i.e. maximum attainable speed, low adhesion condition, etc.)

Upon the occurrence of an ABSU failure, it is assumed that communication is interrupted between the failed ABSU and the Approach ABSU, as well as with the ABSU Ahead. When communication is lost with an adjacent ABSU, the Approach ABSU is designed to establish communication with the next ABSU in an AWS configuration. This means that when an ABSU fails, the Approach ABSU and the ABSU Ahead establish communication together. Then upon establishing such communication, the Approach ABSU receives from the ABSU Ahead the train signature of the train approaching its location if any. Upon receiving said train signature, the Approach ABSU inserts a predefined number of "provisional" trains in its protected stack, and continues to provide the ABSU Ahead with train signatures from its protected stack, starting with the provisional trains until it receives confirmation that a train on the original protected stack has reached the ABSU Ahead. Accordingly, the main approach of this failure recovery technique is to provide a transition period during which affected trains maintain status quo and continue to operate, or are authorized to operate with a speed restriction. After the completion of this transition period, normal AWS operation resumes. In effect, the above described failure management process enables the AWS to "self-heal" from an ABSU failure by combining the absolute permissive blocks in the approach to, and ahead of the failed ABSU into a longer absolute permissive block, by introducing "provisional" trains as place holders for train data lost as a result of the ABSU failure, and by overriding the failed ABSU to enable trains to pass its location.

It should be noted that the above description of a failure recovery approach for the AWS system is being disclosed herein for the purpose of describing the preferred embodiment, and is not intended to limit the invention hereto. As would be understood by a person with ordinary skills in the art, a number of variations/modifications can be implemented in the proposed failure recovery process. For example, the signatures data associated with the trains within a protected stack can be transmitted to the ABSU Ahead in order to facilitate the processing of these trains during an ABSU failure. In effect, under this design choice, each ABSU includes a protective stack and an approach stack. Also, in lieu of displaying an overridden aspect upon a failure, the ABSU can display a "call-on" aspect that requires action by the approaching train in order to drive the automatic train stop to the clear position.

The disclosed AWS configuration, together with the architecture, design features and operation of the Absolute Block Signal Unit demonstrate the advantages of the proposed AWS system. The new structure and configuration for the AWS system when integrated with a CBTC installation provide a backup mode of operation without interfering with normal CBTC operation or degrading the availability of the CBTC system. Other advantages of the proposed AWS system include providing an operation compatible with CBTC (i.e. distance-to-go operation), a generic structure that can be easily customized to geographical locations without extensive application engineering requirements, and a self-healing configuration that enables train service to continue during certain AWS failures. Further, the proposed AWS system simplifies the initialization of CBTC installations and can leverage the CBTC infrastructure.

It should be noted that while the preferred embodiment employs a wayside signal module and an associated automatic train stop to provide certain signal functions, the ABSU can be designed without the wayside signal and associated automatic train stop. Under such alternate simplified design, the ABSU continues to track train movements through the CBTC territory, and generates and communicates a MAL to an approaching train only if its associated absolute block area is vacant. The MAL is limited to a single absolute permissive block, and a train must receive a new MAL to proceed past the end of the absolute block. If a train operating with a speed restriction does not stop at an ABSU location to receive a MAL, it can continue to operate with the speed restriction through the new absolute block, which movement has no impact on safety of operation. Obviously, a continuing movement with speed restriction will have an adverse impact on performance. Also, under such simplified ABSU design, the AWS is not capable of supporting the movement of a manual train throughout the CBTC territory. Similarly, it should also be noted that while the preferred embodiment employs a transponder reader at each ABSU location to capture the train ID of a passing train, the ABSU can be designed without the use of a transponder reader. Under such alternate design, train ID data is transmitted from a train to the ABSUs via radio communication. Further, if this alternate design is used, then it is not necessary to equip each train with a transponder that includes the train ID fields. The train ID data can be stored within the on-board computer and transmitted to the ABSUs as part of a radio communication.

BRIEF DESCRIPTION OF THE DRAWINGS

These and other more detailed and specific objectives will be disclosed in the course of the following description taken in conjunction with the accompanying drawings wherein.

DESCRIPTION OF THE PREFERRED EMBODIMENT

Figure 1:
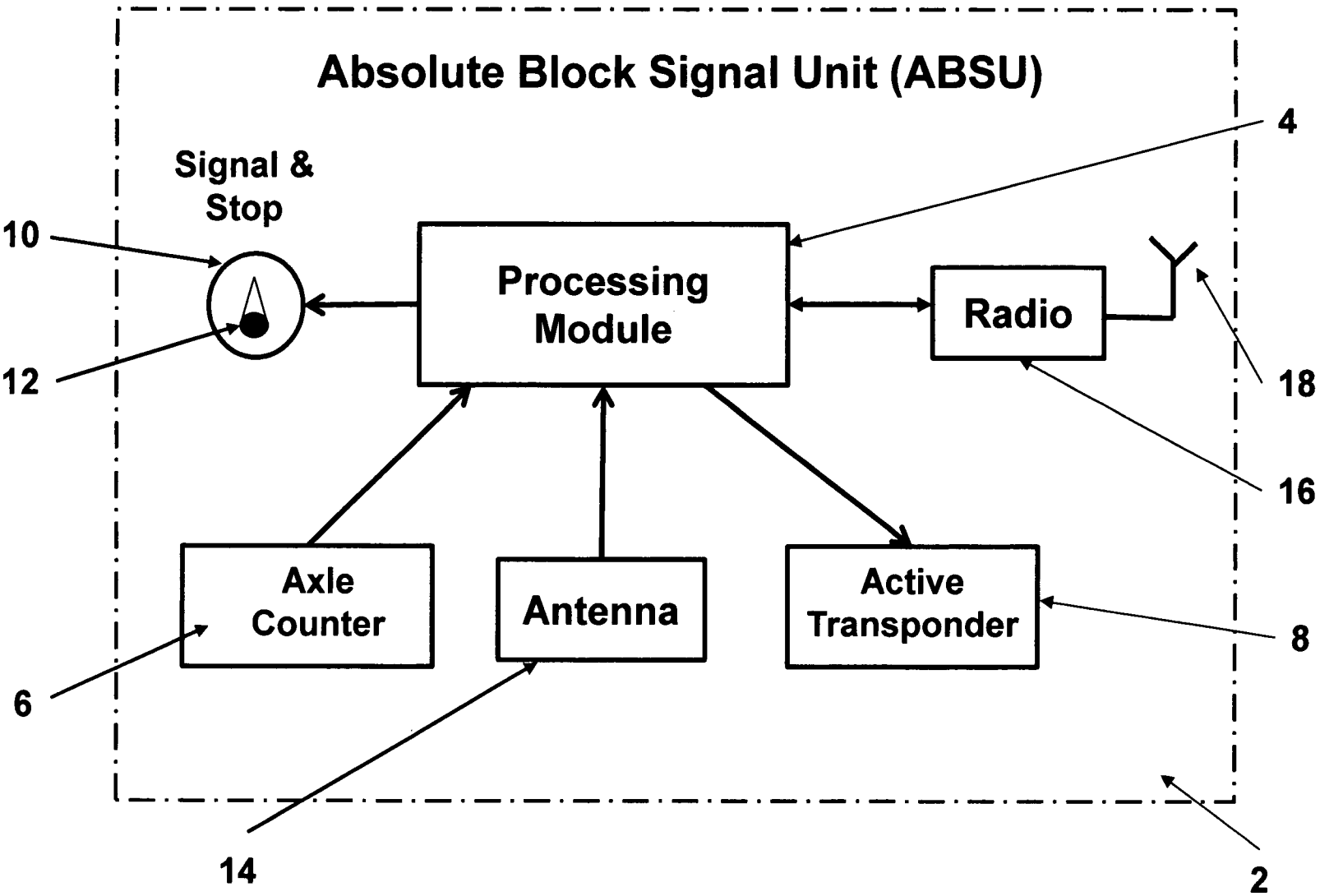
FIG. 1 is a general block diagram of the Absolute Block Signal Unit (ABSU) in accordance with the preferred embodiment of the invention.

The present invention describes a new structure, and/or a new method to implement an Auxiliary Wayside Signal (AWS) system. This new structure is based on the concept of absolute permissive block, and uses an architecture that includes conventional train control equipment to provide the required AWS functions. The proposed AWS system can be integrated with a CBTC installation to provide backup modes of operation, as well as to facilitate the initialization of CBTC equipment (zone controllers and on-board controllers) into CBTC operation. In addition, one of the main characteristics of the proposed AWS system is to be transparent to CBTC operation, and to operate without any impact on CBTC functionalities and availability. Another characteristic of the AWS is to provide a self-healing feature that enables train service to continue in the event of certain AWS failures. The proposed AWS system can also be used as a primary signaling system for simple train control applications, and is designed to provide limited signal protection to manual trains operating without a speed restriction.

To implement the absolute permissive block concept, a new generic structure defined as an Absolute Block Signal Unit (ABSU) is proposed. The architecture of the ABSU employs a number of conventional train control devices that provide basic functions for the operation of the ABSU. These functions include the detection of a train crossing a specific location, communicating with other elements of the AWS system as well as elements of an associated CBTC installation, controlling the movement of a train into an associated absolute permissive block, communicating a movement authority limit (MAL) and/or a civil speed restriction to an approaching train, and detecting certain attributes associated with a train crossing its location.

The preferred embodiment is based on a specific ABSU design that includes a processor module, an axle counter, a transponder reader, an active transponder, a data radio communication module, a wayside signal and associated automatic train stop. Further, the preferred embodiment employs a train identification system that is based on a unique attributes for each train. More specifically, each train is identified by the number of axles in the train consist and an alphanumeric code that includes a fixed field and/or a variable field based on the train's current trip.

The disclosure of the various concepts used by the preferred embodiment is based on a number of operating hypothesis and assumptions. More specifically, it is assumed that under the primary CBTC operation, all trains operating in the CBTC territory are equipped CBTC trains, and that upon a failure of a zone controller, all affected trains will operate with a speed restriction. Also, if a CBTC equipped train fails, it is assumed that it will operate with a speed restriction. The restricted speed is a design choice, but typically train operates at a restricted speed of 10 to 20 mph during a CBTC failure. It is also assumed that under rare operating conditions, a manual train may operate through the CBTC territory without speed restriction and using an absolute block protection from interlocking to interlocking. The safety of operation of the manual train is dependent on compliance with operating rules and procedures, especially the compliance with civil speed limits within the territory. The preferred embodiment includes a design feature that provides a limited protection for a manual train.

Referring now to the drawings where the illustrations are for the purpose of describing the preferred embodiment of the invention and are not intended to limit the invention hereto, FIG. 1 is a block diagram of the general architecture for the Absolute Block Signal Unit 2. The ABSU includes a processing module 4, an axle counter 6, an active transponder 8, a transponder antenna 14, a data radio module 16 with associated antenna 18, and a wayside signal 10 with associated automatic train stop 12. The processor module 4 controls the operation of the ABSU 2, and processes input signals from the axle counter 6, the transponder antenna 14, the automatic train stop 12, as well as data received from the data radio data module 16. Also, the processor module 4 generates data and/or control signals for the active transponder 8, the wayside signal 10, the automatic train stop 12, as well as data to be transmitted via the data radio module 16. The wayside signal 10 could be of the position light type, color light type or color position light type signal. For the preferred embodiment, the wayside signal is a color position light type signal. Further, the automatic train stop 12 could be of the mechanical type with a circuit controller, a magnetic type or a transponder based stop device. For the preferred embodiment, the automatic train stop is of the mechanical type with circuit controller. In addition, the data radio module 16 is of the same type used by an associated CBTC installation to enable the ABSU to communicate with CBTC equipped trains and other CBTC system elements.

Communications between adjacent ABSUs could be through data radio communication, or via a backbone fiber optic network that also interconnect the ABSUs with elements of the CBTC installation, including zone controllers, an ATS subsystem, interlocking control devices, etc. For the preferred embodiment, communications between the ABSUs is via data radio communication. As indicated above, the ABSU can be located at a CBTC radio location in order to leverage the CBTC communication infrastructure (i.e. both radio and fiber optic data communication).

It should be noted that the transponder antenna 14 is physically located in the approach to the ABSU location to enable the processing of train information by the ABSU as the train is approaching its location. Similarly, the active transponder 8 is physically located in the approach to the ABSU location, and could be supplemented by additional transponders or an inductive loop to maintain continuous and smooth train operation. It should also be noted that once a train is identified to an ABSU, its signature will propagate along the line via ABSU to ABSU communication. The data received from the transponder antenna 14 acts as confirmation of the train signature received through ABSU to ABSU communication.

The absolute permissive block concept is based on providing a movement authority to a particular train at a specific location to move for a specific distance or to a specific location. To facilitate the implementation of this concept, the preferred embodiment employs a train identification system that is based on a unique "signature" for each equipped CBTC train. Since it is anticipated that non-equipped trains may operate in the territory, the signature includes two elements, and one of these elements is also present in non-equipped trains. More specifically, the train signature includes a first element that consists of the number of axles in the train consist, and a second element that comprises an alphanumeric code embedded in a transponder mounted on the train. For the preferred embodiment, the alphanumeric code includes two fields, the first field contains a fixed train ID, and the second field includes a trip ID that changes for each train trip. Therefore, for a non-equipped train, only one field (# of train axles) is present in the train signature. The use of the train signature enables the implementation of a number of safety functions, including ensuring that all the cars within a particular train have passed a specific location, tracking a specific train among a "stack" of trains, and facilitating the interfaces with the CBTC installation.

Although the Auxiliary Wayside Signal system operates independently and autonomously of a CBTC system, it is primarily designed to support the operation of a communication based train control installation. As such, it is desirable that the CBTC installation incorporates certain features to facilitate the interfaces with the proposed AWS. More specifically, it is desirable that each CBTC train be equipped with an active transponder that stores a fixed train ID and a variable trip ID. It is also desirable that the train tracking algorithm within the zone controller tracks the number of axles within each train consist. It should be noted that while it is desirable to incorporate the above features into a CBTC system, the proposed AWS system can function without these features. In such case, the train signature will include one element, namely the number of axles in the train consist.

In order to distinguish a failed non-communicating train from a manual unequipped train, the preferred embodiment includes a data field within the variable trip ID that reflects the operating conditions on the train. Information stored in the data field identify if the train is operating with a speed restriction, or operating with a MAL. The absence of proper code in this data field, or the absence of an entire train signature indicates to the ABSUs that the train must be processed as a manual train. Since the train ID is tracked by the AWS system and is communicated from one ABSU to the next, an ABSU can ascertain the operating status of the approaching train upon receiving a communication from the Approach ABSU.

Figure 2:
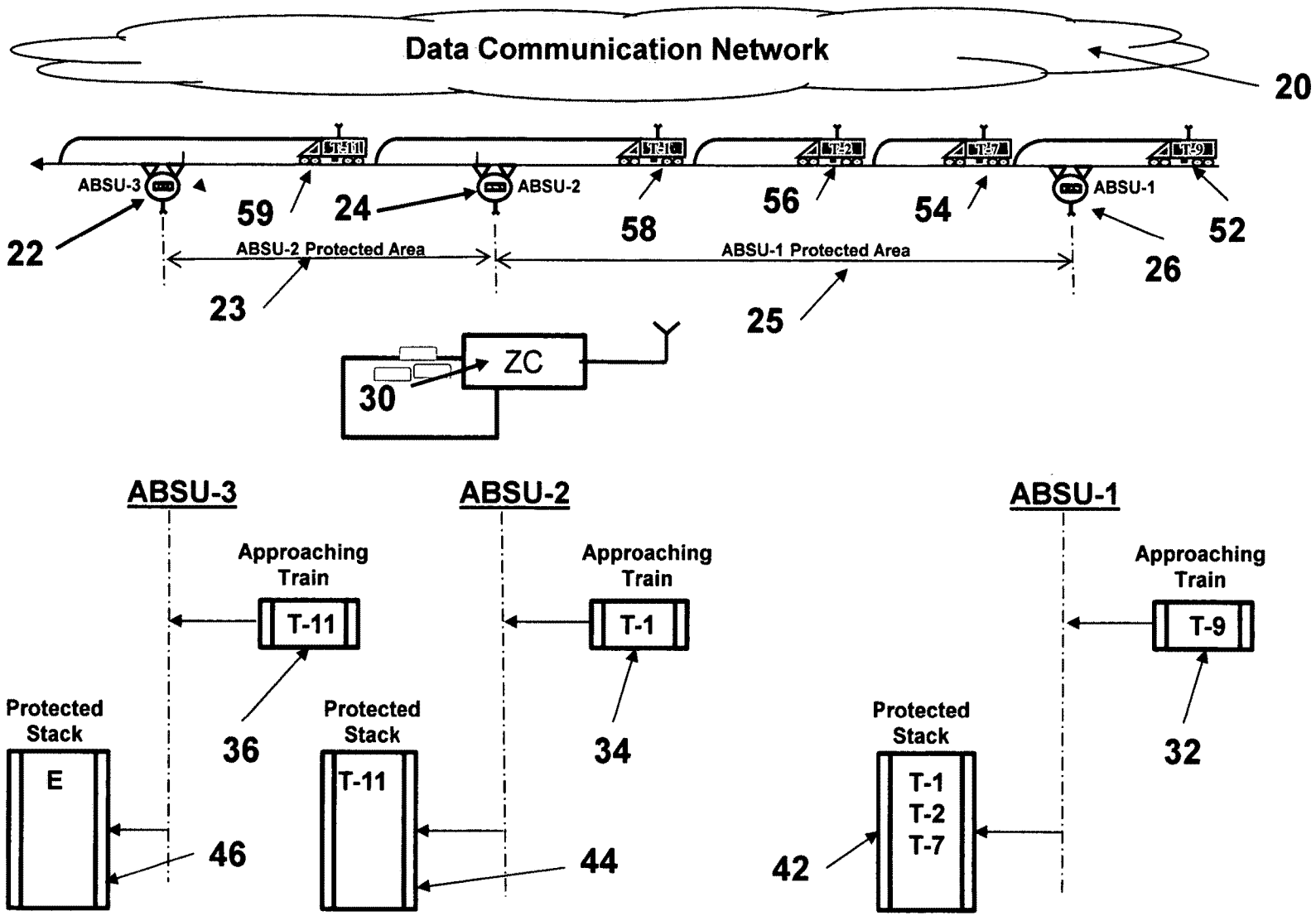
FIG. 2 shows a typical AWS installation that includes three (3) ABSUs that operate autonomously of a zone controller in a "standby" mode in accordance with the preferred embodiment of the invention.

The AWS system includes a plurality of ABSUs that are installed on the right of way, and are interconnected by a fiber optic data communication network, or through data radio communications. The number and spacing between ABSUs is a design choice, and is dependent on the desired operating headway for the AWS system. FIG. 2 shows a typical AWS installation that includes three (3) ABSUs 22, 24 & 26. The AWS system is installed in conjunction with a CBTC system that includes a zone controller 30, a data communication network 20, and onboard CBTC equipment installed on trains 52, 54, 56, 58 & 59. The data communication network 20 provides communication between the zone controller 30 and the CBTC equipped trains, as well as communication between the ABSUs 22, 24 & 26 and between the ABSUs and the CBTC elements. The ABSUs have two modes of operation, a "standby" mode that is in effect when CBTC is operating normally, and an "active" mode when CBTC is experiencing a failure. During the standby mode of operation, an ABSU monitors train operation within an associated absolute permissive block. In that respect, ABSU-1 26 monitors train operation within absolute block 25, and ABSU-2 24 monitors train operation within absolute block 23. Also, to facilitate the description of the preferred embodiment, with respect to ABSU-2 24, ABSU-1 26 is defined as the Approach ABSU, and ABSU-3 22 is defined as the ABSU Ahead.

Each ABSU includes a data stack defined as "protected stack" that stores the number of trains as well as the signature of each train operating within the associated absolute permissive block. The stack is of the first-in-first-out type, and is used to control the movements of trains during CBTC failures. As such, protected stack 42 is associated with ABSU-1 26, protected stack 44 is associated with ABSU-2 24, and protected stack 46 is associated with ABSU-3 22. In addition, each ABSU includes an "Approaching Train" data field that stores the signature information associated with the first train approaching the ABSU location. As such approaching train data field 32 includes the signature information for the train approaching ABSU-1 26, approaching train data field 34 includes the signature information for the train approaching ABSU-1 24, and approaching train data field 36 includes the signature information for the train approaching ABSU-1 22. It should be noted that the use of a data field to store the signature of the train approaching an ABSU location is disclosed for the purpose of describing the preferred embodiment and is not intended to limit the invention hereto. Another, design choice is for each ABSU to include a second stack that stores the number and signatures of trains approaching the ABSU location (i.e. operating within the absolute block in the approach to the ABSU location). During the standby mode of operation, an ABSU displays a permissive signal indication, and the associated automatic train stop is in the clear position. Further, the ABSU performs three (3) main tasks or functions: First, the ABSU detects the crossing of the train approaching its location. The ABSU uses its axle counter and tag reader to verify that the train identified by the train signature stored in its approaching train data field has completely crossed its location. Upon such verification, the ABSU places the train signature at the bottom of its protected train stack. Second, the ABSU sends a message to the Approach ABSU to indicate that a specific train (as defined by a train signature) has crossed its location. Third, upon receiving a message from the ABSU Ahead that the train at the top of its protected stack has crossed the location of the ABSU Ahead, it removes that train from the stack, and sends a message to the ABSU Ahead to provide the signature of the next train in the stack that will be approaching the location of the ABSU Ahead. In the event, the protected stack is empty, then the ABSU sends a message to the ABSU Ahead indicating that no train is approaching its location.

The ABSU active mode of operation is triggered when the associated CBTC system experiences a failure. During the active mode, and if the protected stack of an ABSU includes any trains, then the ABSU displays a stop aspect, and the associated automatic train stop is set to the tripping position. The ABSU will continue to process the trains in the protected stack similar to the standby mode, and upon verifying that the stack is empty, and depending on operating conditions, it will issue a movement authority limit or a restricted speed for the approaching train to operate through the associated absolute permissive block. In that respect, the operating conditions depend on the nature of the CBTC failure. For example, a zone controller failure causes all trains within its span of control to stop, and then proceed at restricted speed under operating rules and procedures. In such a case, the train signatures will reflect the operation with speed restrictions. A second example, is a single CBTC train failure that results in that train operating at restricted speed under operating rules and procedures. Accordingly, when describing the operation of the ABSUs in active mode, it is necessary to identify the operational assumptions associated with the CBTC failure. It is also important to note that one of the main assumptions related to CBTC and AWS operations is that there is no common failure mode that causes simultaneous failures in both CBTC and AWS. For example, it assumed that a CBTC communication failure will not impact communications between the ABSUs.

It should be noted that the block diagram of FIG. 1 and the above description of the ABSU architecture and functionalities are being set forth herein for the purpose of describing the preferred embodiment, and are not intended to limit the invention hereto. As would be understood by a person of ordinary skills in the art, and as disclosed in the Summary Section of the invention, an alternate ABSU design can be used to implement the main functions of the invention. Pursuant to such alternate design, it is not necessary to provide a transponder reader, a wayside signal and an automatic train stop at each ABSU location. The function of communicating the train ID to the ABSUs can be provided by the on-board data radio. Further, an ABSU can perform all its monitoring functions in the "standby" operating mode without the need for a wayside signal and associated automatic train stop. In addition, during the "active" operating mode, an ABSU can generate and transmit a MAL to an approaching train without the need for said wayside signal and associated automatic train stop.

Figure 3:
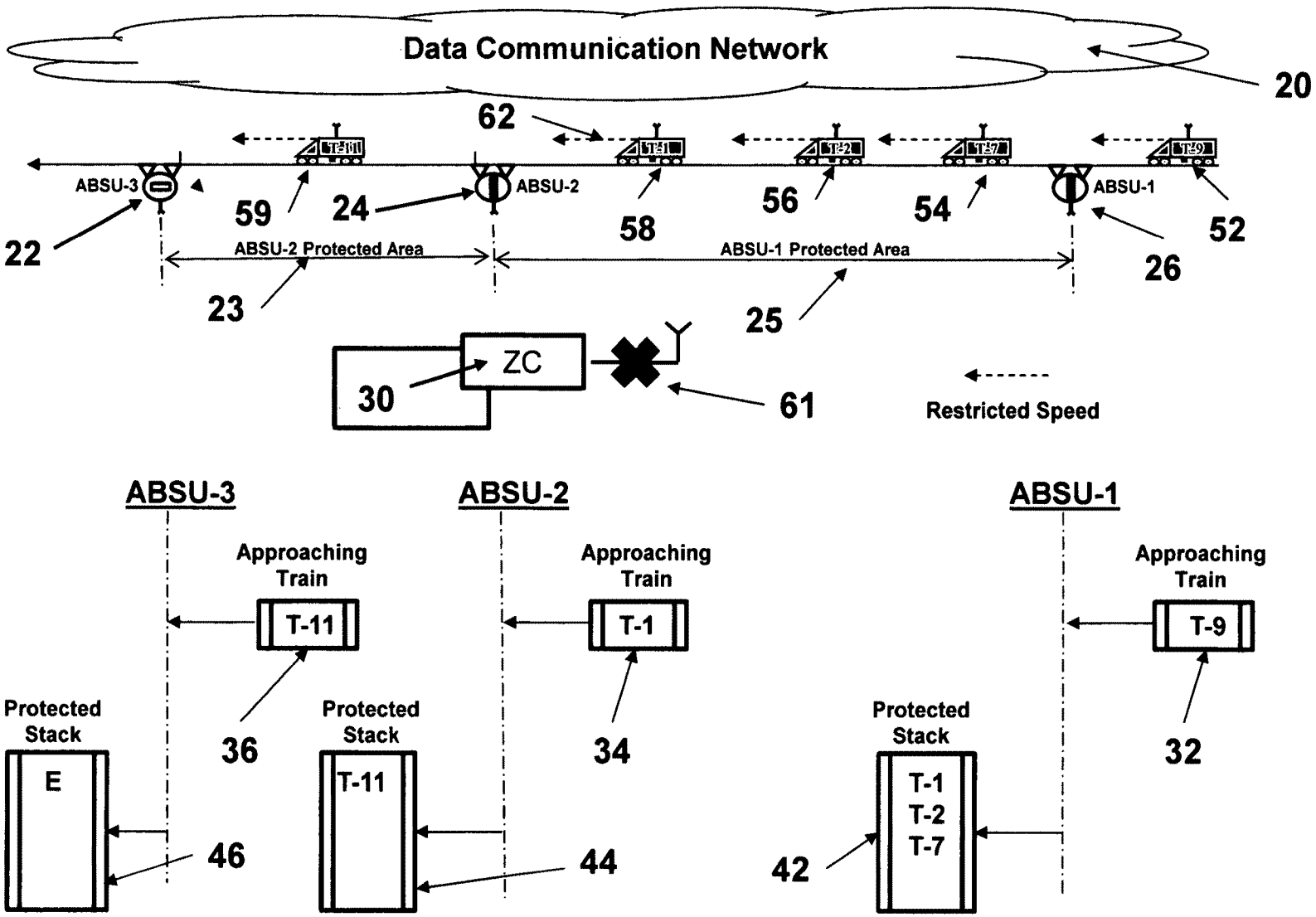
FIGS. 3-18 demonstrate the operation of the AWS installation, including a step by step operation of ABSU-1, ABSU-2 and ABSU-3 in an "active" mode during a zone controller failure.
Figure 4:
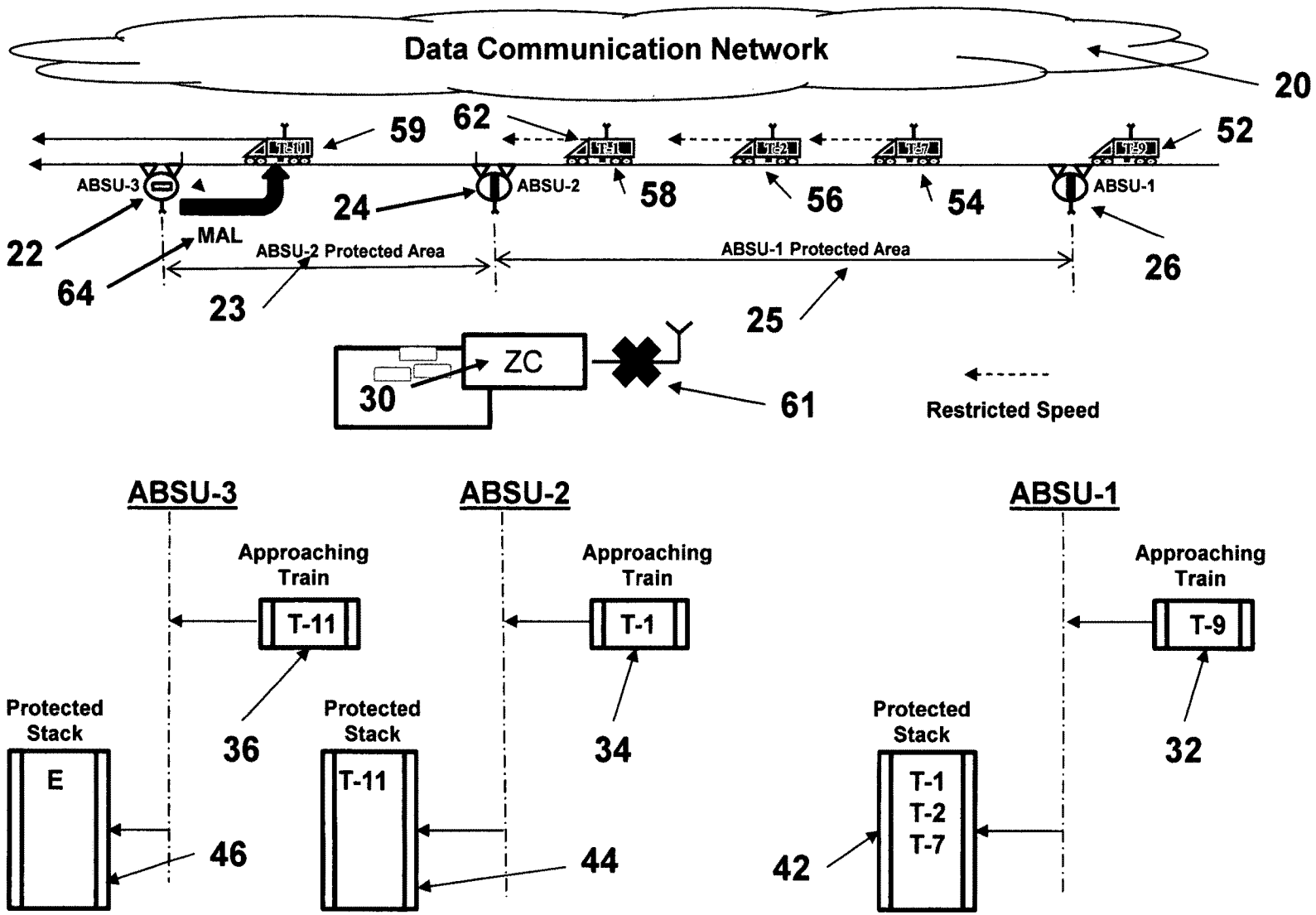

FIGS. 3-18 demonstrate the operation of ABSU-1 26, ABSU-2 24 and ABSU-3 22 during a zone controller failure. As shown in FIG. 3, and upon a zone controller failure 61, all trains T-9 52, T-7 54, T-2 56, T-1 58 & T-11 59 within the span of control of the zone controller 30 will operate with a restricted speed 62. It is assumed that these trains have not experienced a failure, remain localized (i.e. can determine their own locations), and can communicate via radio communication. Also upon the zone controller failure 61, the ABSUs 22, 24 & 26 will switch to the active state. As such, ABSU-1 26 will display a stop aspect, and its associated automatic train stop will be in the tripping position. This is because the protected stack 42 of ABSU-1 26 includes three trains. Similarly, ABSU-2 24 will display a stop aspect, and its associated automatic train stop will be in the tripping position. This is because the protected stack 44 of ABSU-2 24 includes one train. With respect to ABSU-3 22, it will display a permissive aspect, and its automatic train stop will be in the clear position because its protected stack 46 is empty. As shown in FIG. 4, ABSU-3 22 issues a movement authority limit 64 to train T-11 59 to authorize it to proceed to the end of its associated absolute permissive block. Train T-11 59 can then operate to the end of its MAL 64 with normal operating speed, using onboard intelligence and complying with civil speed limits as provided by the onboard vital data base. It should be noted that in the event train T-11 59 does not establish radio communication with ABSU-3 22, then, the MAL 64 will be relayed to train T-11 59 via the active transponder associated with ABSU-3 22. Further, if train T-11 59 becomes delocalized, or if it exhibits a CBTC failure, then it can continue to move with restricted speed pursuant to operating rules and procedures.

Figure 5:
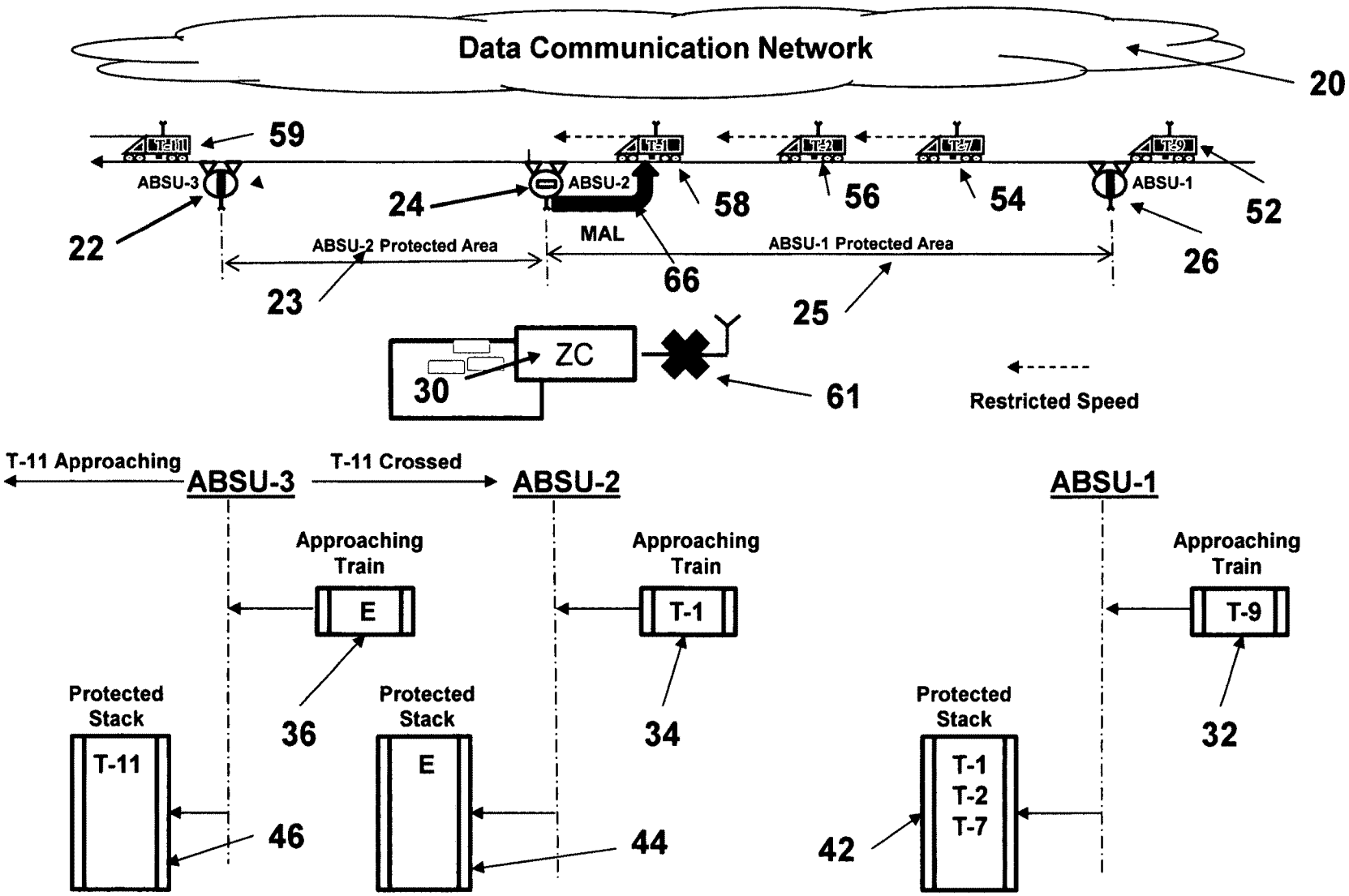

FIG. 5 reflects the movement of train T-11 59 past the location of ABSU-3 22. Upon a completion of this move, ABSU-3 22 displays a stop aspect, and controls its automatic train stop to the tripping position. Further, ABSU-3 22 sends a message to ABSU-2 24 indicating that train T-11 59 crossed its location. In turn, ABSU-2 24 displays a permissive aspect, and controls its automatic train stop to the clear position. ABSU-2 24 will then issue a movement authority limit 66 to approaching train T-1 58. This movement authority limit 66 authorizes train T-1 58 to move up to the location of ABSU-3 22.

Figure 6:
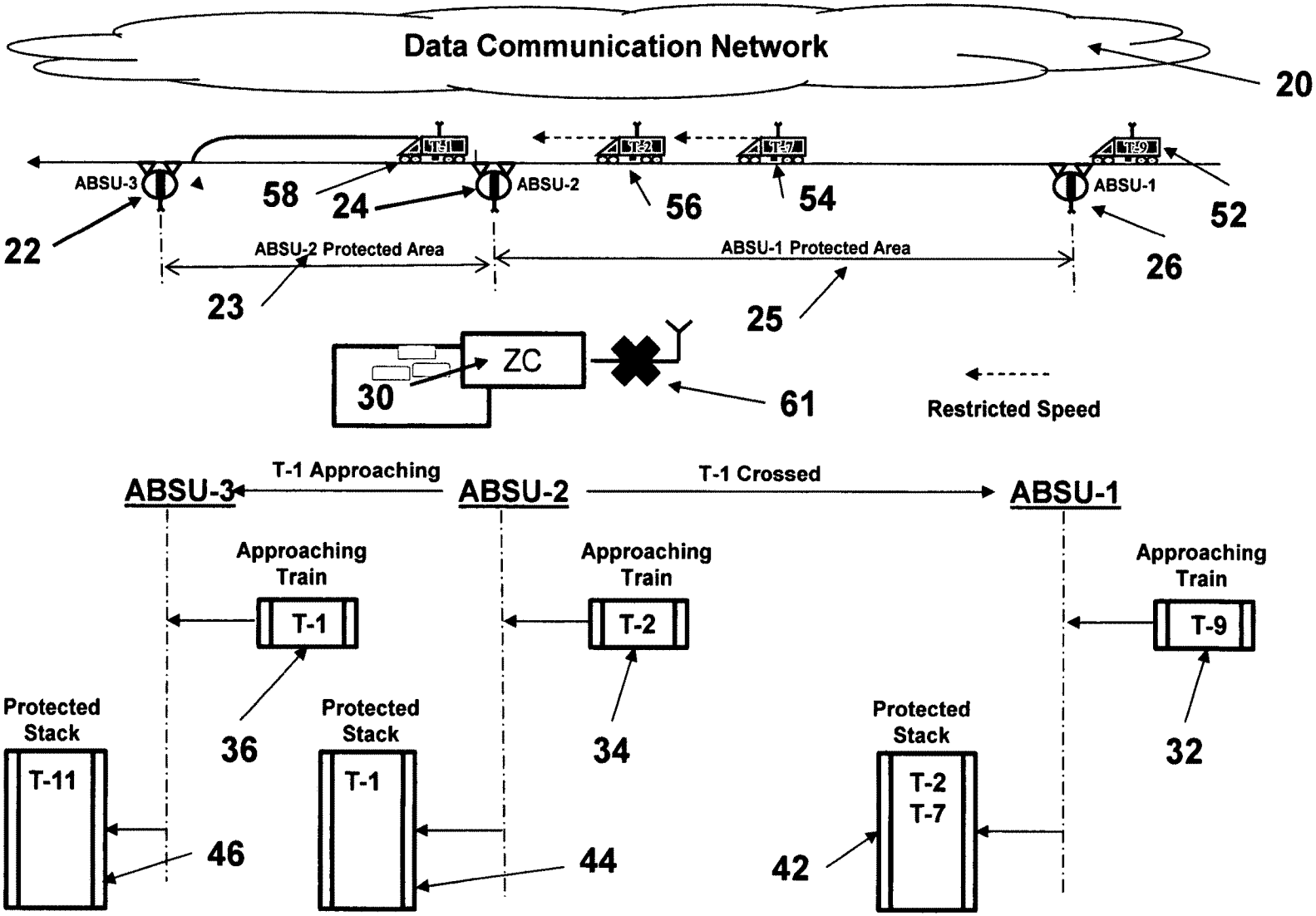

FIG. 6 reflects the movement of train T-1 58 passed the location of ABSU-2 24. Upon a completion of this move, ABSU-2 24 displays a stop aspect, and controls its automatic train stop to the tripping position. Further, ABSU-2 24 sends a message to ABSU-1 26 indicating that train T-1 58 crossed its location. In addition, ABSU-2 24 sends a message to ABSU-3 22 indicating that train T-1 58 is approaching the location of ABSU-3 22.

Figure 7:
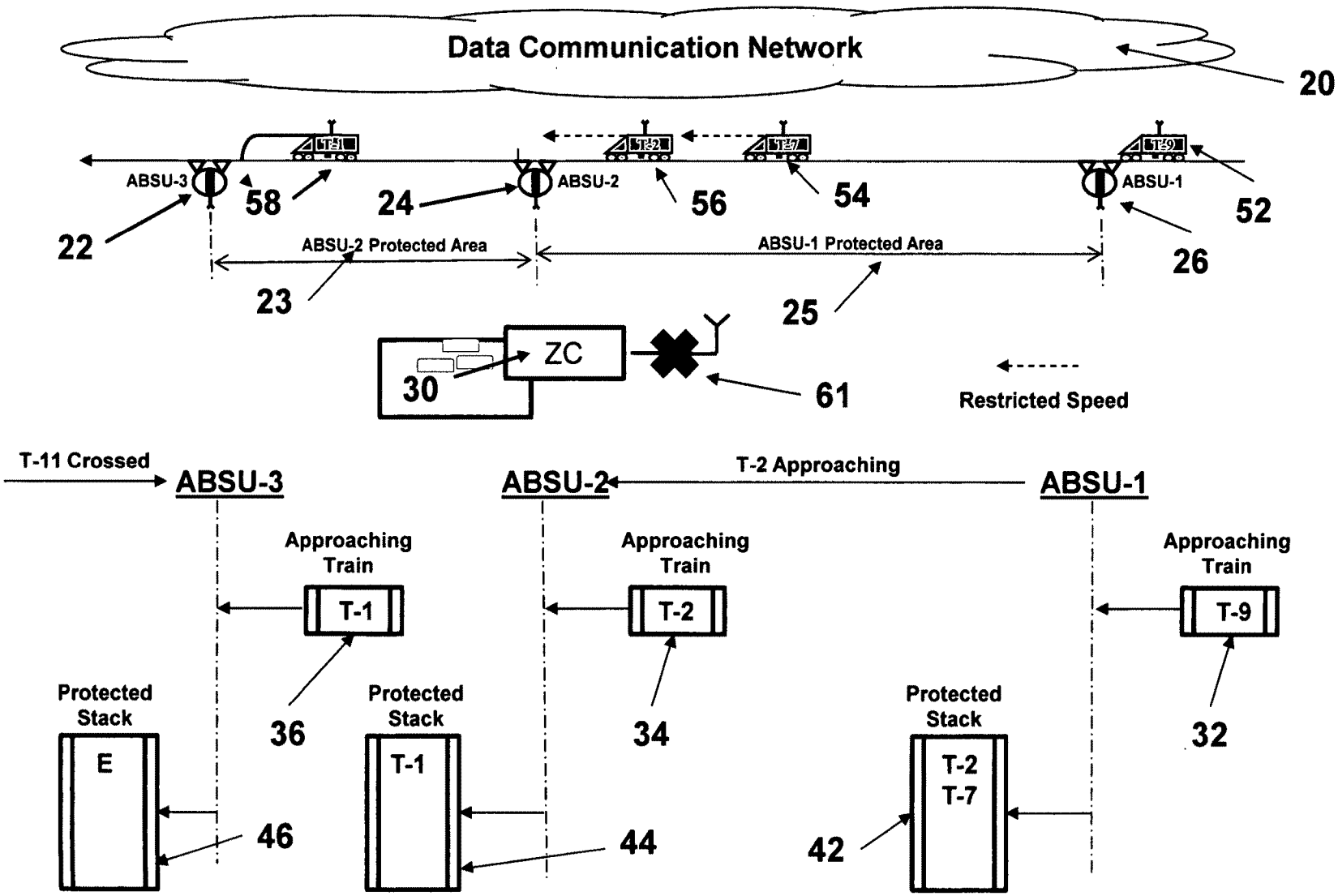
Figure 8:
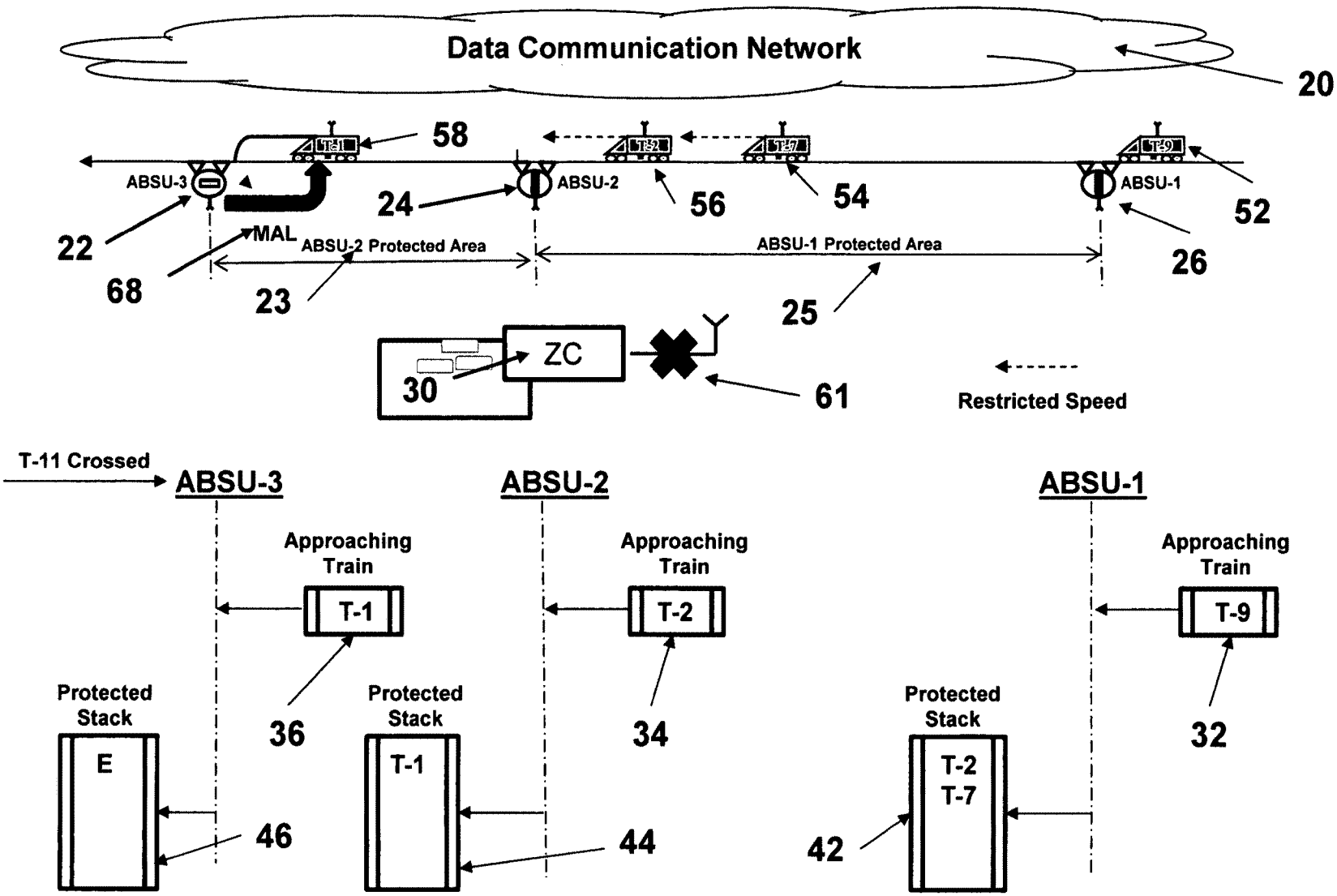

FIG. 7 reflects the movement of train T-11 59 out of the absolute permissive block associated with ABSU-3 22. Also, it indicates that ABSU-1 26 has sent a message to ABSU-2 24, indicating that train T-2 56 is approaching the location of ABSU-2 24. Then FIG. 8 reflects the operation of ABSU-3 22 following the movement of train T-11 out of its absolute permissive block. ABSU-3 22 is indicated to display a permissive aspect, and its automatic train stop is in the clear position. Also, ABSU-3 22 is communicating a movement authority limit to train T-1 58 to proceed through its associated absolute permissive block.

Figure 9:
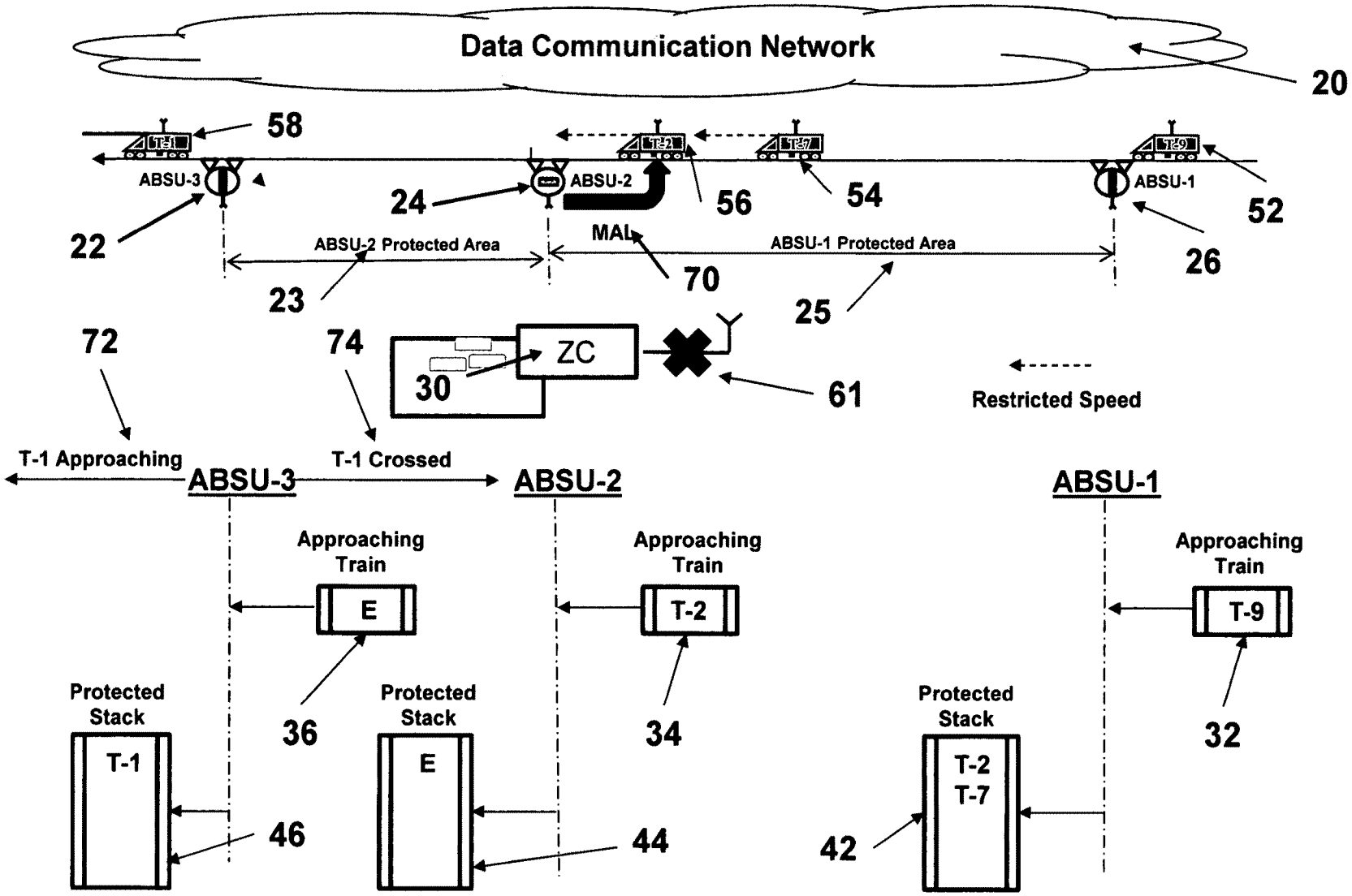
Figure 10:
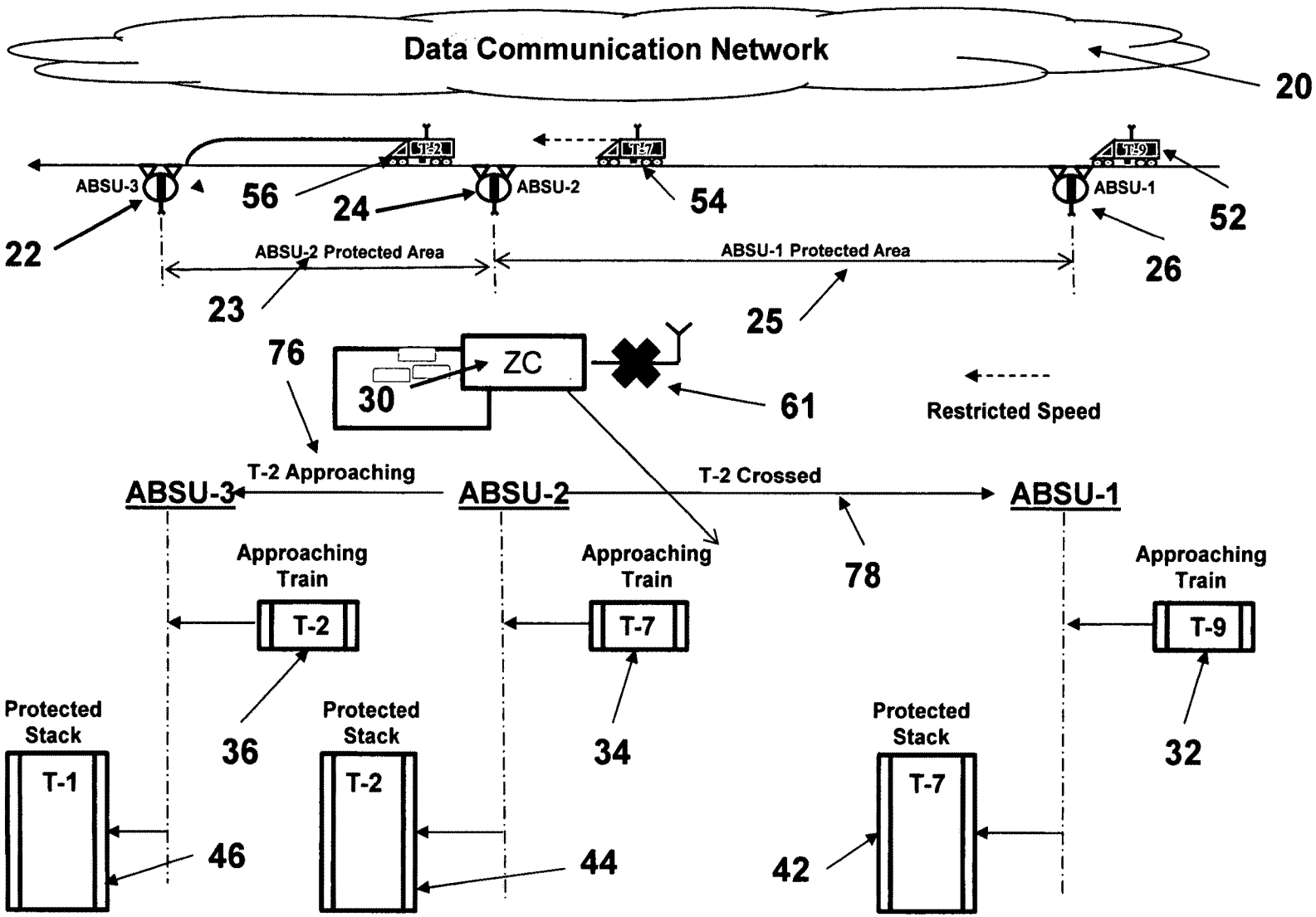
Figure 11:
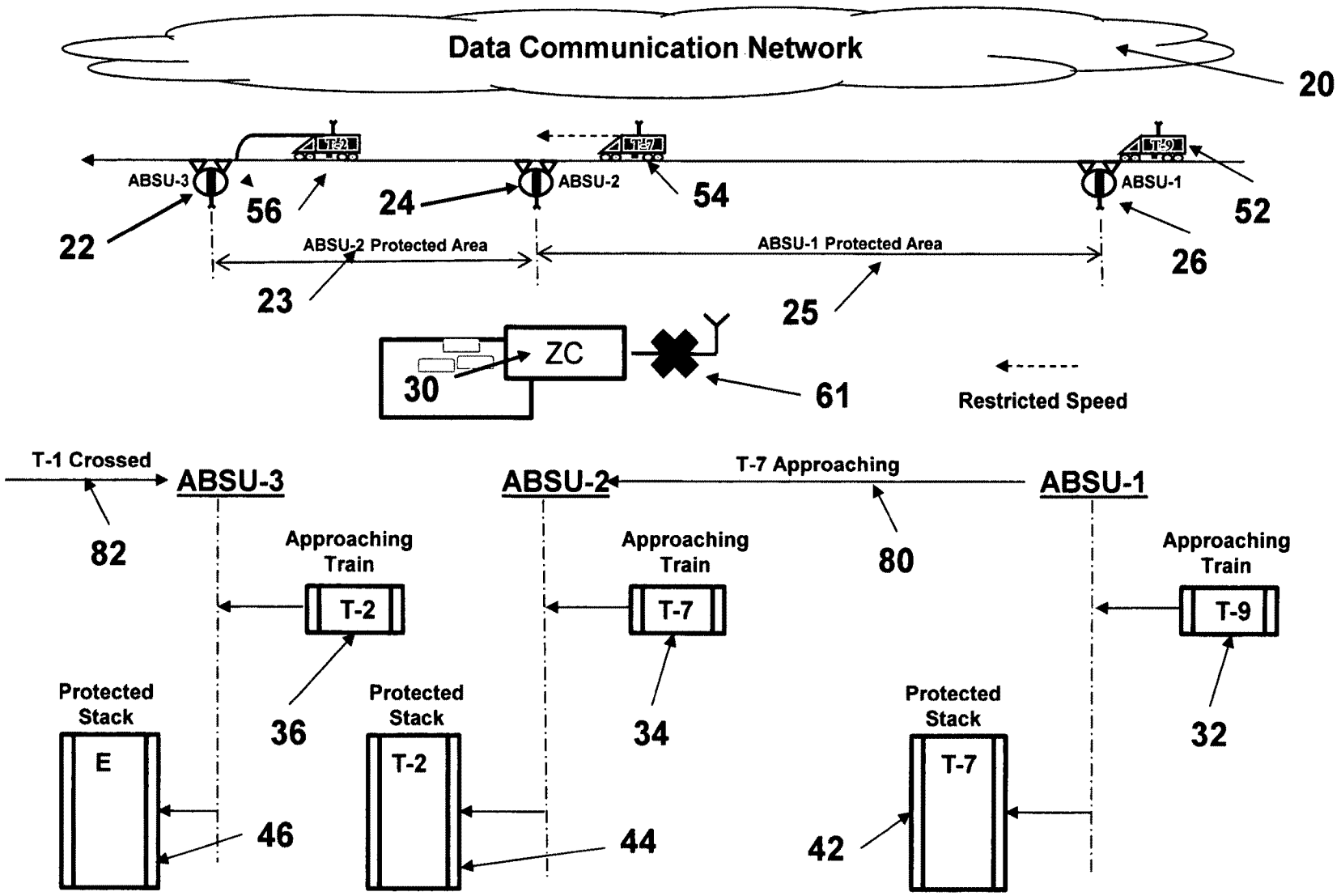
Figure 12:
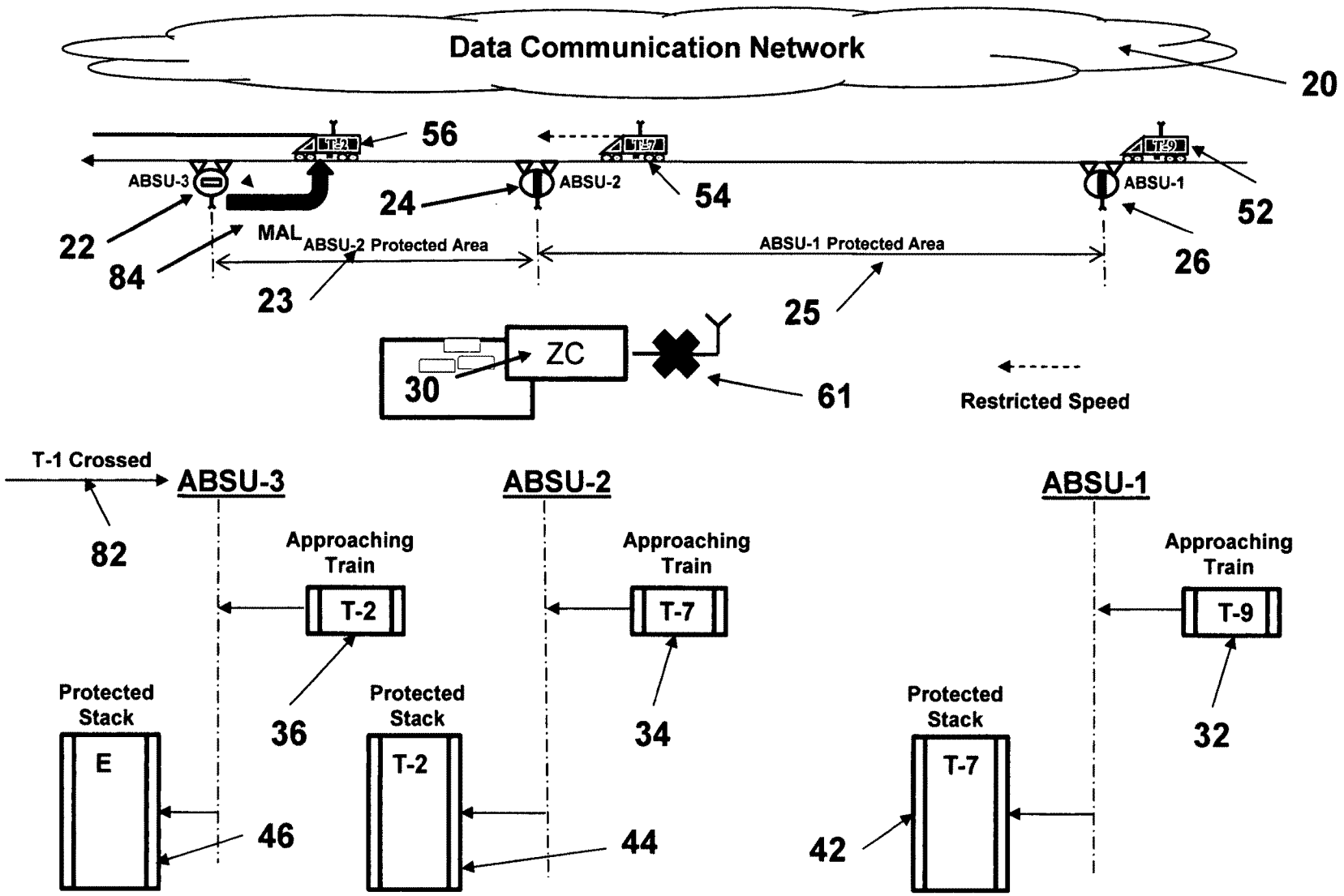

FIG. 9 reflects the movement of train T-1 58 past the location of ABSU-3 22, the permissive state of ABSU-2 24, and the communication of a MAL 70 to train T-2 56. This figure also shows the communications 72 & 74 between the various ABSUs. Similarly, FIG. 10 reflects the movement of train T-2 56 past the location of ABSU-2 24, and the communications 76 & 78 between the various ABSUs. FIGS. 11 & 12 show additional communications 80 & 82 between the ABSUs, as well as the communication of a MAL 84 to train T-2 56.

Figure 13:
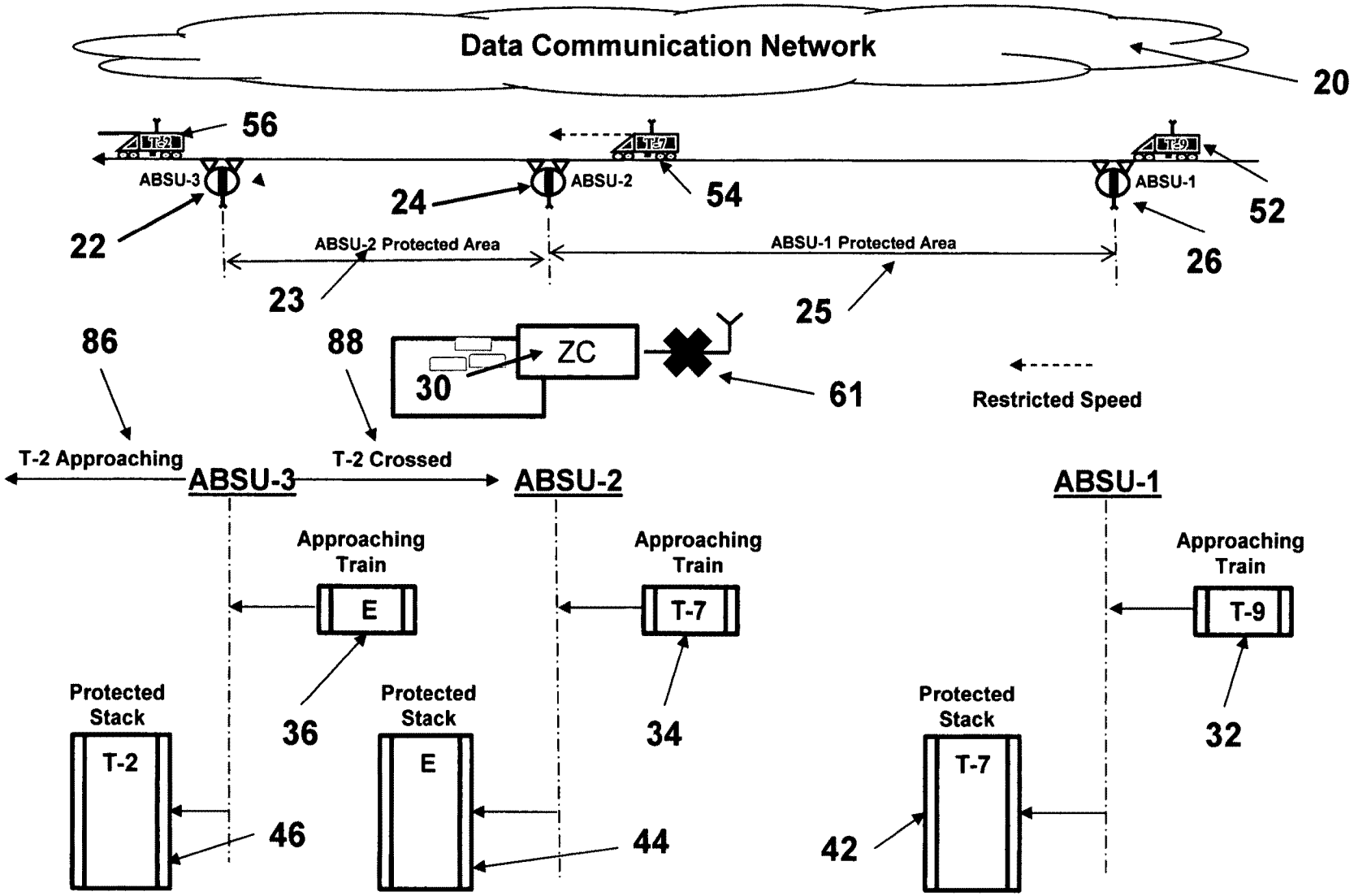
Figure 14:
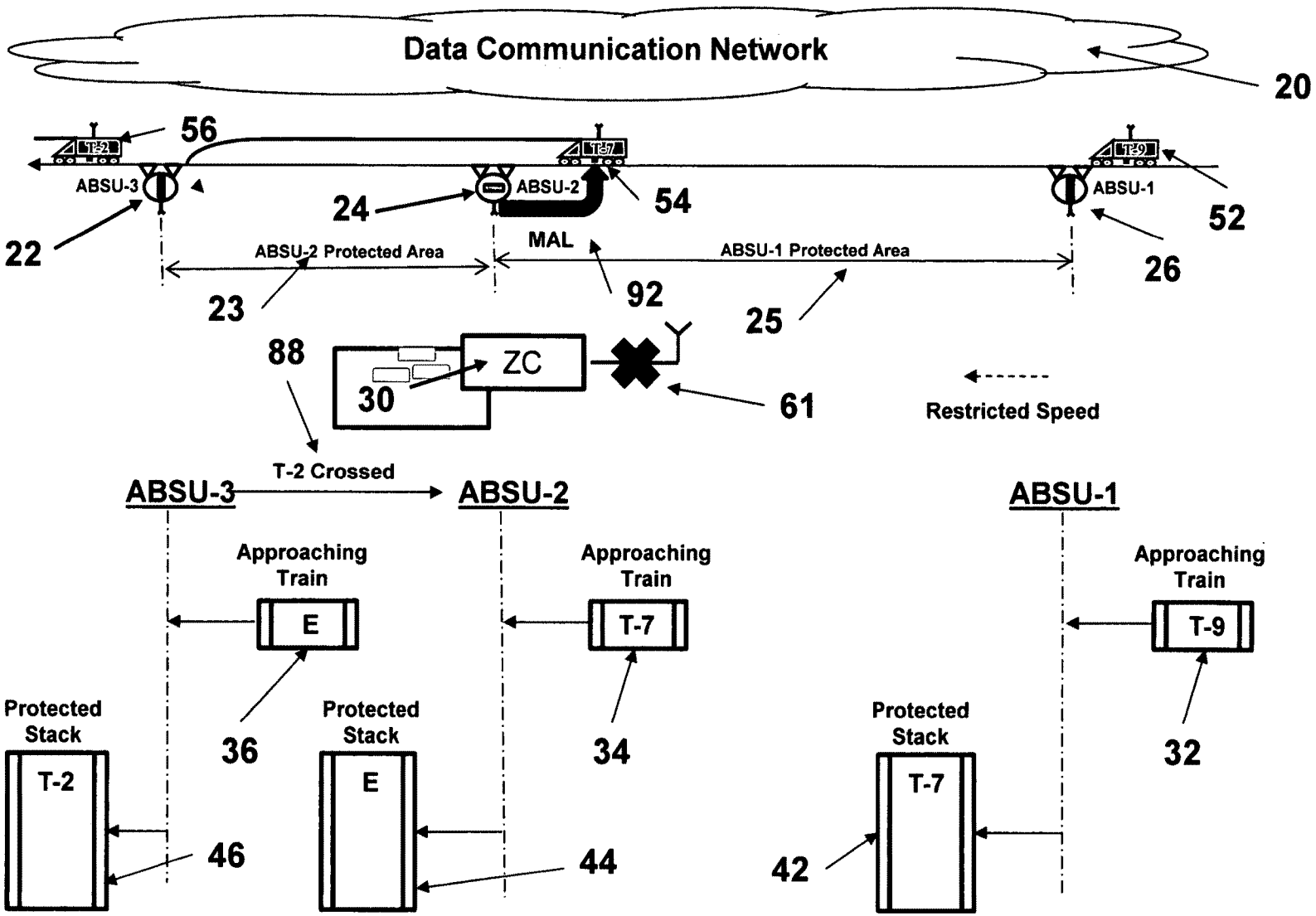
Figure 15:
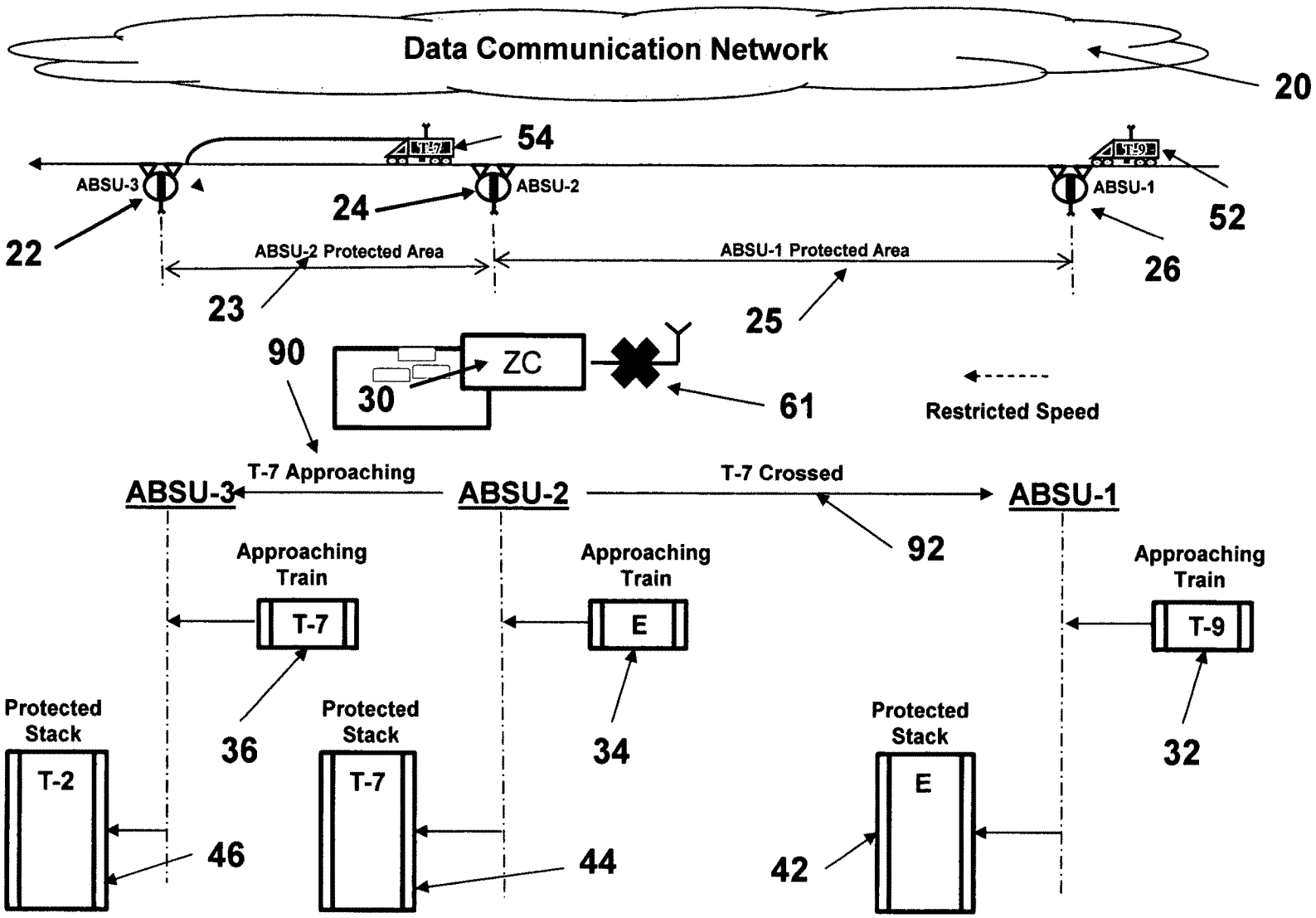
Figure 16:
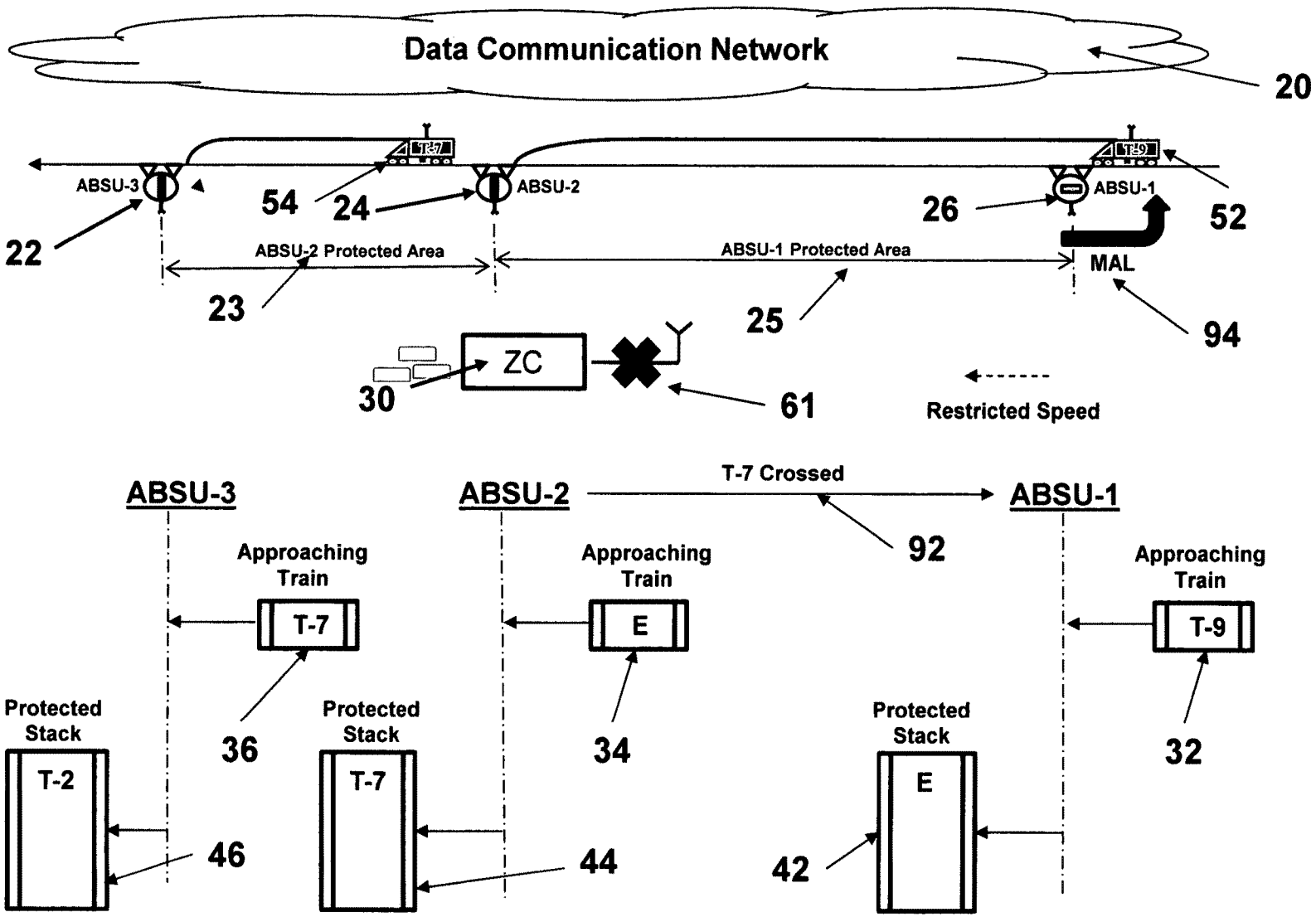
Figure 17:
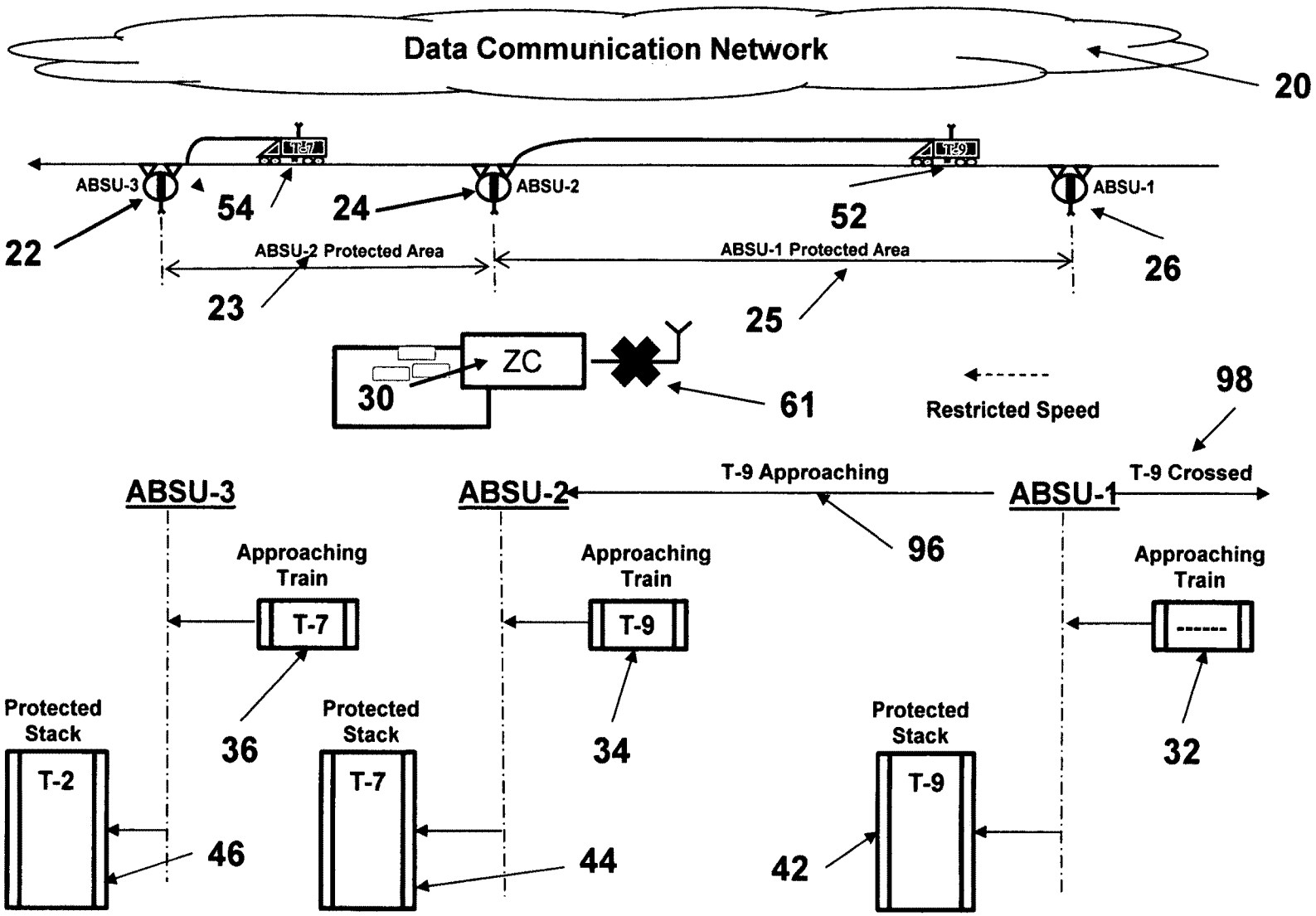
Figure 18:
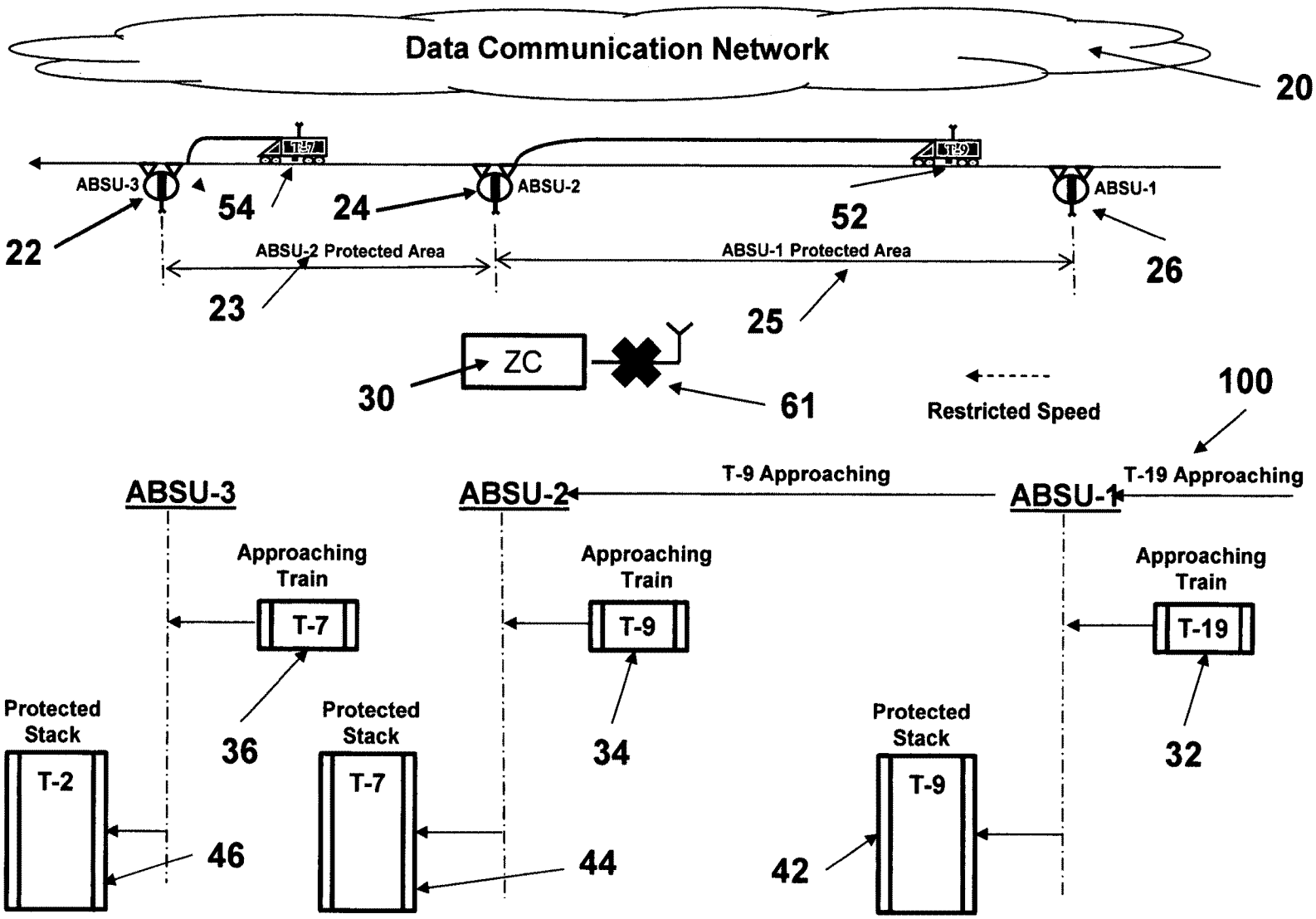

FIG. 13 reflects the movement of train T-2 56 past ABSU-3 22, and shows the communications 86 & 88 from ABSU-3 22 to adjacent ABSUs. Then FIG. 14 shows the communication of a MAL 92 to train T-7 54. Similarly, FIG. 15 reflects the movement of train T-7 56 past ABSU-2 24, and shows the communications 90 & 92 from ABSU-2 24 to adjacent ABSUs. Then FIG. 16 shows the communication of a MAL 94 to train T-9 52. Also, FIG. 17 reflects the movement of train T-9 52 past ABSU-1 26, and shows the communications 96 & 98 from ABSU-1 26 to adjacent ABSUs. FIG. 18, the last figure in this operating scenario of a zone controller failure 61, shows communication 100 to ABSU-1 26 that train T-19 is approaching. The operation of the AWS will continue until the zone controller operates properly.

Figure 19:
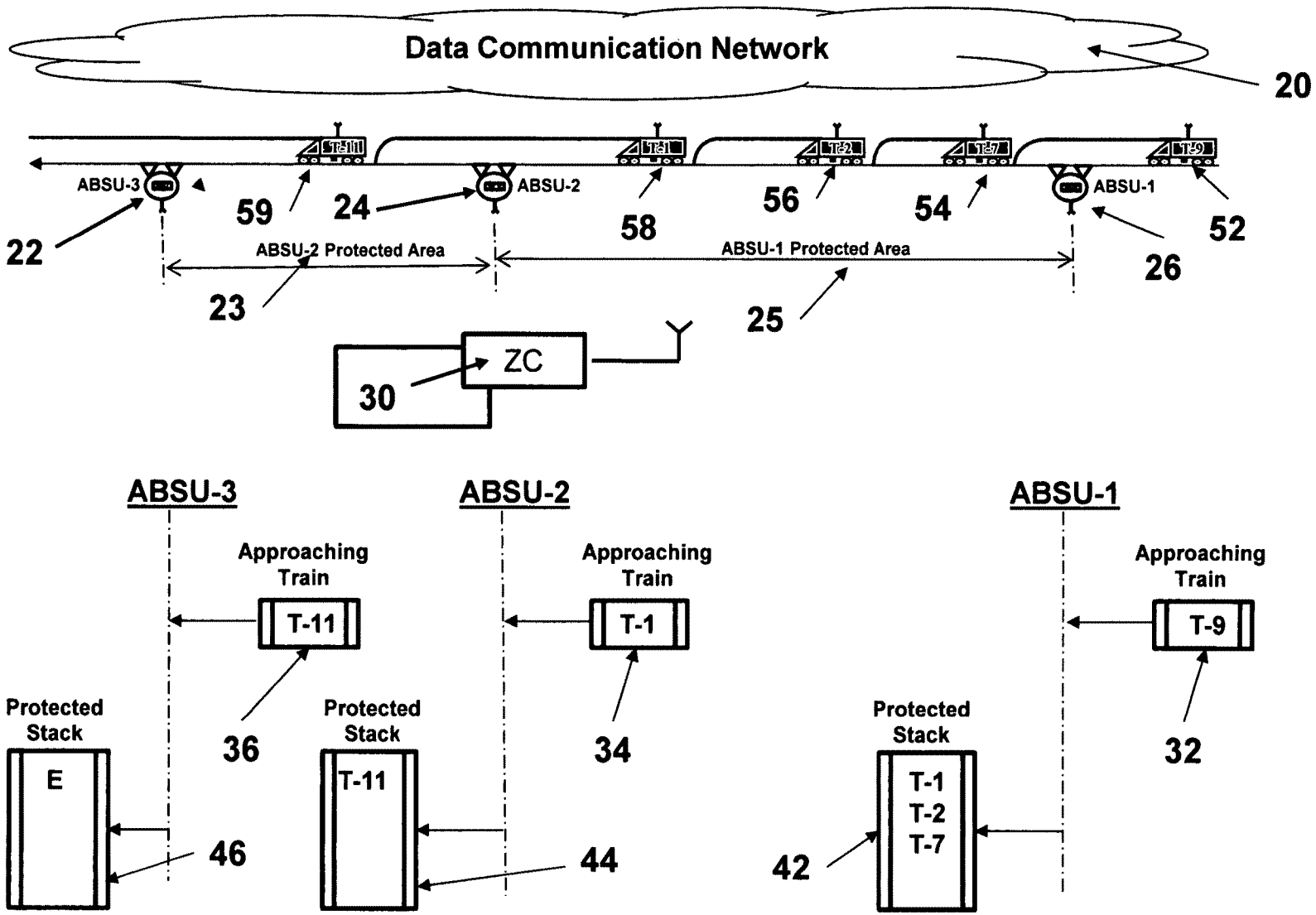
FIG. 19 shows the AWS operating conditions prior to a failure of a CBTC equipped train.
Figure 20:
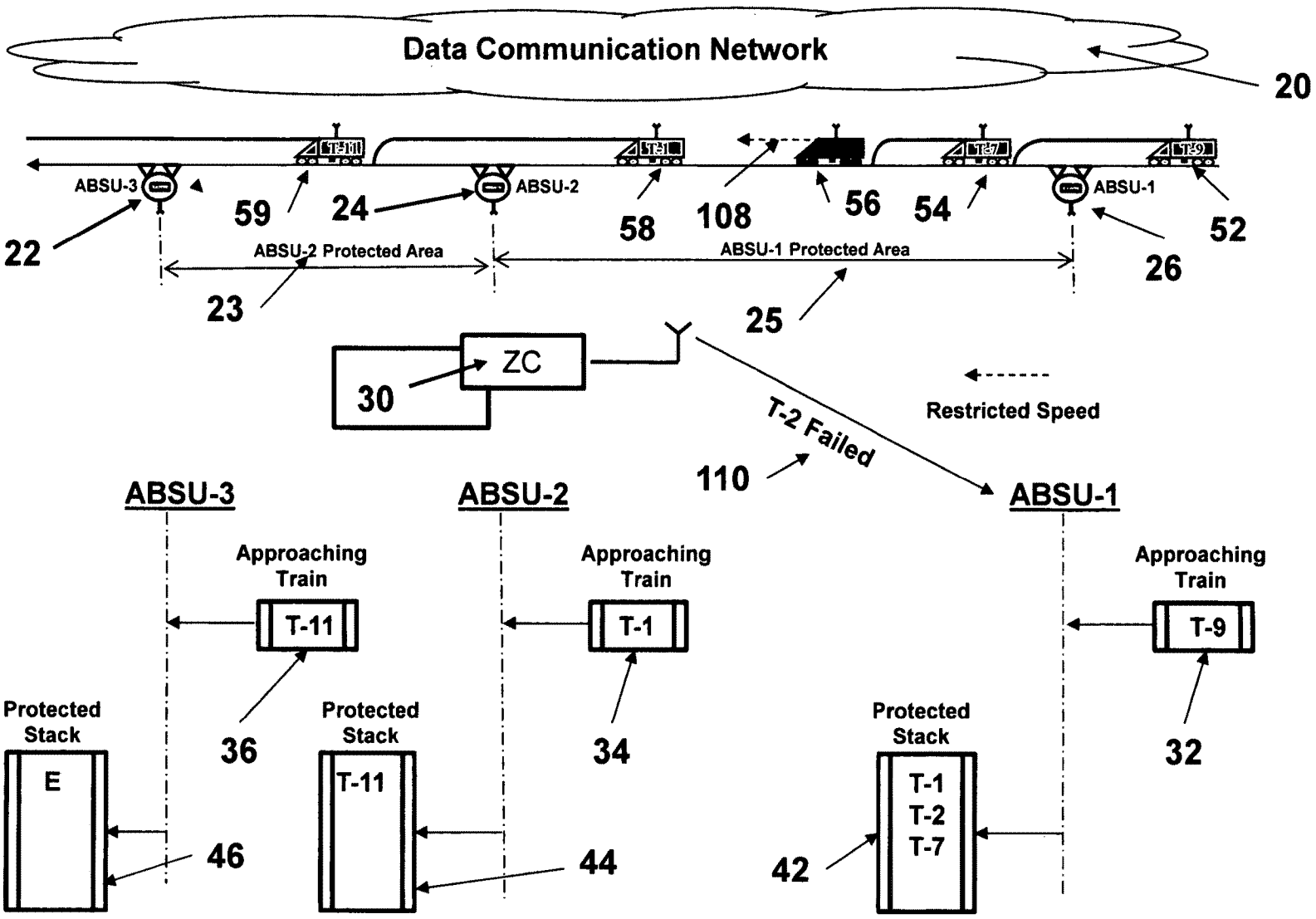
FIGS. 20-33 demonstrate the operation of the AWS installation, including a step by step operation of ABSU-1, ABSU-2 and ABSU-3 in an "active" mode as a failed CBTC train moves through the AWS territory.
Figure 21:
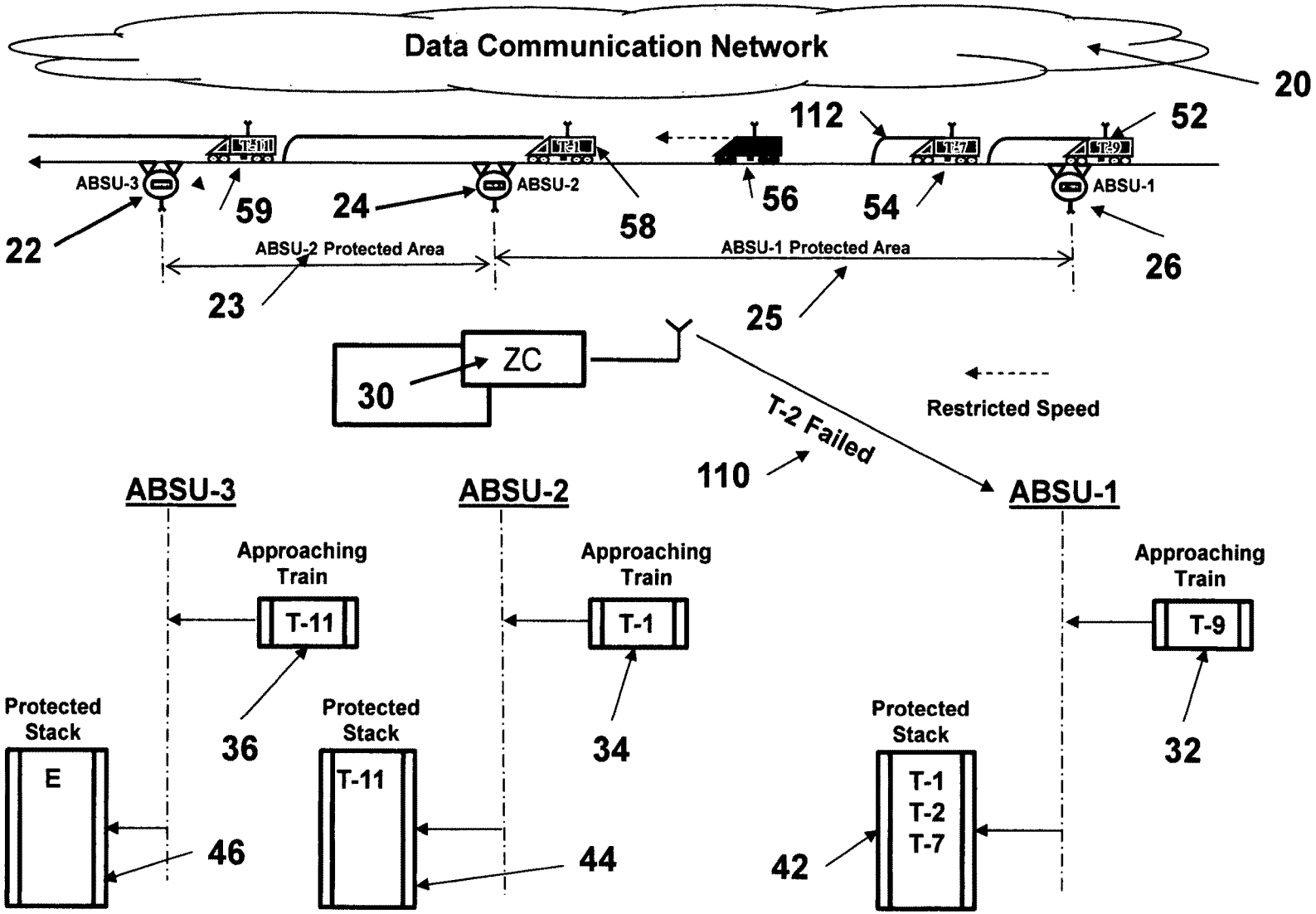

A second AWS operating scenario is related to a failure of a single CBTC train, and is demonstrated in FIGS. 19-33. These figures show the operation of ABSU-1 26, ABSU-2 24 and ABSU-3 22 as the failed CBTC train moves through the territory. FIG. 19 indicate the operating conditions prior to the failure, wherein zone controller 30, and CBTC equipped trains T-9 52, T-7 54, T-2 56, T-1 58 & T-11 59 operate normally. Then FIG. 20 indicates that train T-2 56 has failed, and that upon such failure train T-2 56 is able to move with CBTC default restricted speed 108. Also, upon the failure of train T-2 56, the zone controller 30 informs 110 ABSU-1 26 of the failure. FIG. 21 indicates that the MALs for trains T-9 52, T-1 58 & T-11 59 are updated. However, the MAL 112 for train T-7 54 cannot be updated since failed train T-2 56 is not reporting its current location. Train T-2 56 continues to move with speed restriction.

Figure 22:
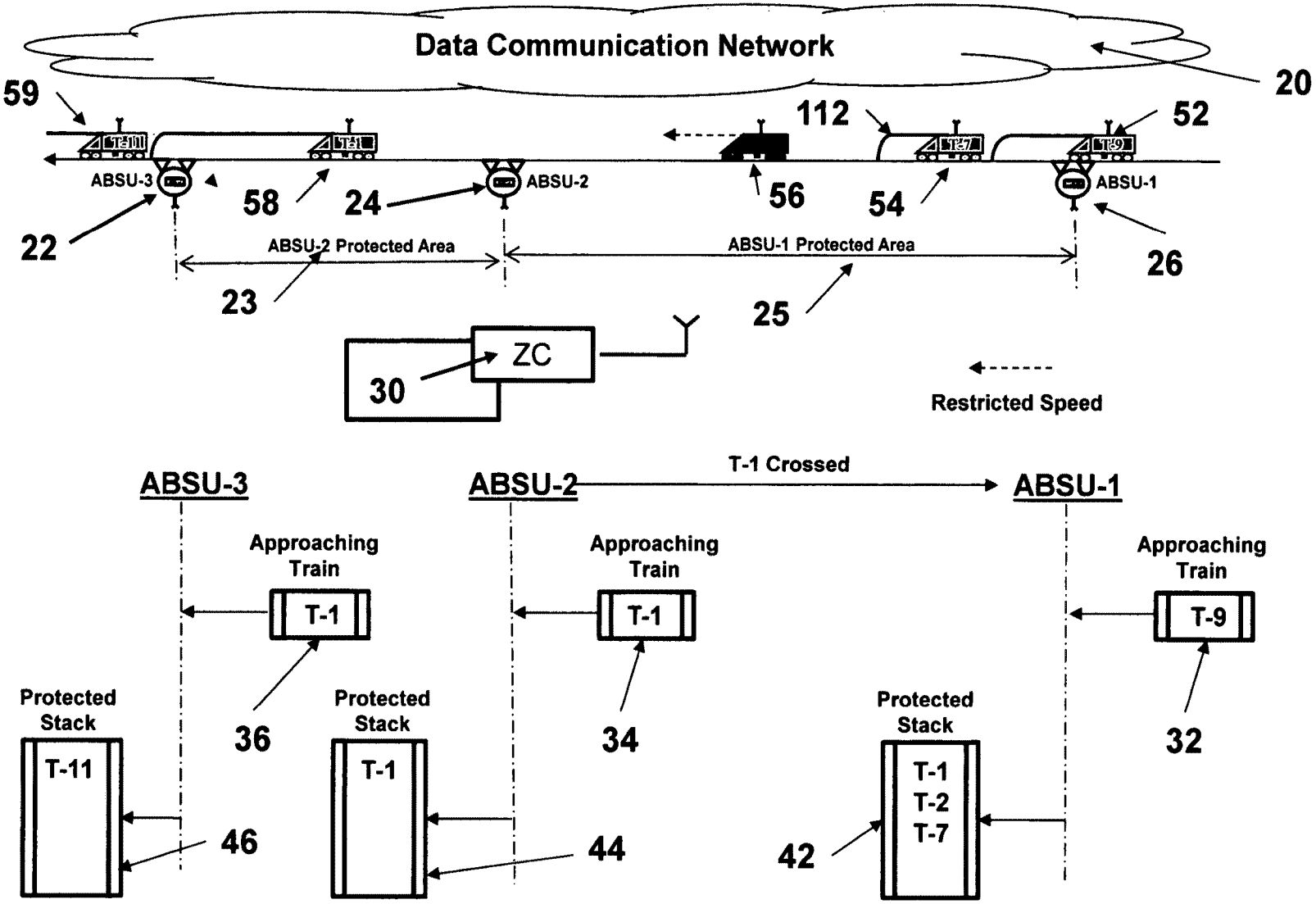
Figure 23:
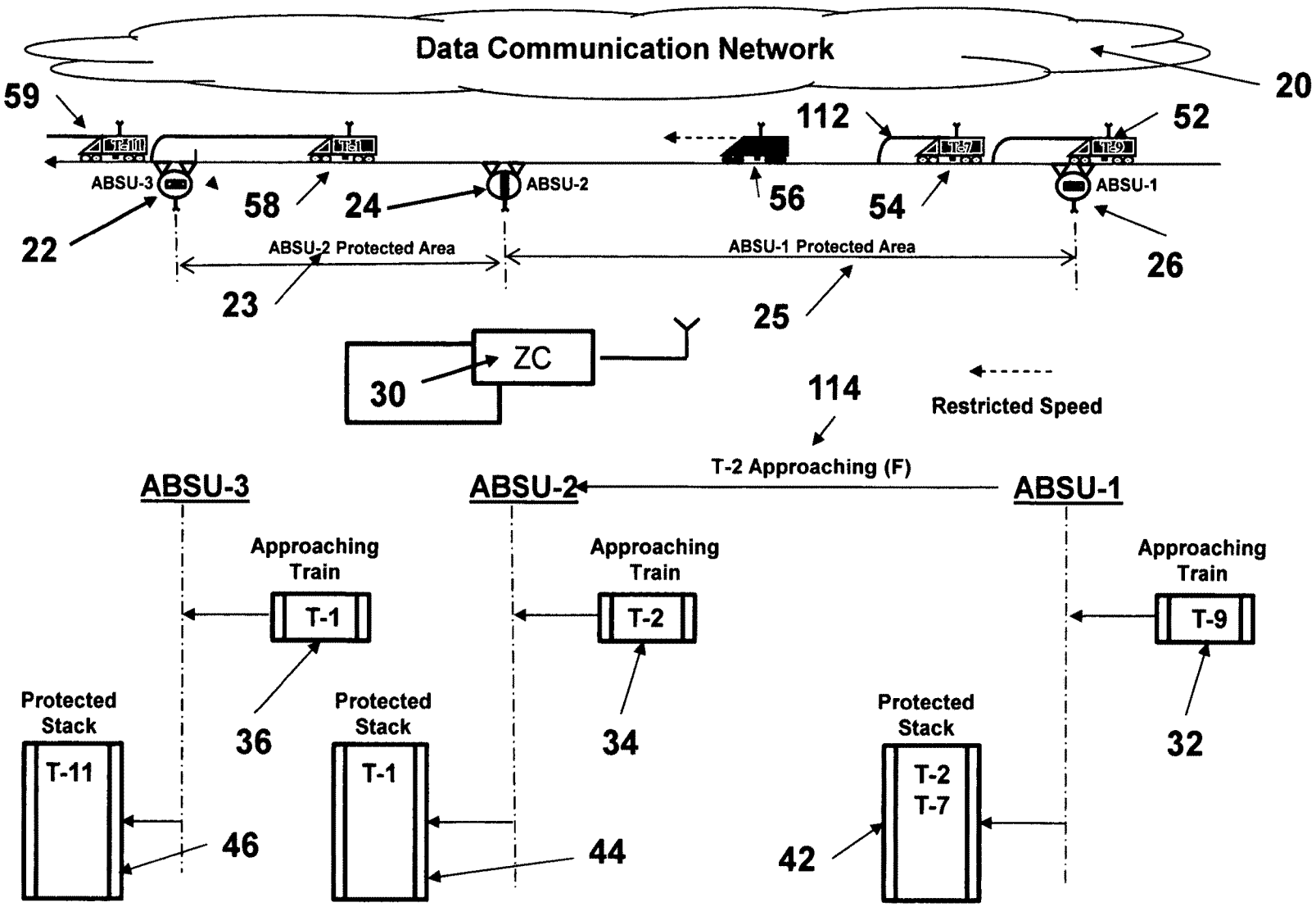

FIG. 22 reflects the movement of train T-1 58 past ABSU-2 24, and the movement of train T-11 59 past ABSU-3 22. Then in FIG. 23 and upon receiving a message that train T-1 58 has crossed ABSU-2 24, ABSU-1 26 sends a message 114 to ABSU-2 24 indicating that failed train T-2 56 is approaching its location. Then upon receiving this message 114, ABSU-2 24 displays a stop aspect and controls its automatic train stop to the tripping position.

Figure 24:
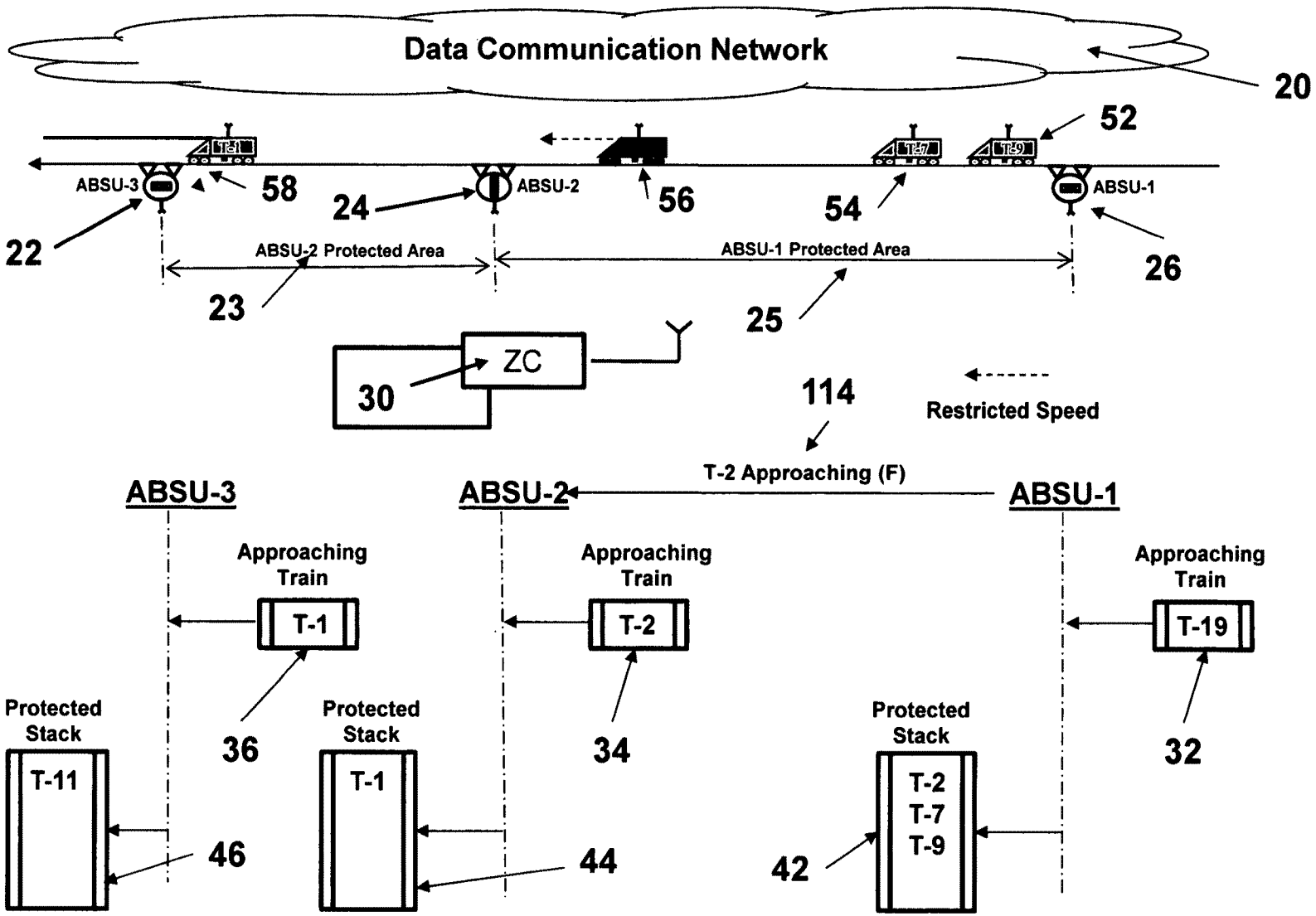
Figure 25:
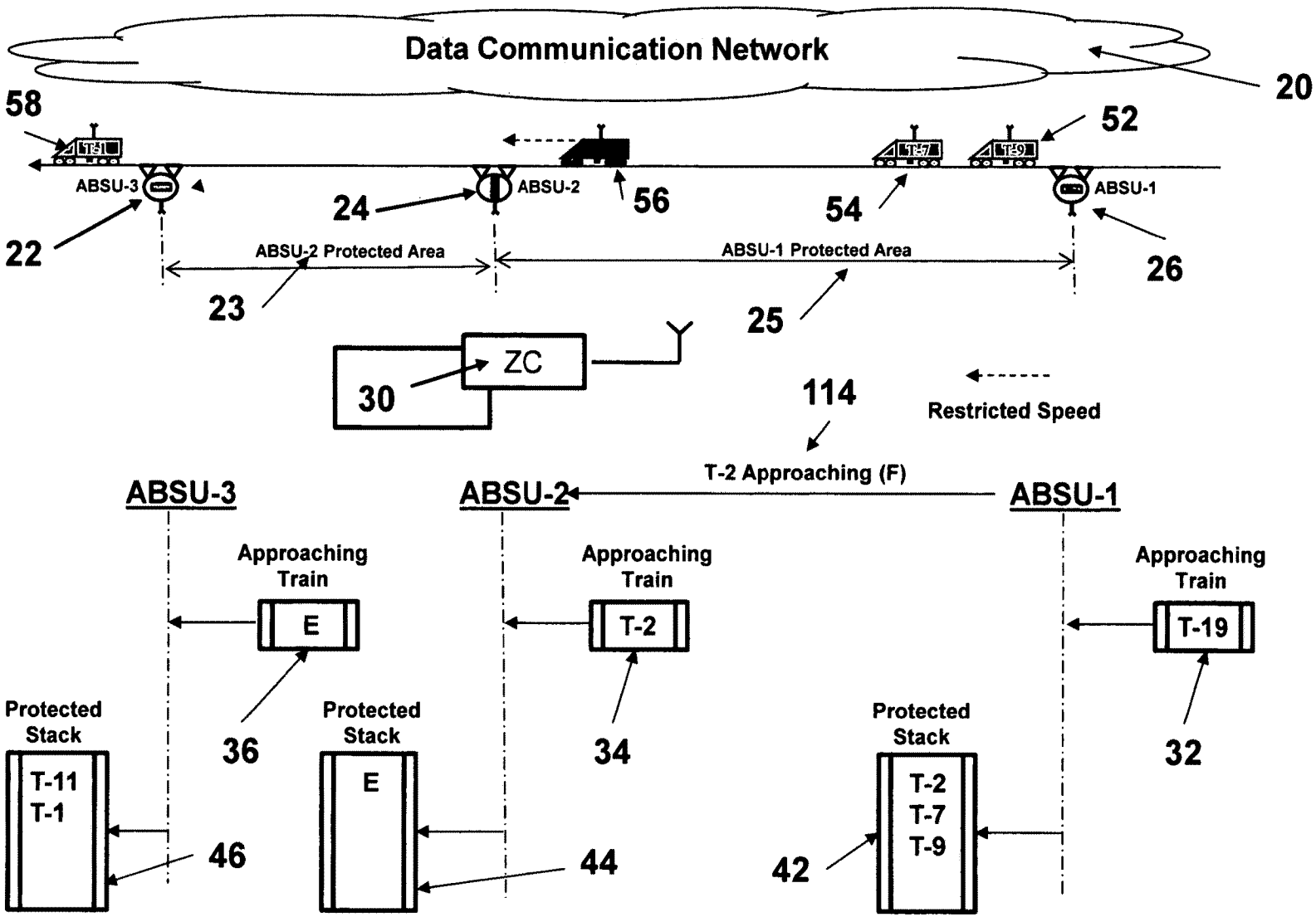
Figure 26:
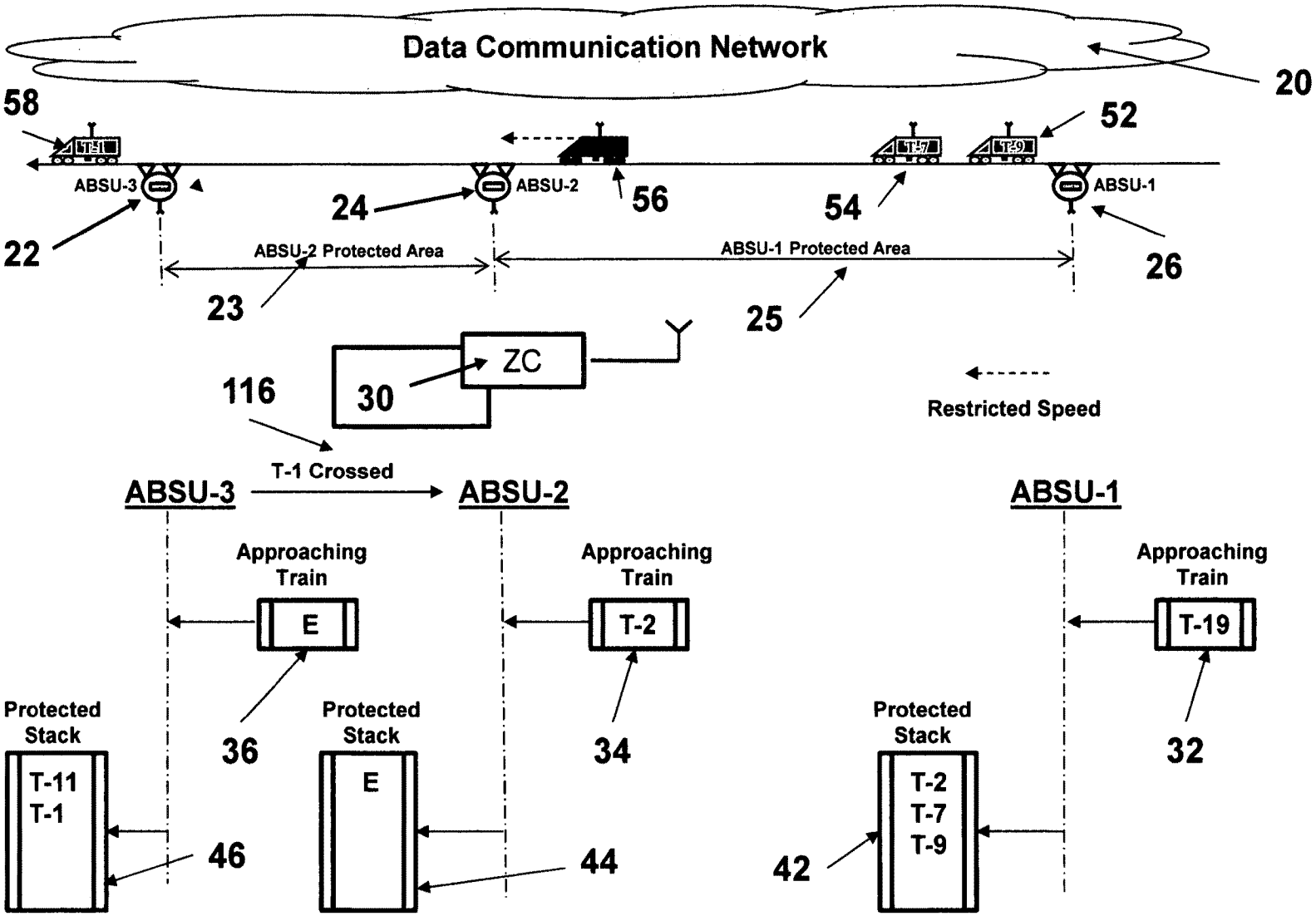

FIG. 24 indicates that trains T-7 54 and T-9 52 have reached the limits of their movement authorities, and are not able to move forward until receiving new movement authorities. FIG. 25 reflects the movement of train T-1 58 past ABSU-3 22. FIG. 26 indicates that upon receiving a communication from ABSU-3 22 that train T-1 58 has crossed its location 116, ABSU-2 24 displays a permissive aspect to train T-2 56. This enables failed train T-2 56 to proceed with restricted speed through absolute permissive block 23. It should be noted that it is a design choice to enable failed train T-2 56 to proceed with a higher restricted speed through absolute permissive block 23. In such case, the maximum operating speed within absolute permissive block 23 would be limited to smallest civil speed limit within this absolute block. The higher restricted speed is transmitted to failed train T-2 56 via the active transponder associated with ABSU-2 24. Alternatively, failed train T-2 56 can continue to move with the default CBTC restricted speed.

Figure 27:
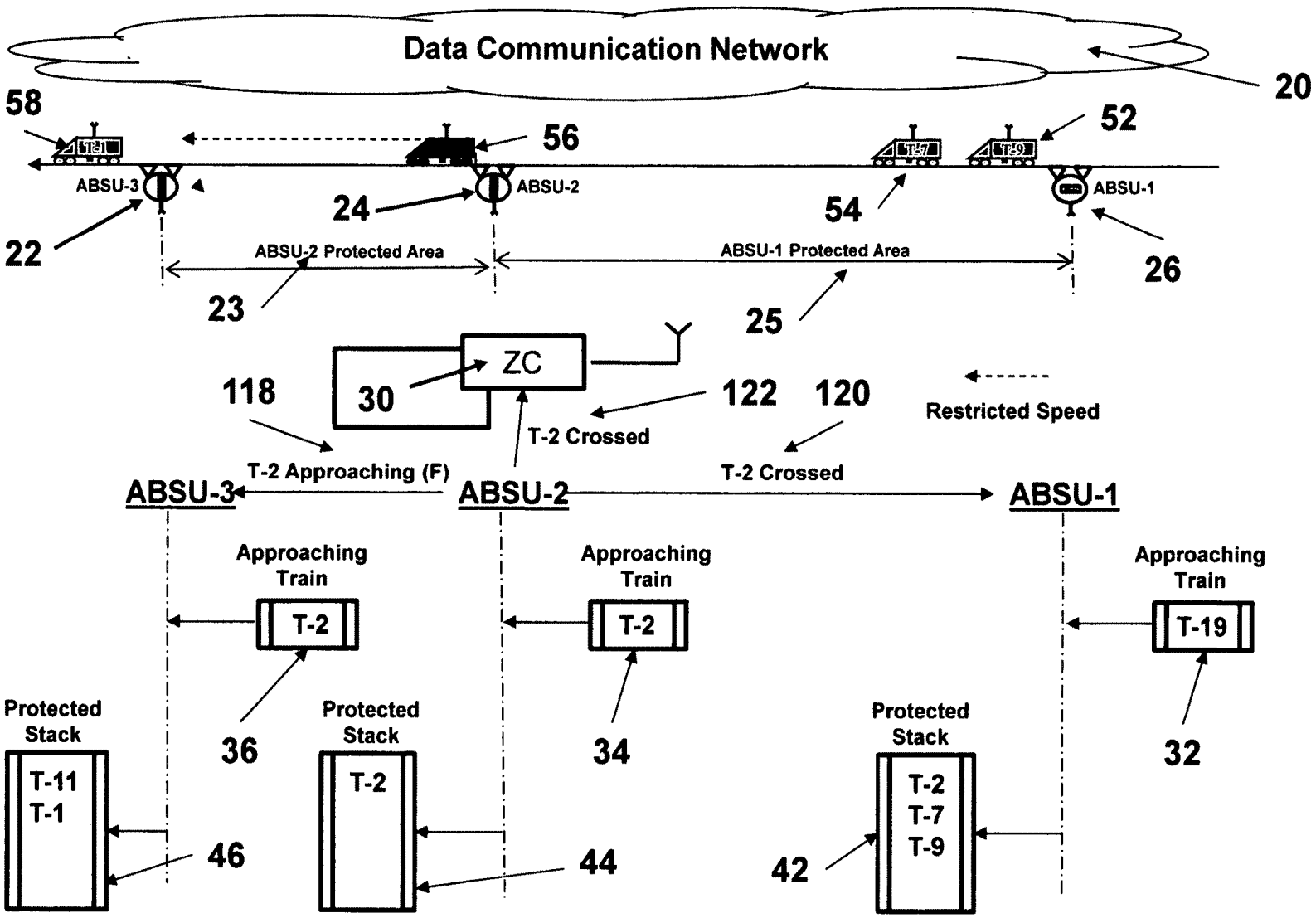
Figure 28:
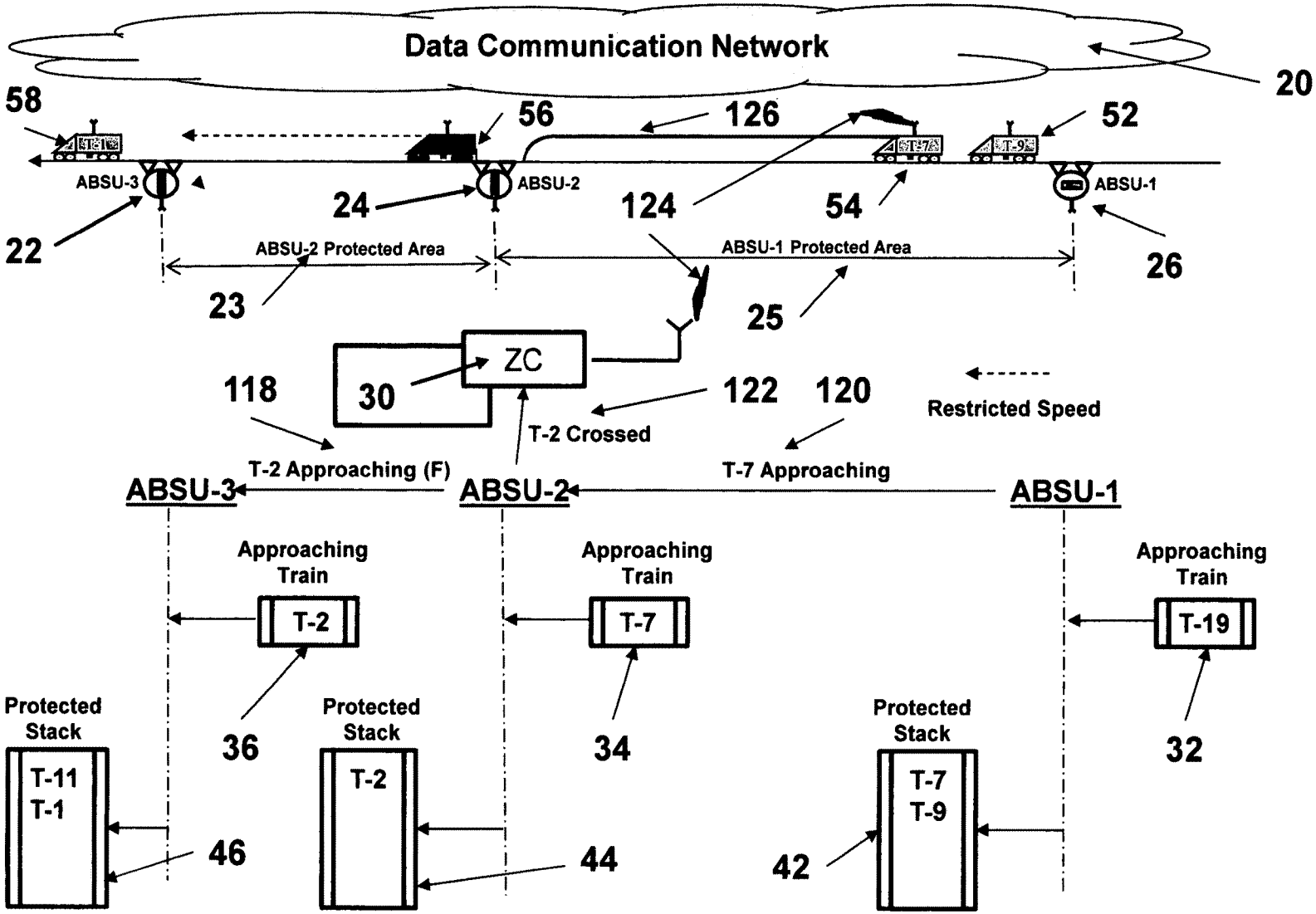

FIG. 27 reflects the movement of failed train T-2 56 past ABSU-2 24, and the communications from ABSU-2 24 to ABSU-3 22 (that failed train T-2 is approaching its location 118), to ABSU-1 26 (that train T-2 has crossed its location 120), and to the zone controller 30 (that train T-2 has crossed its location 122). Upon receiving the communication that failed train T-2 56 is approaching its location, ABSU-3 22 displays a stop aspect, and controls its automatic train stop to the tripping position. Then in FIG. 28, and upon receiving the communication that failed train T-2 56 has crossed the location of ABSU-2 24, the zone controller 30 communicates 124 a movement authority limit 126 to train T-7 54 authorizing it to move to the ABSU-2 24 location.

Figure 29:
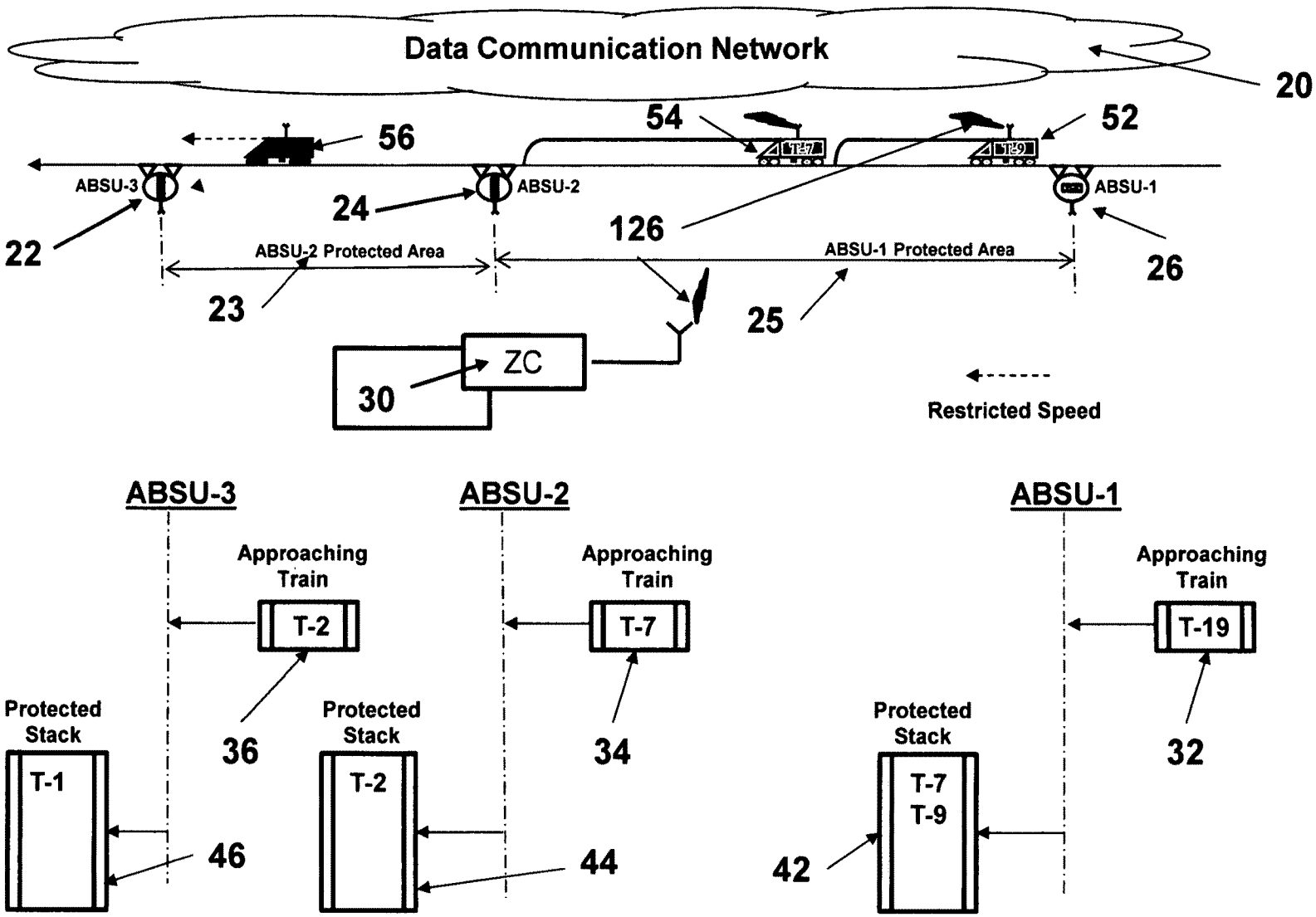
Figure 30:
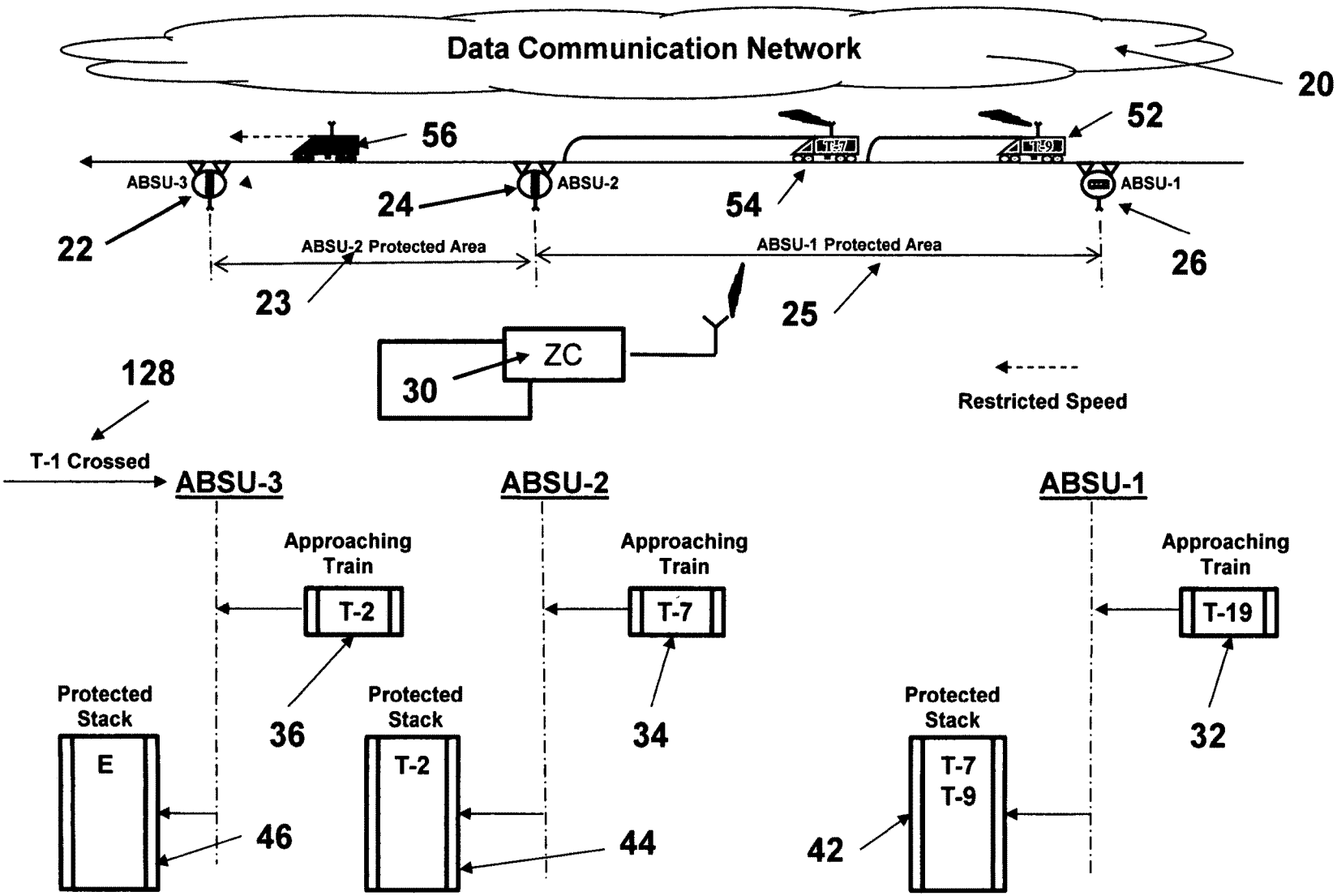
Figure 31:
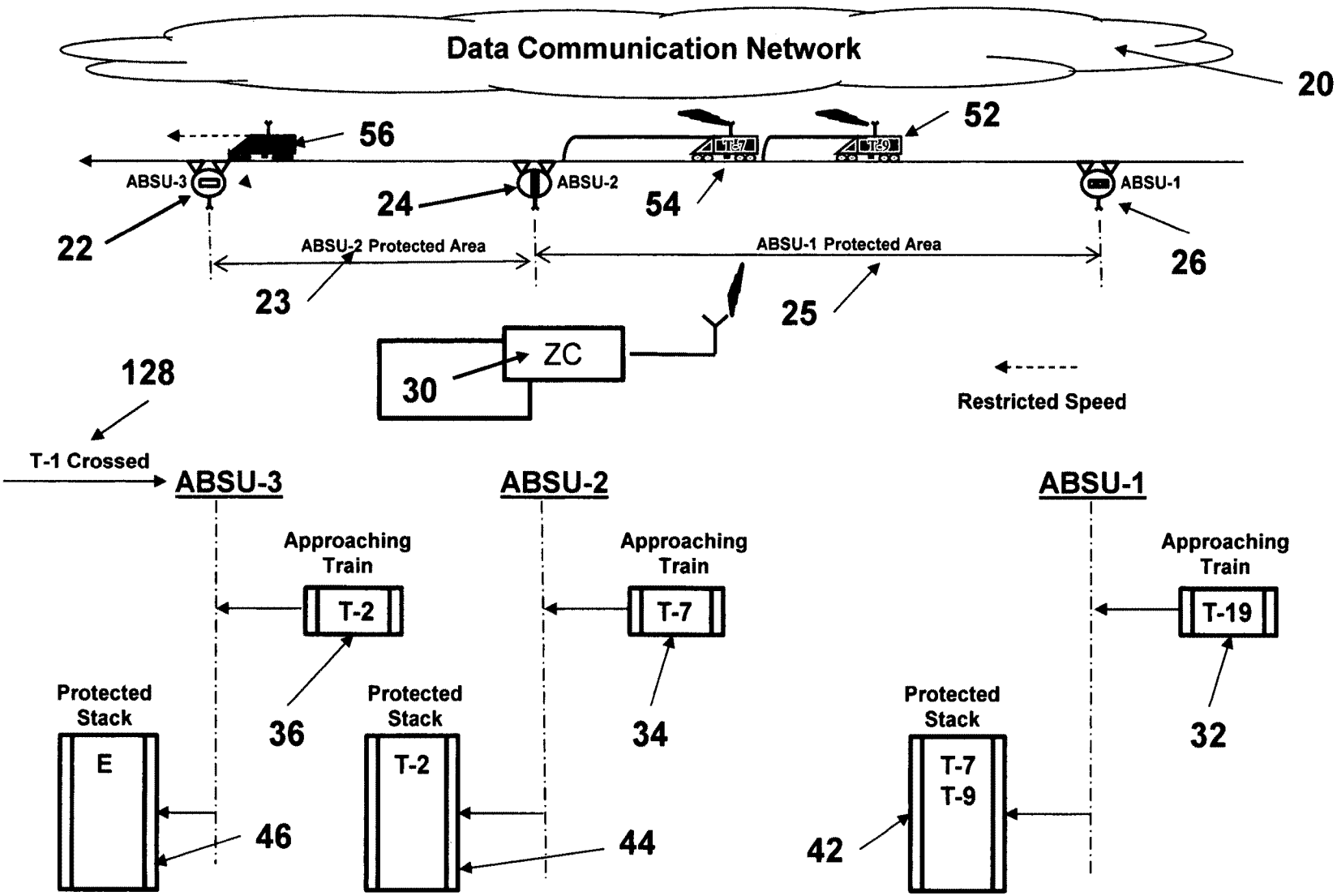

FIG. 29 reflects the movement of train T-7 54, and the communication 126 of a MAL from the zone controller 30 to train T-9 52. FIG. 30 shows the communication 128 to ABSU-3 22 that train T-1 has crossed the ABSU Ahead. Then FIG. 31 shows ABSU-3 22 displaying a permissive signal to enable failed train T-2 56 to proceed with a restricted speed.

Figure 32:
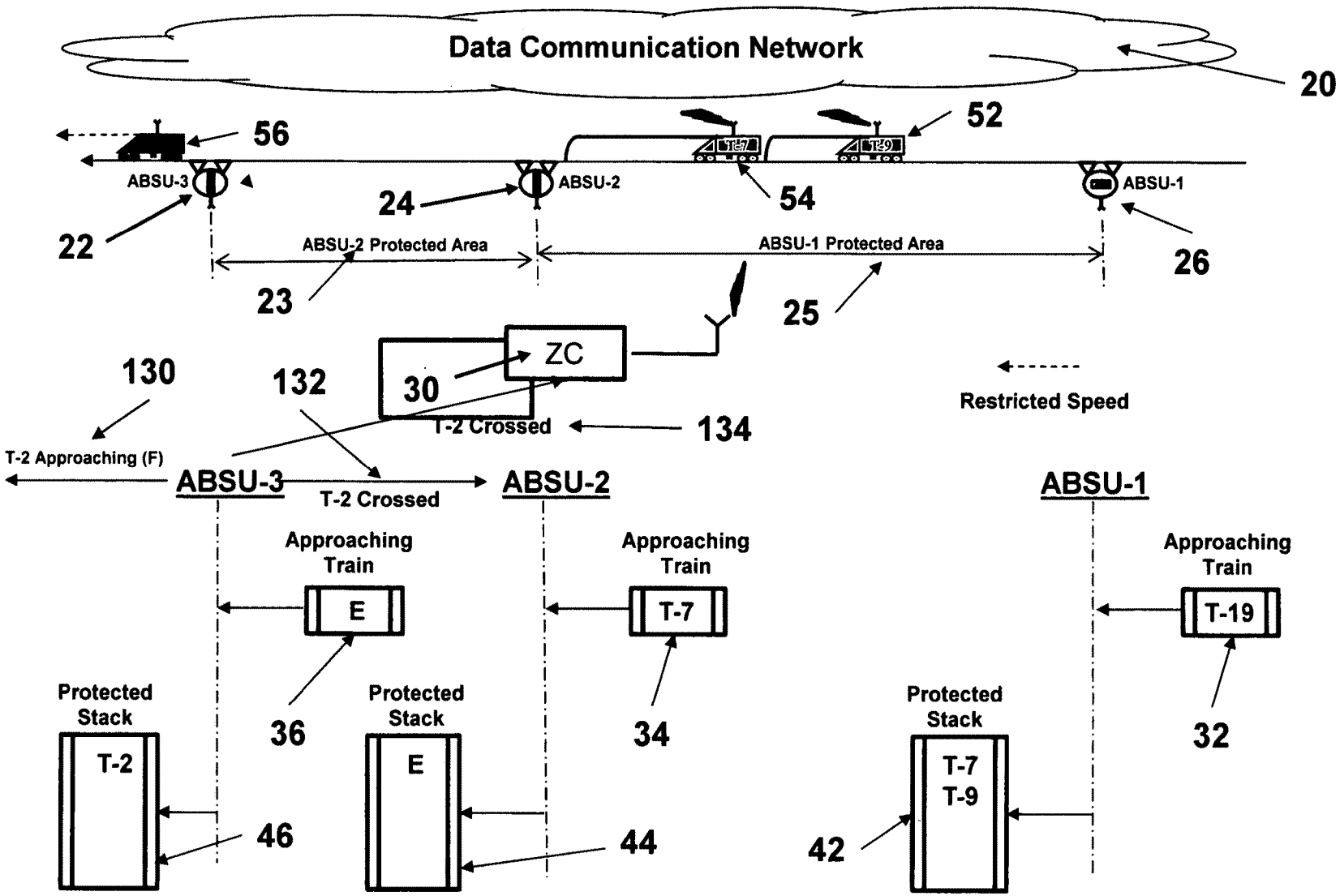
Figure 33:
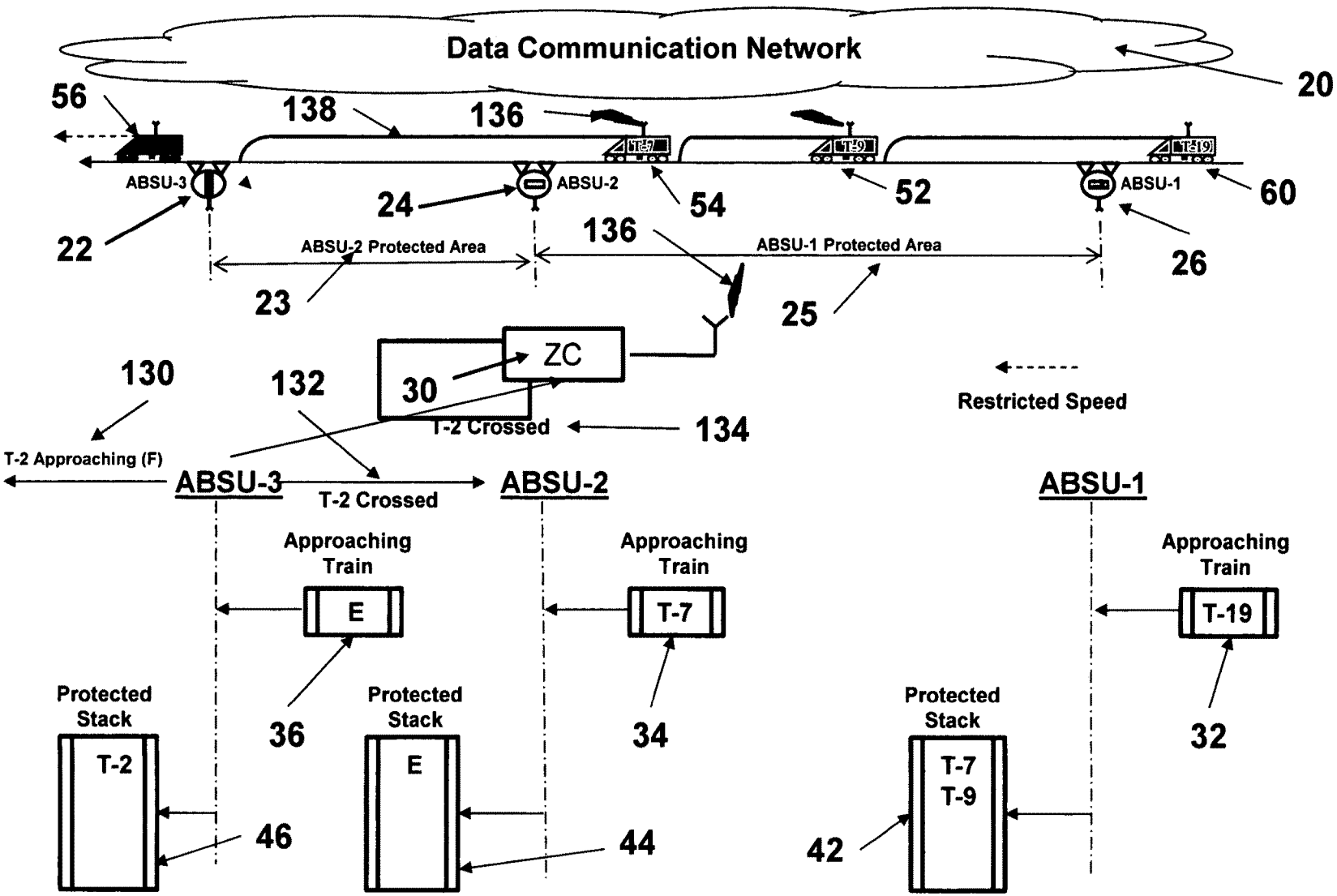

FIG. 32 reflects the movement of failed train T-2 56 past ABSU-3 22, and the communications from ABSU-3 22 to the ABSU Ahead (that failed train T-2 is approaching its location 130), to ABSU-2 24 (that train T-2 has crossed its location 132), and to the zone controller 30 (that train T-2 has crossed its location 134). Then in FIG. 33, and upon receiving the communication that failed train T-2 56 has crossed the location of ABSU-3 22, the zone controller 30 communicates 136 a movement authority limit 126 to train T-7 54 extending its MAL 138 to the ABSU-3 22 location. The operation of the AWS in conjunction with the zone controller 30 will continue until failed train T-2 56 is taken out of service or is repaired. It should be noted that it is a design choice as to how a movement authority is communicated from an ABSU to an approaching train. One design choice is to relay the movement authority via the zone controller. A second design choice is to send it directly from the ABSU to the train, and inform the zone controller.

Figure 34:
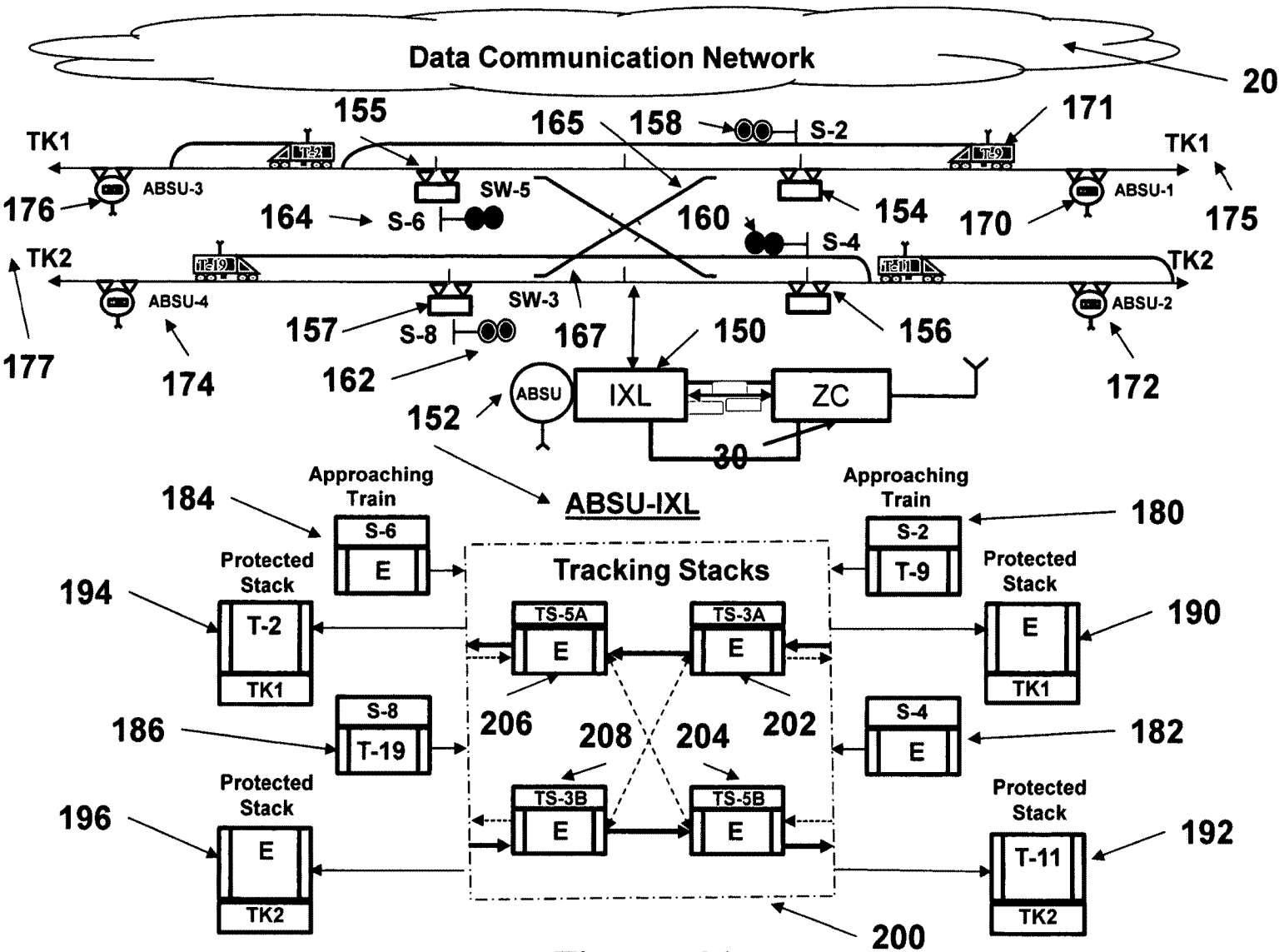
FIG. 34 shows the general approach to implement the ABSU concept at an interlocking location in accordance with the preferred embodiment of the invention.

FIG. 34 shows the general approach to implement the ABSU concept at an interlocking 150 in accordance with the preferred embodiment. As indicated in the Summary Section of the invention, the ABSU functions are implemented as part of the interlocking control logic. Further, since the interlocking spans a plurality of approaches on a number of tracks, it needs to interface with each adjacent ABSU. As such, the ABSU at the interlocking (ABSU-IXL) 152 interfaces with the ABSUs in the approach to the interlocking 170 & 174 as well as the ABSUs ahead of the interlocking 176 & 172, wherein the terms "in the approach to," and "ahead of" are based on traffic direction. Therefore, the specific interface functions between the ABSU-IXL 152 and an adjacent ABSU on a specific track depends on the traffic direction on that track. FIG. 34 shows an interlocking configuration 150 for a two track railroad, wherein track 1 (TK1) 175 designates one track, and track2 (TK2) 177 designates the second track. The interlocking includes two cross overs 165 & 167 with four track switches 3A, 3B, 5A and 5B. The "A" switches are associated with TK1 175, while the "B" switches are associated with TK2 177. The interlocking also includes four (4) home signals S2 158, S4 160, S6 164 & S8 162.

For the preferred embodiment, ABSU-IXL 152 is designed to support bi-directional traffic on both TK1 175 and TK2 177. As such, each signal location (S2, S4, S6 and S8) includes an axle counter, a transponder reader and an active transponder 154, 155, 156 & 157. Further, the interlocking control module includes four data fields to store the signatures of trains approaching signal locations S-2 180, S4 182, S-6 184 and S-8 186. In addition, the interlocking control module includes four (4) protected stacks 190, 192, 194 and 196 (one protected stack for each destination ABSU 170, 172, 174 and 176). Further, the interlocking control module includes internal tracking stacks 200 to track train movements within the interlocking limits. As such, for the preferred embodiment, the train tracking stacks include TS-3A 202, TS-5A 206, TS-3B 204 & TS-5B 208. The communications between ABSU-IXL 152 and adjacent ABSUs 170, 172, 174 & 176 is provided by the Data Communication Network 20 that provides communications between the zone controller 30 and CBTC equipped trains 171.

Figure 35:
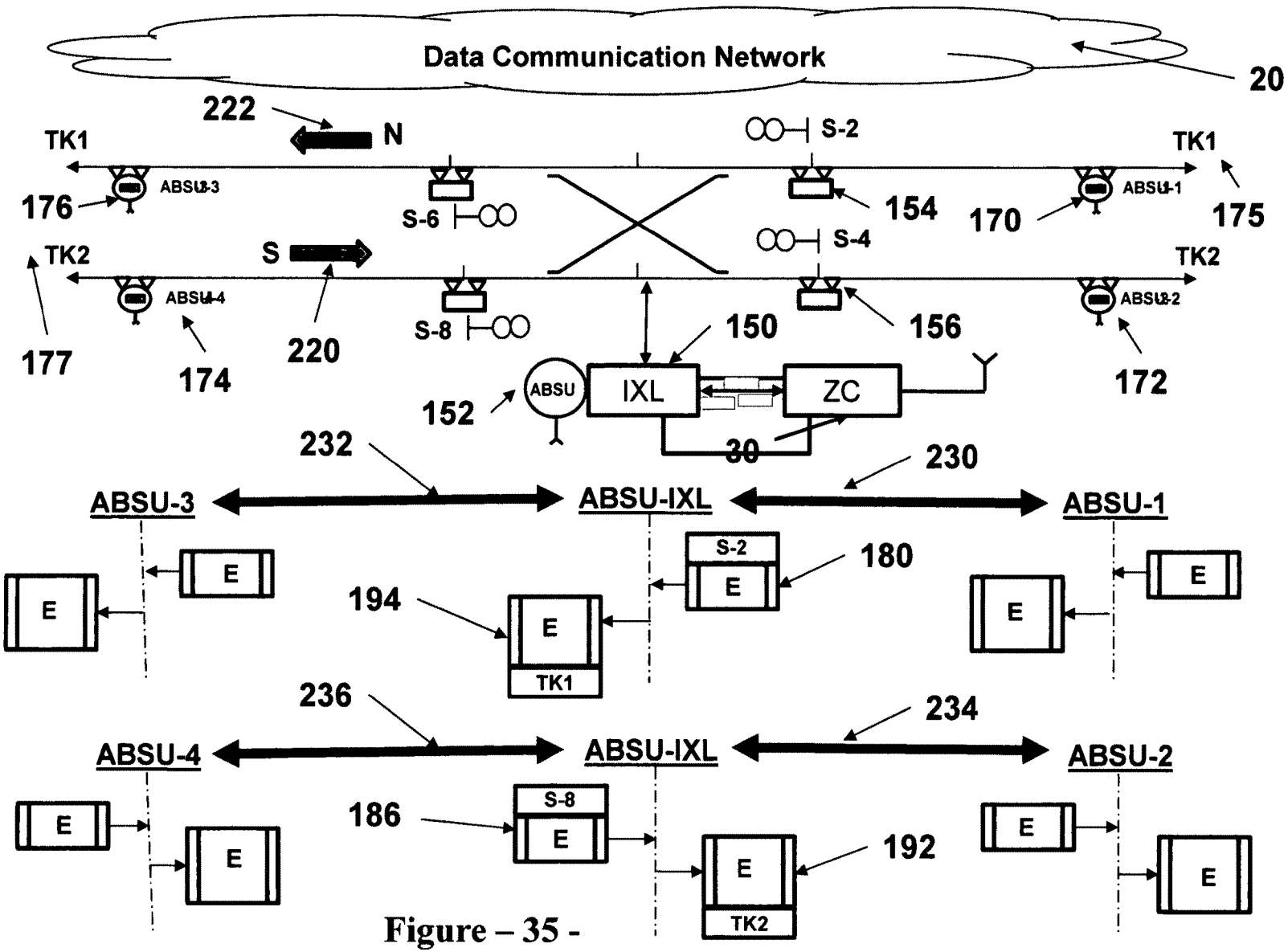
FIGS. 35 & 36 show the functioning logical modules of an ABSU interlocking configuration for various traffic patterns in accordance with the preferred embodiment of the invention.
Figure 36:
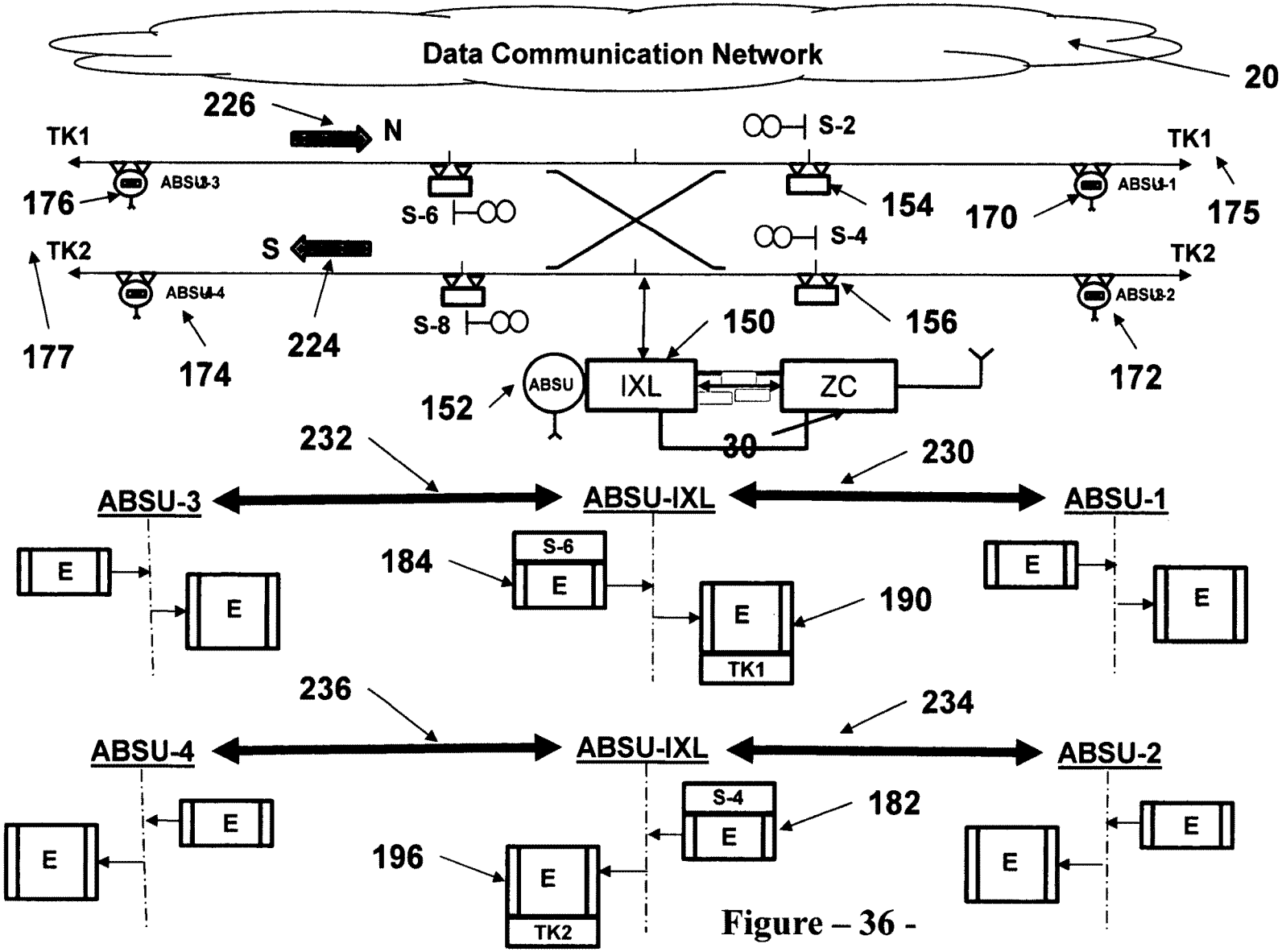
Figure 37:
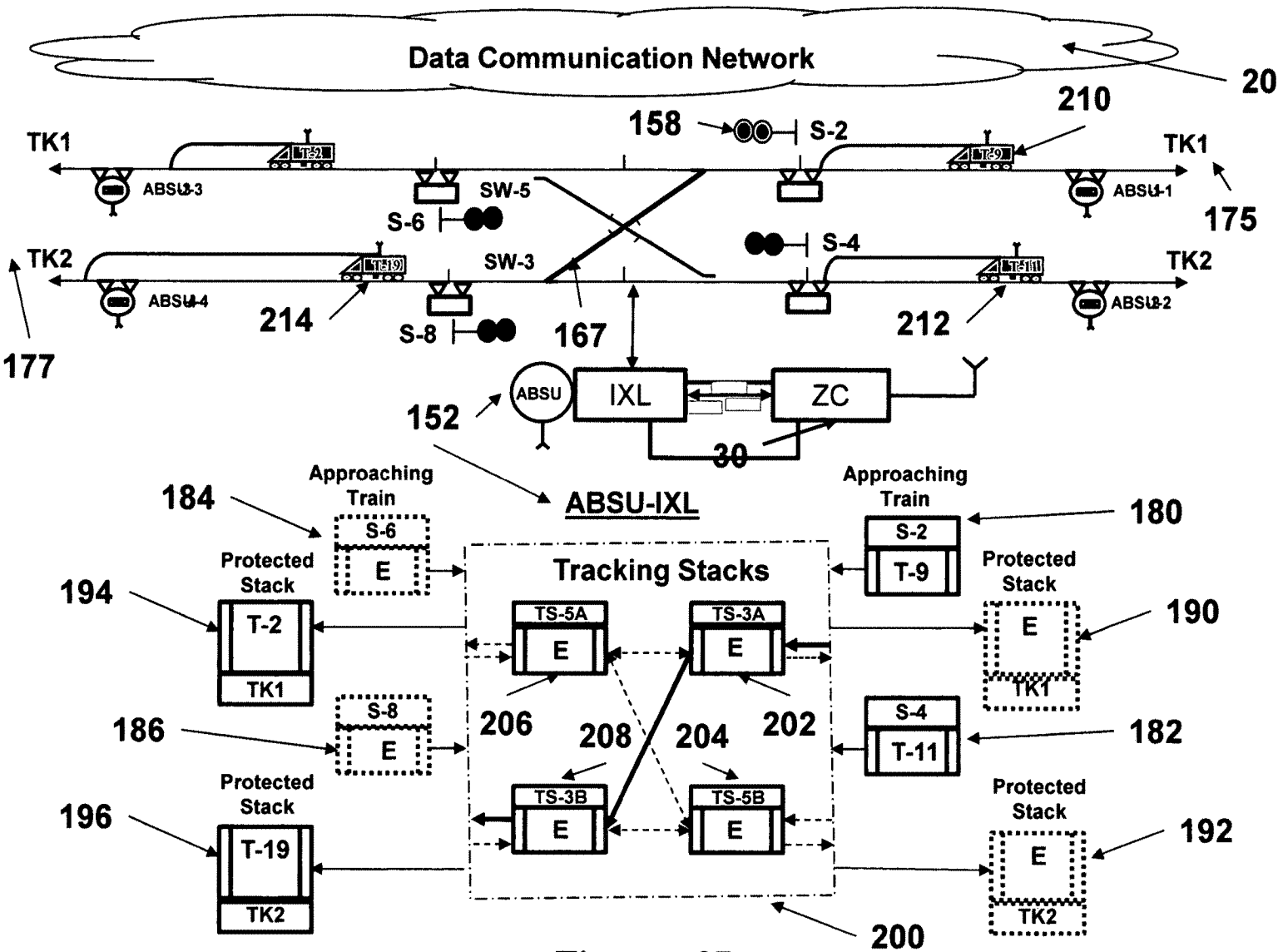
FIGS. 37-43 demonstrate a step by step standby mode operation of an ABSU interlocking configuration for a series of train moves along internal interlocking routes in accordance with the preferred embodiment of the invention.

FIGS. 35 & 36 show the ABSU-IXL logical modules that are functioning for various traffic patterns. In FIG. 35, the traffic on TK1 222 is set to a Northern direction, and the traffic on TK2 220 is set to a Southern direction. For this traffic pattern, and assuming that all switches at the interlocking are in the normal position, the ABSU-DCL track 1 functioning configuration includes the Approach Train Data Field S-2 180, and the Protected Stack for track TK1 194. Similarly, the ABSU-IXL track 2 functioning configuration includes the Approach Train Data Field S-8 186, and the Protected Stack for track TK2 192. As such, for track TK1 175, the ABSU-IXL 152 communicates 230 with its Approach ABSU (ABSU-1 170), and also communicates 232 with the ABSU Ahead (ABSU-3 176). Further, with respect to track TK2 177, the ABSU-DCL 152 communicates 236 with its Approach ABSU (ABSU-4 174), and also communicates 234 with the ABSU Ahead (ABSU-2 172).

Alternatively, in FIG. 36, the traffic on TK1 226 is set to a Southern direction, and the traffic on TK2 224 is set to a Northern direction. For this traffic pattern, and assuming that all switches at the interlocking are in the normal position, the ABSU-DCL track 1 functioning configuration includes the Approach Train Data Field S-6 184, and the Protected Stack for track TK1 190. Similarly, the ABSU-IXL track 2 functioning configuration includes the Approach Train Data Field S-4 182, and the Protected Stack for track TK2 196. As such, for track TK1 175, the ABSU-IXL 152 communicates 232 with its Approach ABSU (ABSU-3 176), and also communicates 230 with the ABSU Ahead (ABSU-1 170). Further, with respect to track TK2 177, the ABSU-IXL 152 communicates 234 with its Approach ABSU (ABSU-2 172), and also communicates 236 with the ABSU Ahead (ABSU-4 174).

Figure 38:
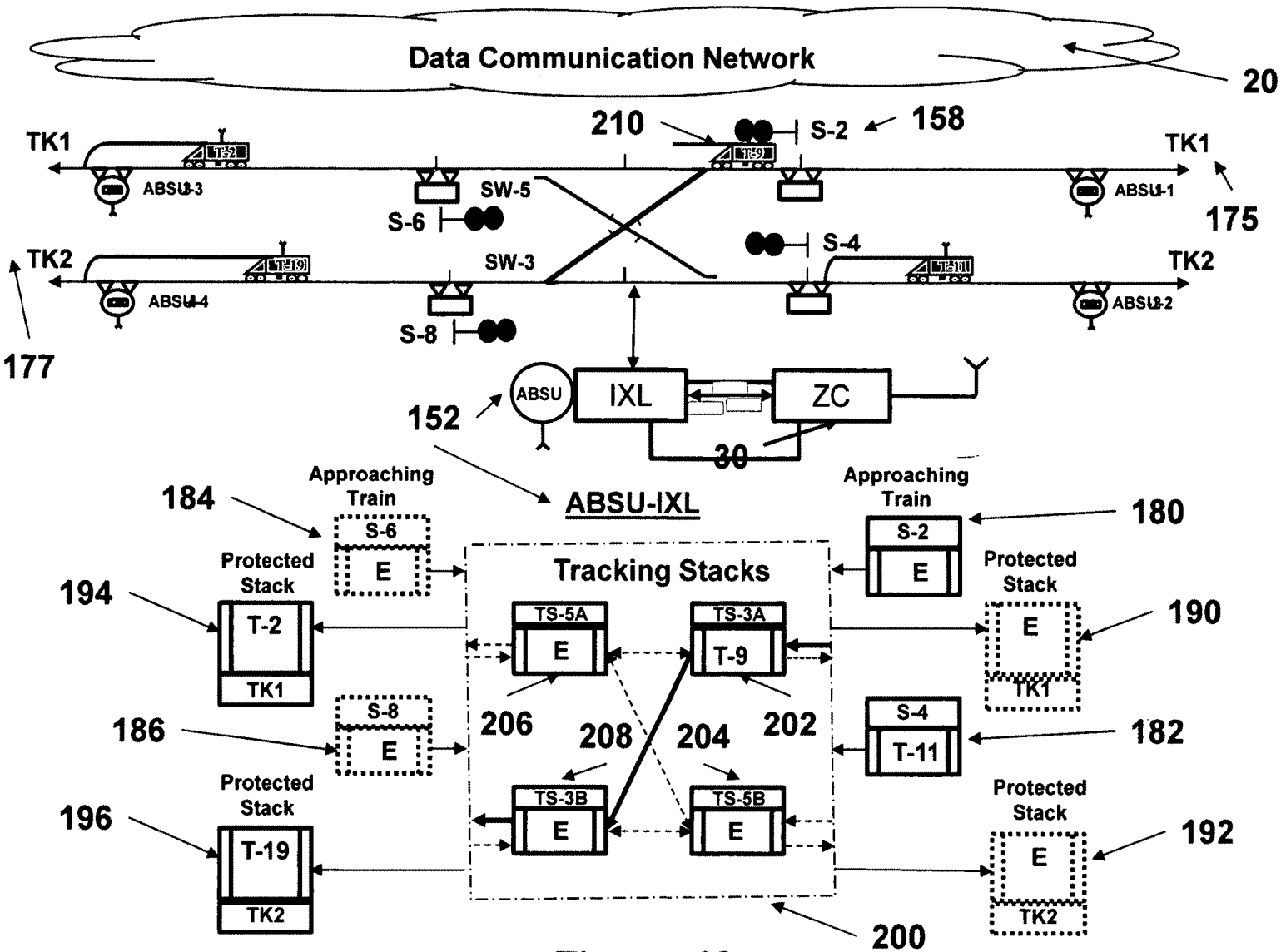
Figure 39:
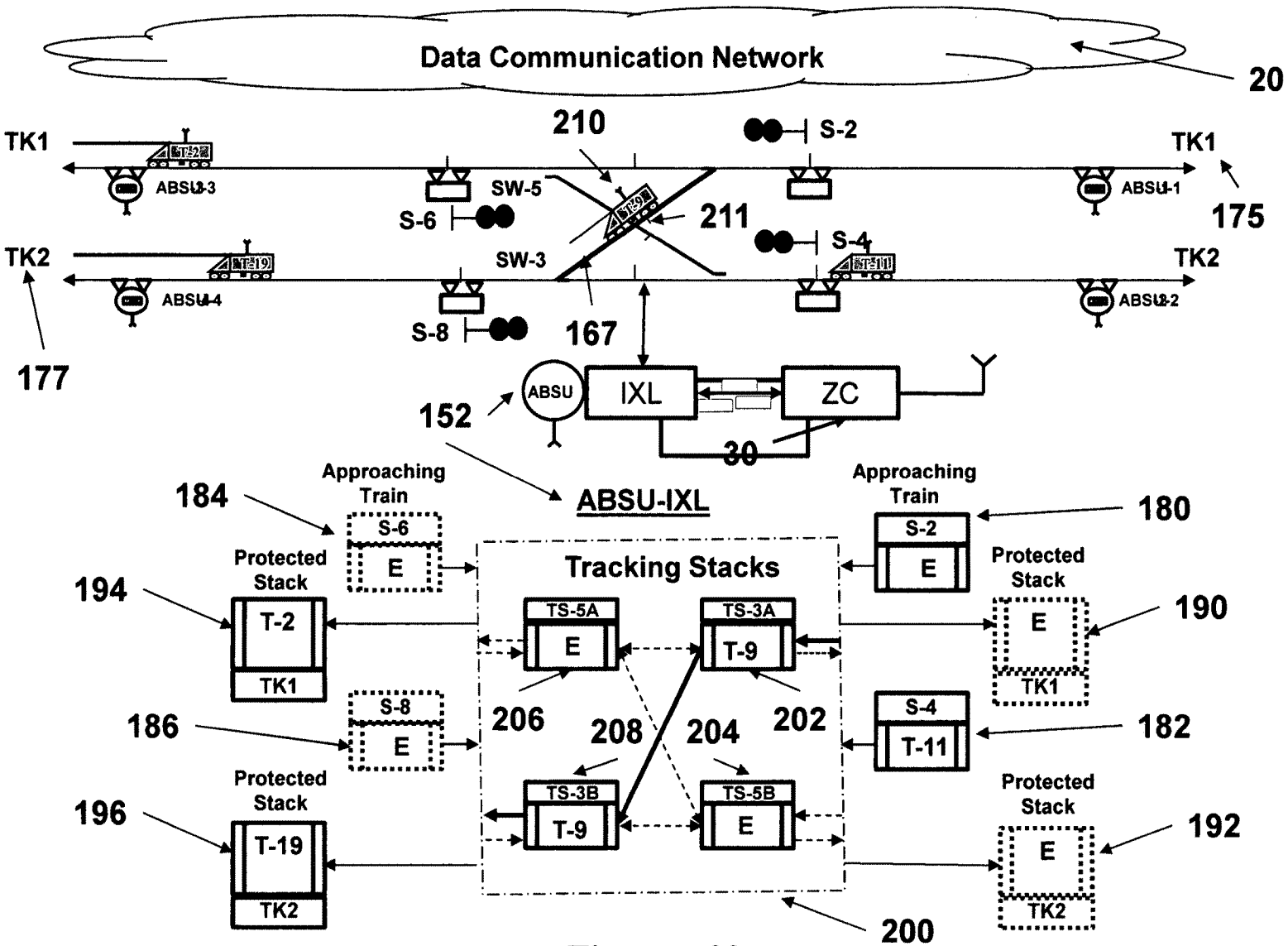

At a high level within the AWS system, the external operation and functions provided of the ABSU-IXL are similar to the operation and functions provided by any other ABSU. This means that the internal functions of the ABSU-IXL associated with routes within the interlocking, and tracking of trains and their signatures along those routes, are transparent to the AWS. FIGS. 37-43 demonstrate the standby mode operation of the ABSU-IXL 152 for a series of train moves. In this example the traffic direction for both TK1 175 and TK2 177 are set to a southern direction. FIG. 38 shows switch SW-3 167 in the reverse position, and signal S-2 158 cleared for train T-9 210 to proceed from track 1 to track 2. For this operating scenario, the Approaching Train Data Field S2 180 includes train T-9 210. Also, all the internal train tracking stacks 202, 204, 206 & 208 within the ABSU-IXL 152 are empty. Further, the protected stack on TK2 196 includes train T-19 214. In addition, the Approaching Train Data Field S-4 182 reflects train T-11 212.

FIG. 38 reflects the movement of train T-9 210 past home signal S-2 158. As a result, Approaching Train Data Field S-2 180 is set to "E" (empty), and internal train tracking stack TS-3A 202 registers the signature for train T-9 210. Then FIG. 39 reflects further movement of train T-9 210 over switch S-3 167 and past the track circuit boundary 211 within the detector circuit for switch S-3. This will cause internal train tracking stack TS-3B 208 to register the signature of train T-9 210.

Figure 40:
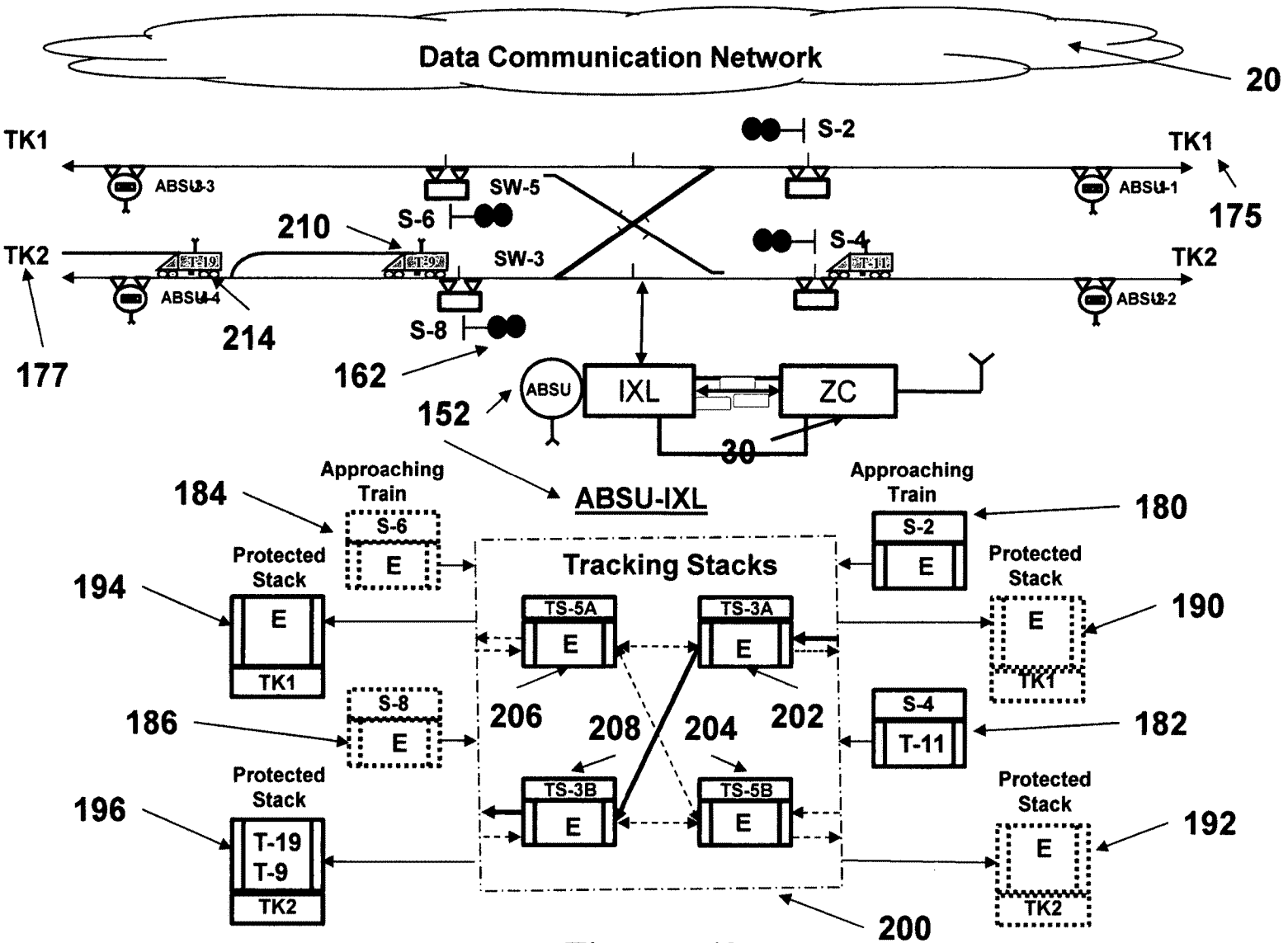
Figure 41:
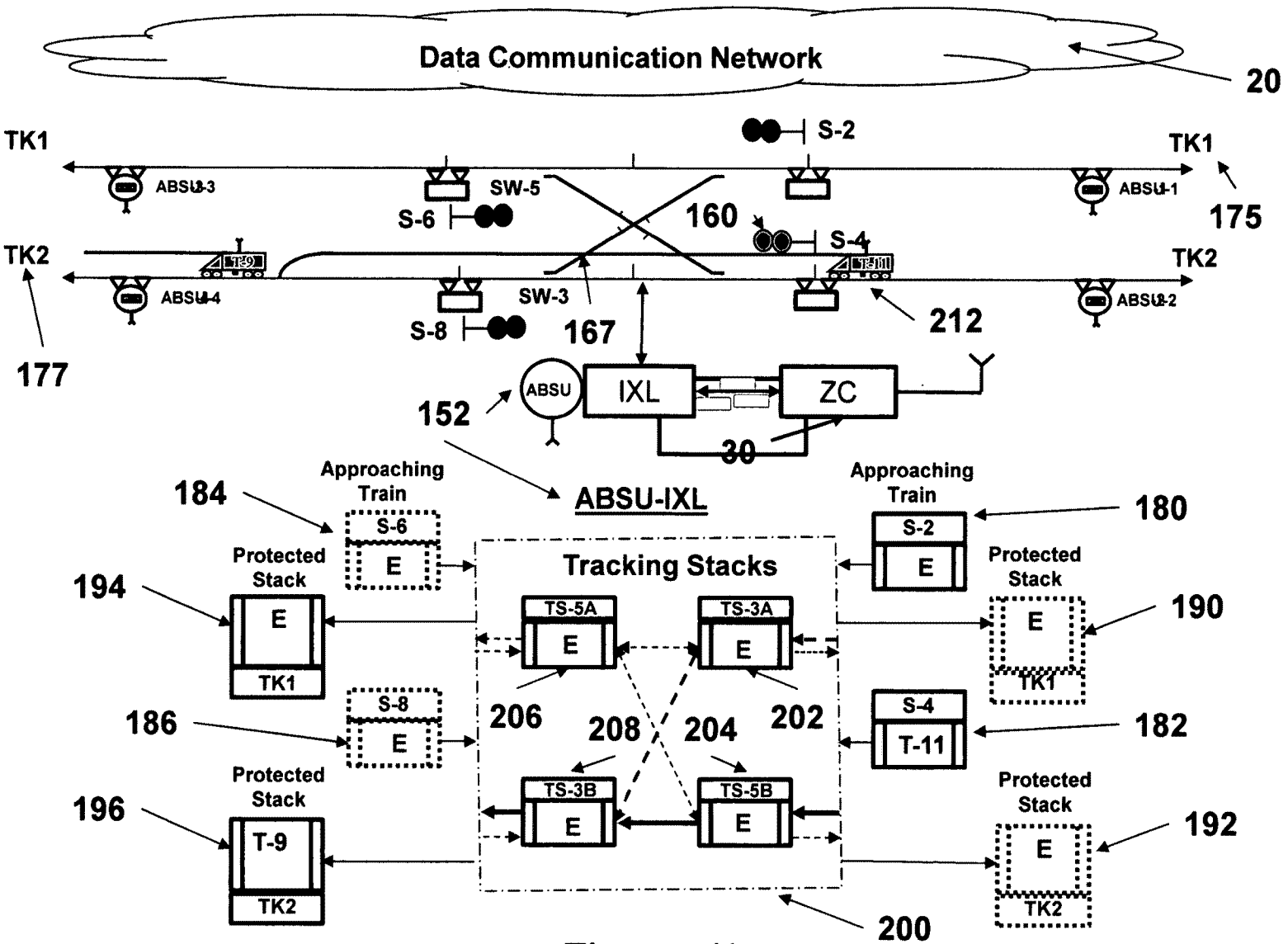

FIG. 40 reflects the movement of train T-9 210 past signal S-8 162. As a result, the internal train tracking stacks TS-3A 202 and TS-3B 208 are set to "E" (empty), and the protected stack for TK2 196 reflects two train signatures for T-19 214 and T-9 210. Then FIG. 41 reflects the establishment of a route within the interlocking for train T-11 212 to move past signal S-4 160 over switch S-3 167 normal.

Figure 42:
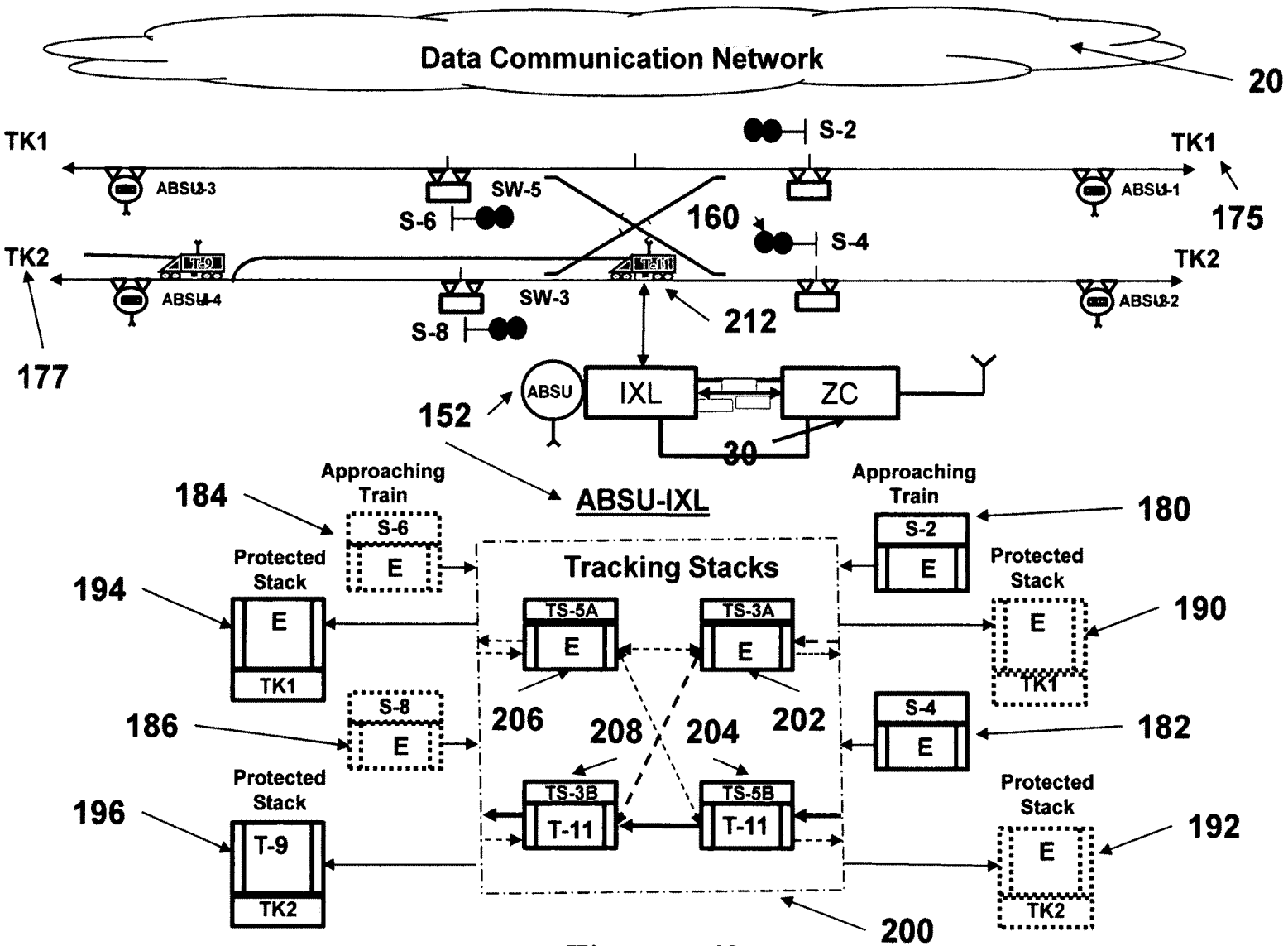
Figure 43:
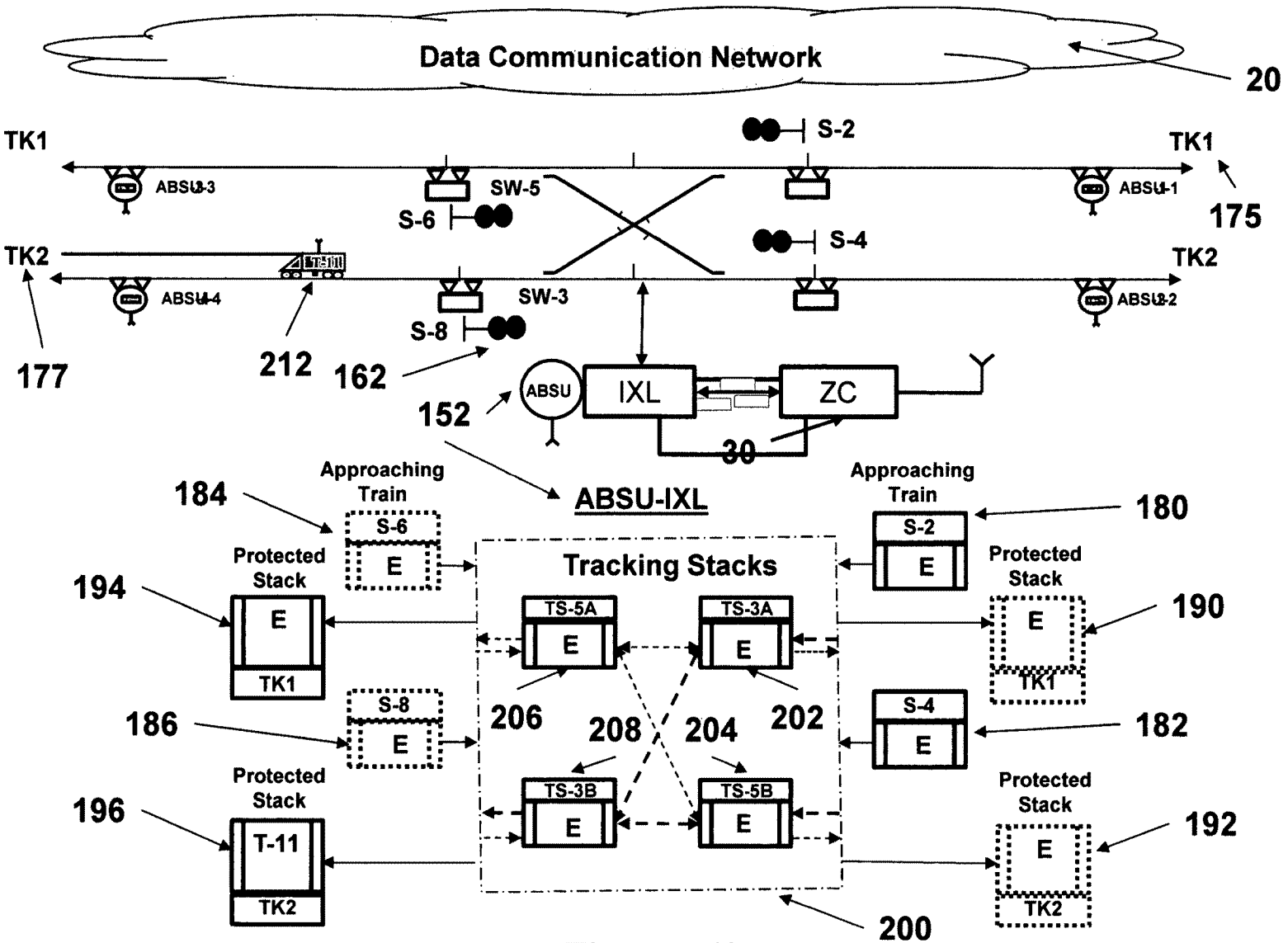

FIG. 42 reflects the movement of train T-11 212 past signal S-4 160. As a result, the internal train tracking stacks TS-5B 204 and TS-3B 208 register the signature of train T-11 212, and Approaching Train Data Field S-4 182 is set to "E" (empty). Then in FIG. 43, train T-11 212 leaves the interlocking passed signal S-8 162. This result in the clearing of the internal train tracking stacks TS-5B 204 and TS-3B 208. Further, the protected stack for TK2 196 reflects the signature of train T-11 212.

Figure 44:
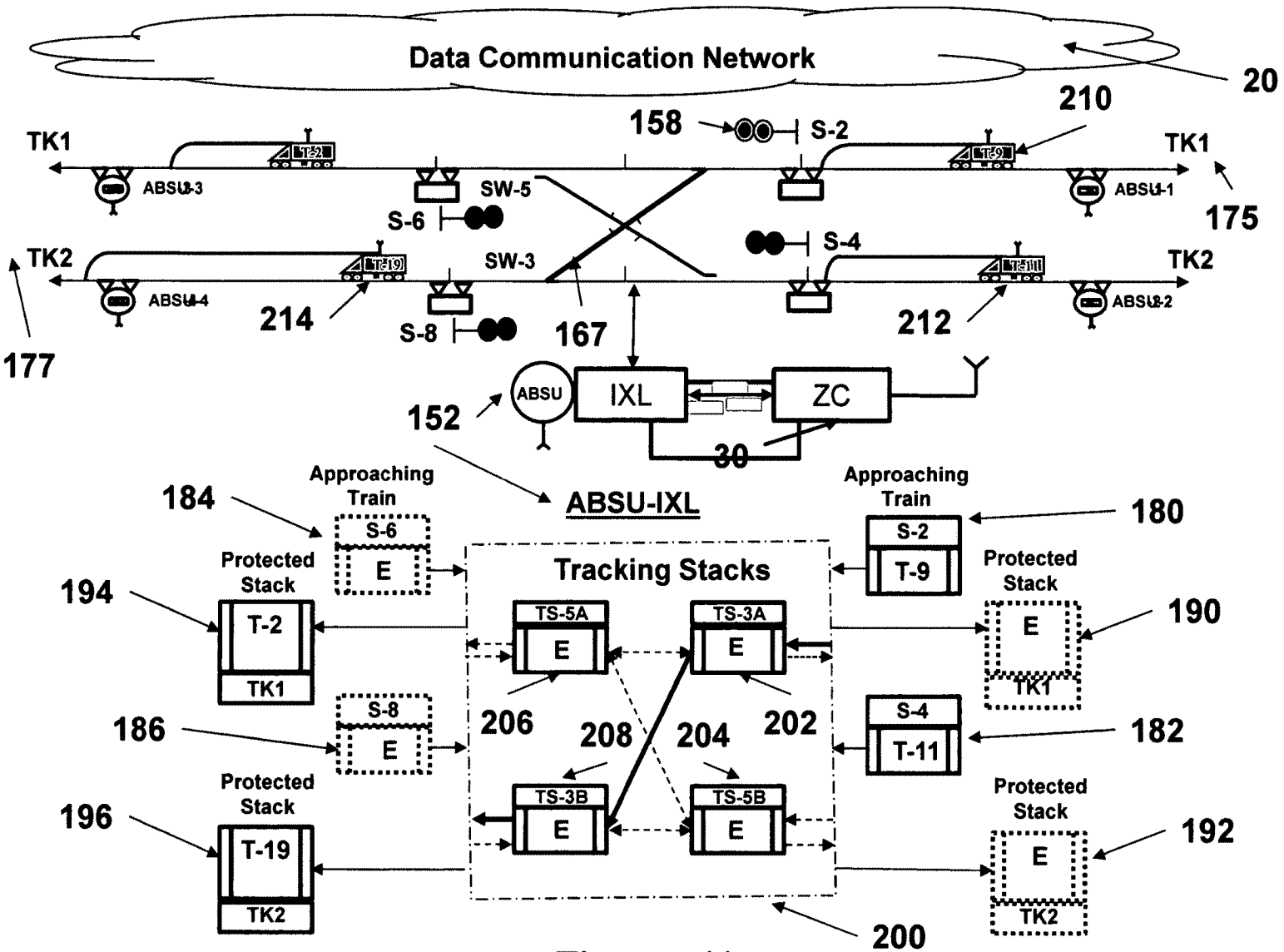
FIGS. 44-55 demonstrate a step by step active mode operation of an ABSU interlocking configuration during a zone controller failure, and for the same series of train moves demonstrated in FIGS. 37-43.
Figure 45:
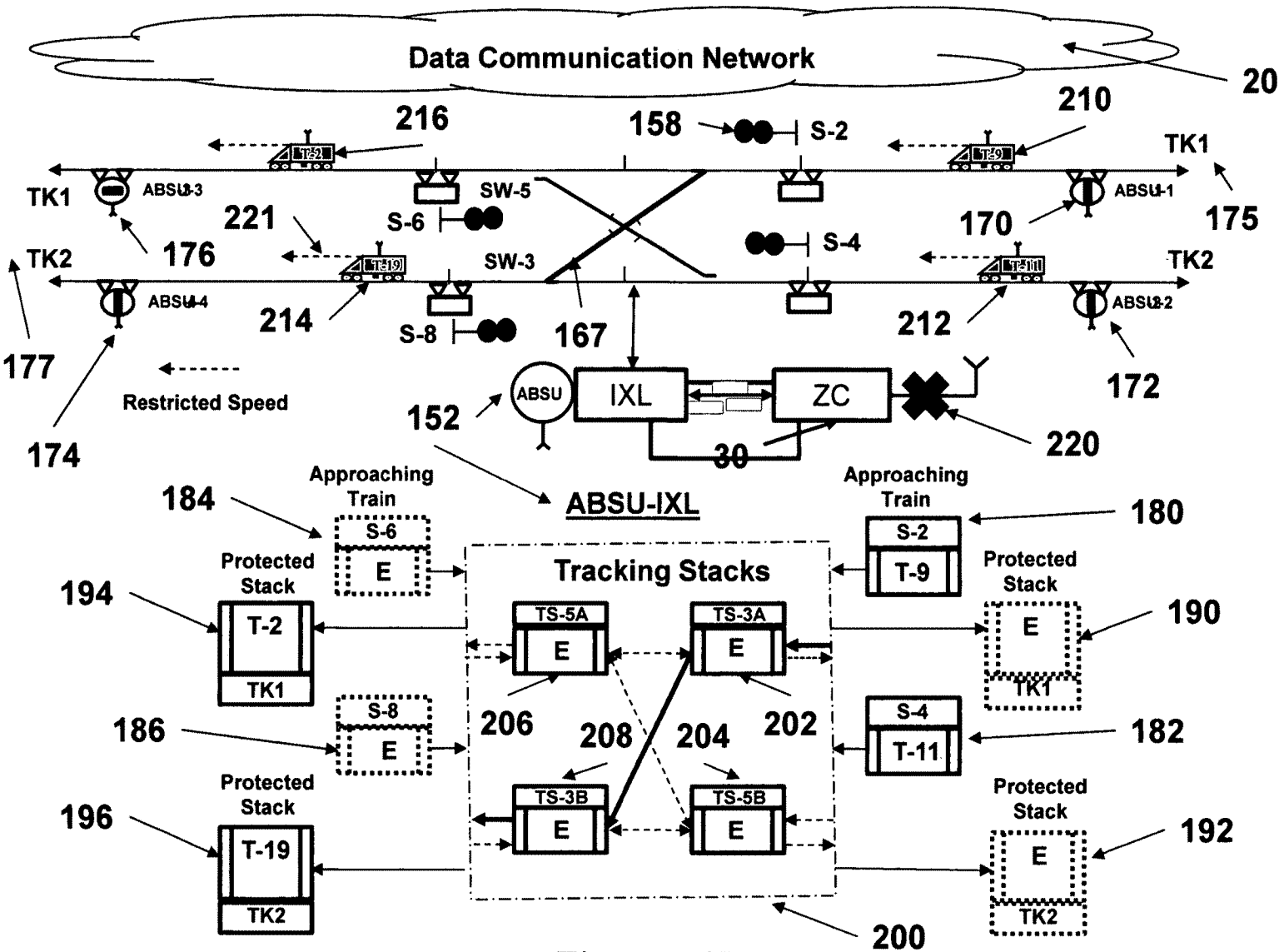

FIGS. 44-55 demonstrate the active operation of the ABSU-IXL 152, during a zone controller 30 failure, and for the same series of train moves indicated in FIGS. 37-43. FIG. 44 shows the operating conditions before the zone controller 30 failure. Then in FIG. 45, upon the failure 220 of the zone controller 30, trains T-2 216, T-9 210, T-19 214 and T-11 212 lose their movement authorities and operate under a speed restriction 221. Based on initial traffic conditions, ABSU-1 170, ABSU-2 172 and ABSU-4 174 display a stop aspect, while ABSU-3 176 displays a clear aspect. Also, the interlocking protected stack for TK1 194 includes train T-2 216, and the interlocking protected stack for TK2 196 includes train T-19 214. Further, the Approaching Train Data Field S-2 180 includes train T-9 210, and the Approaching Train Data Field S-4 182 includes train T-11 212.

Figure 46:
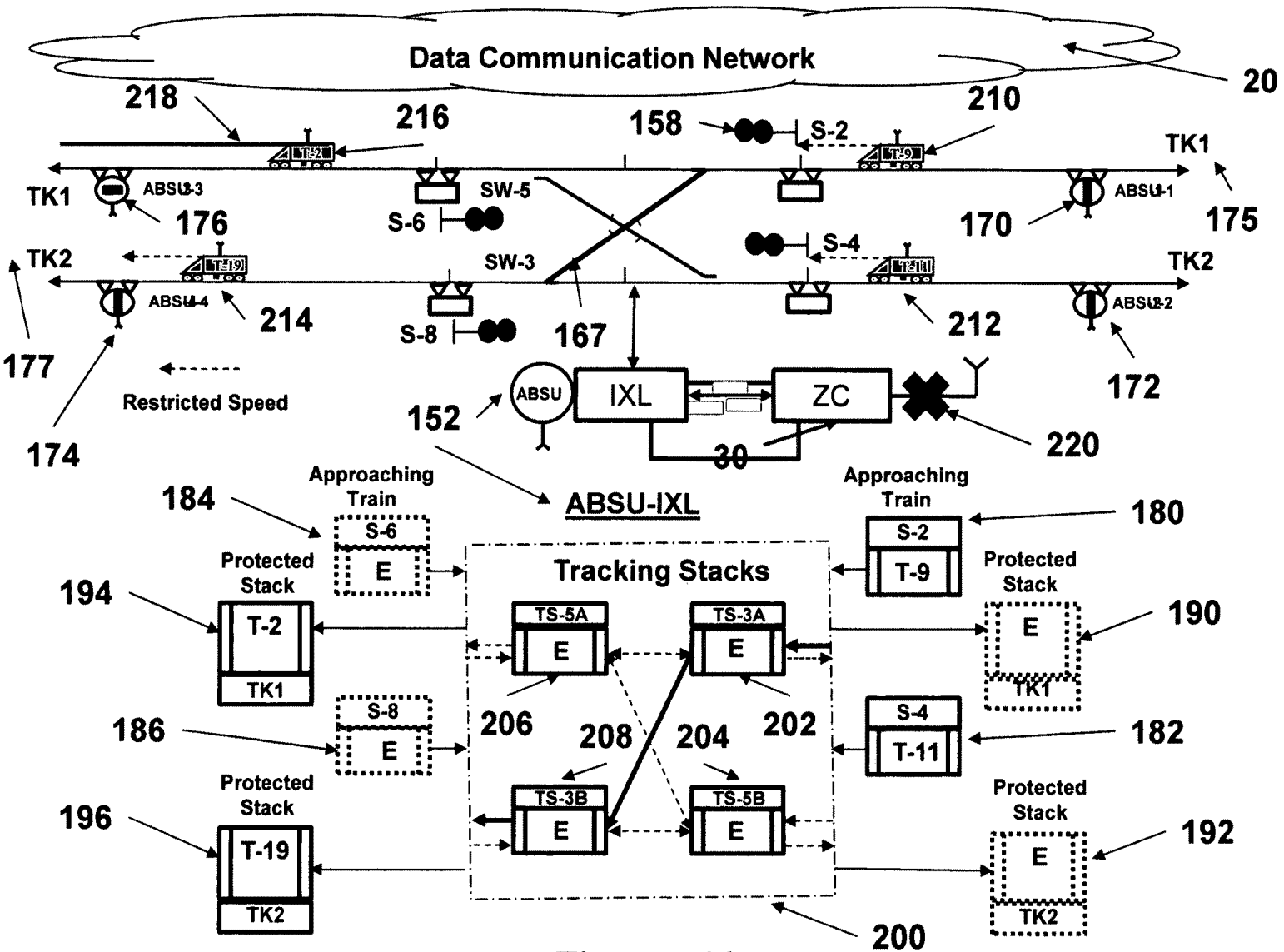
Figure 47:
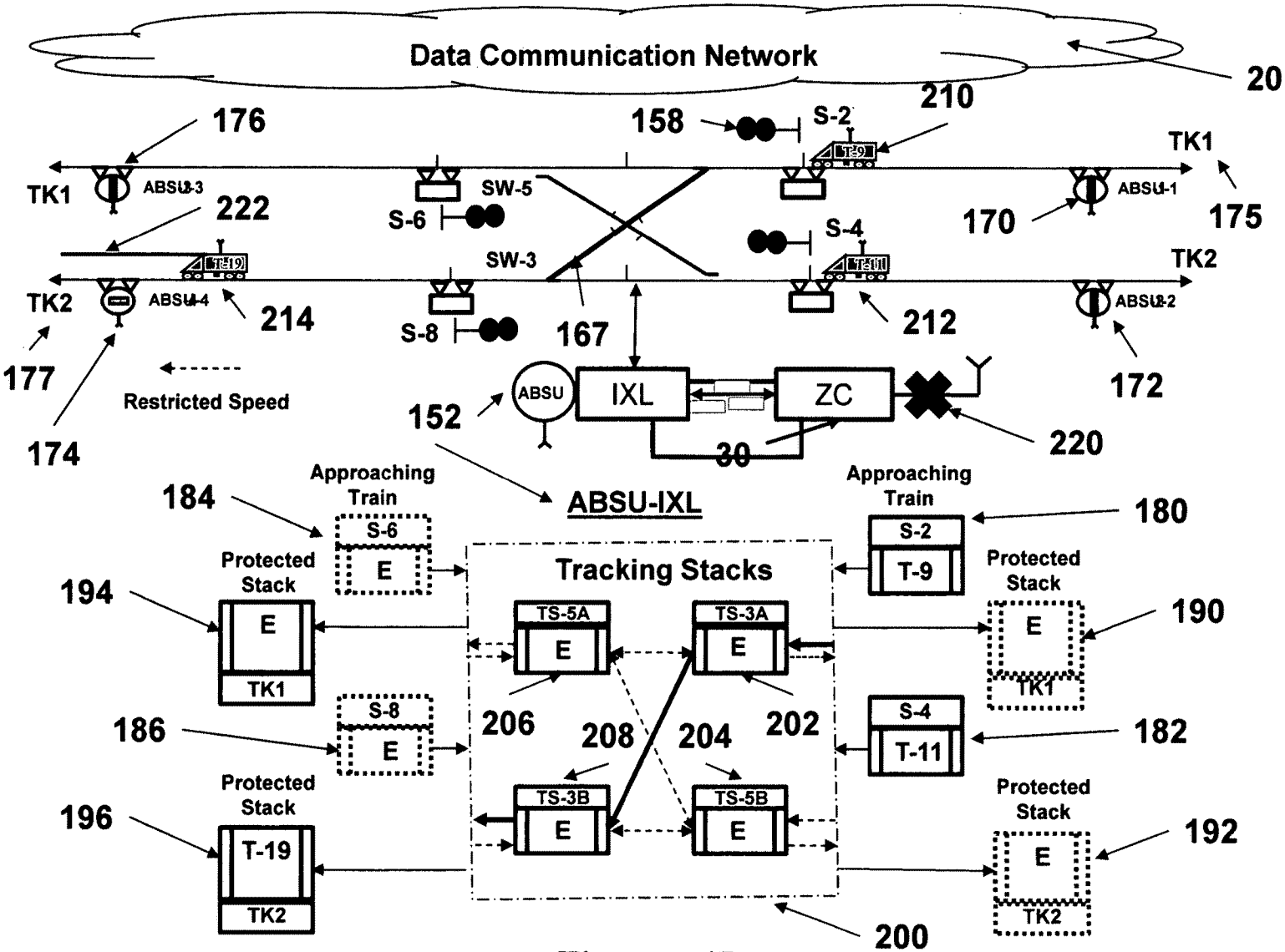

FIG. 46 reflects the transmission of a movement authority limit 218 from ABSU-3 176 to train T-2 216. Then, FIG. 47 indicates the movement of train T-2 216 past ABSU-3 176, and the transmission of a movement authority limit 222 from ABSU-4 174 to train T-19 214 upon the clearing of the absolute permissive block protected by ABSU-4 174.

Figure 48:
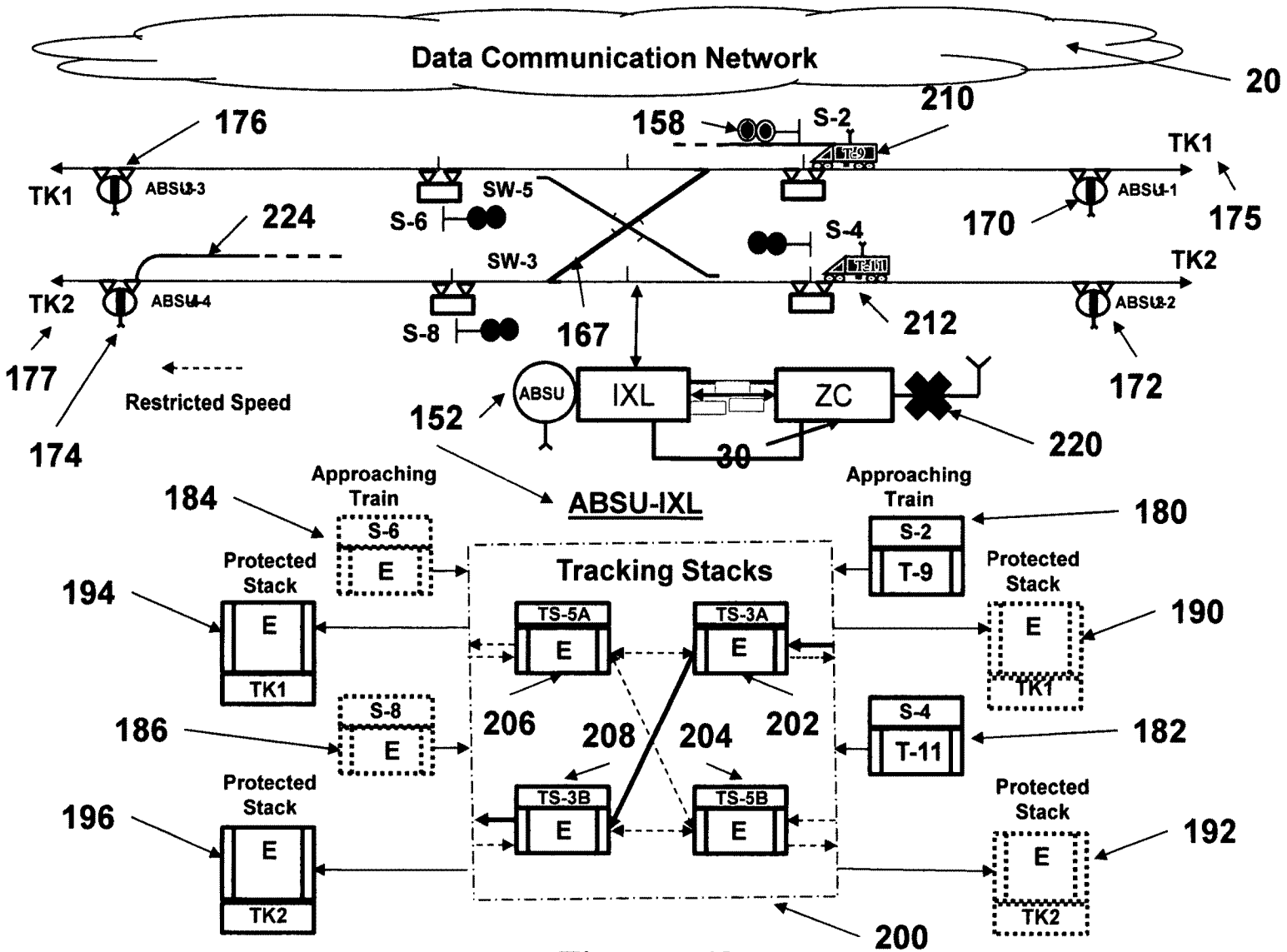
Figure 49:
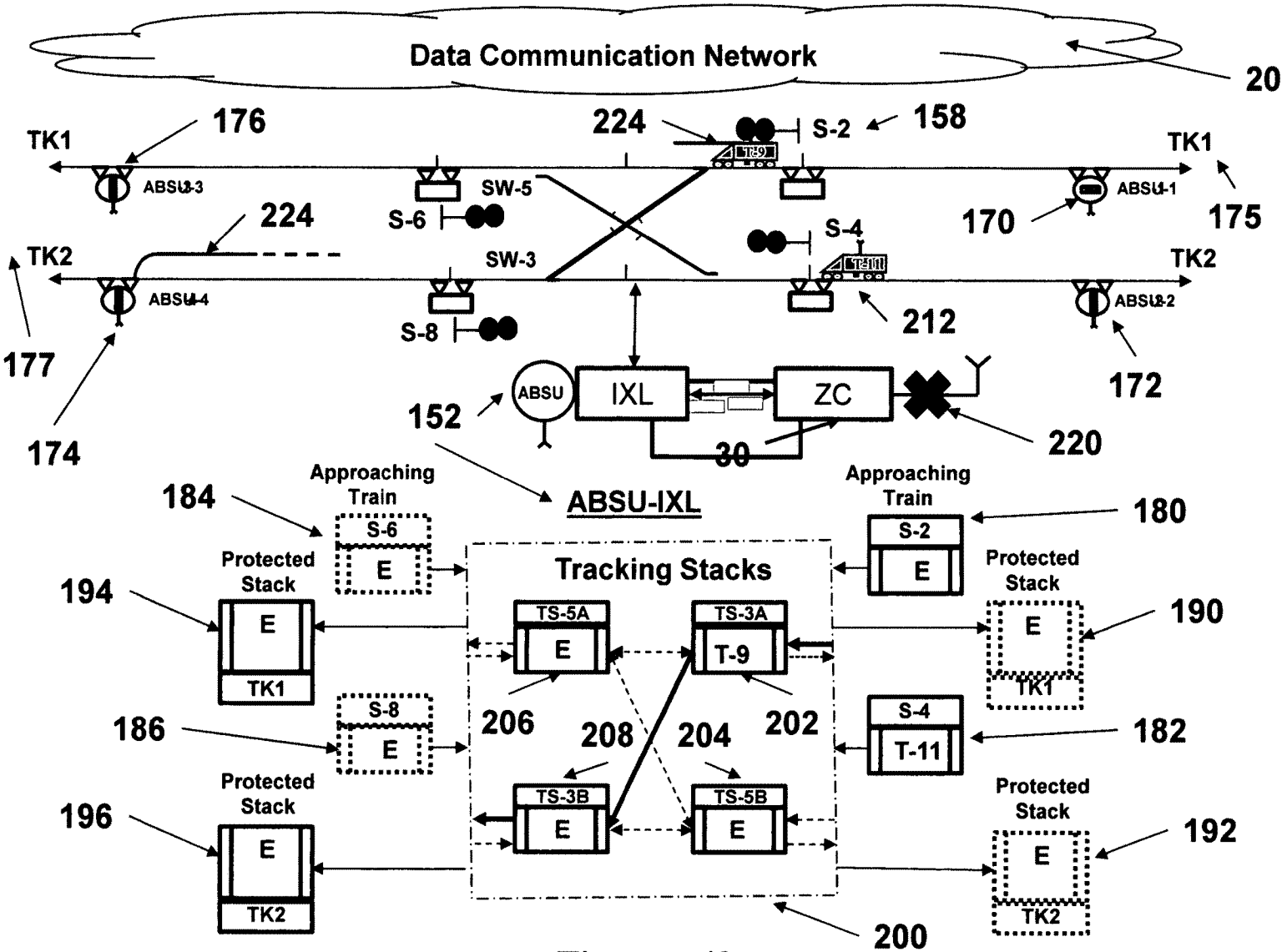

FIG. 48 reflects the movement of train T-19 past ABSU-4 174, the clearing of signal S-2 158, and the transmission of a movement authority limit 224 from ABSU-IXL 152 to train T-9 210 over switch SW-3 167 reverse. Then FIG. 49 reflects the movement of train T-9 224 past signal S-2 158 and the tracking of train T-9 210 by the internal tracking stack TS-3A 202. This figure also shows the permissive state for ABSU-1 170 to permit a following rain to move closer to the interlocking.

Figure 50:
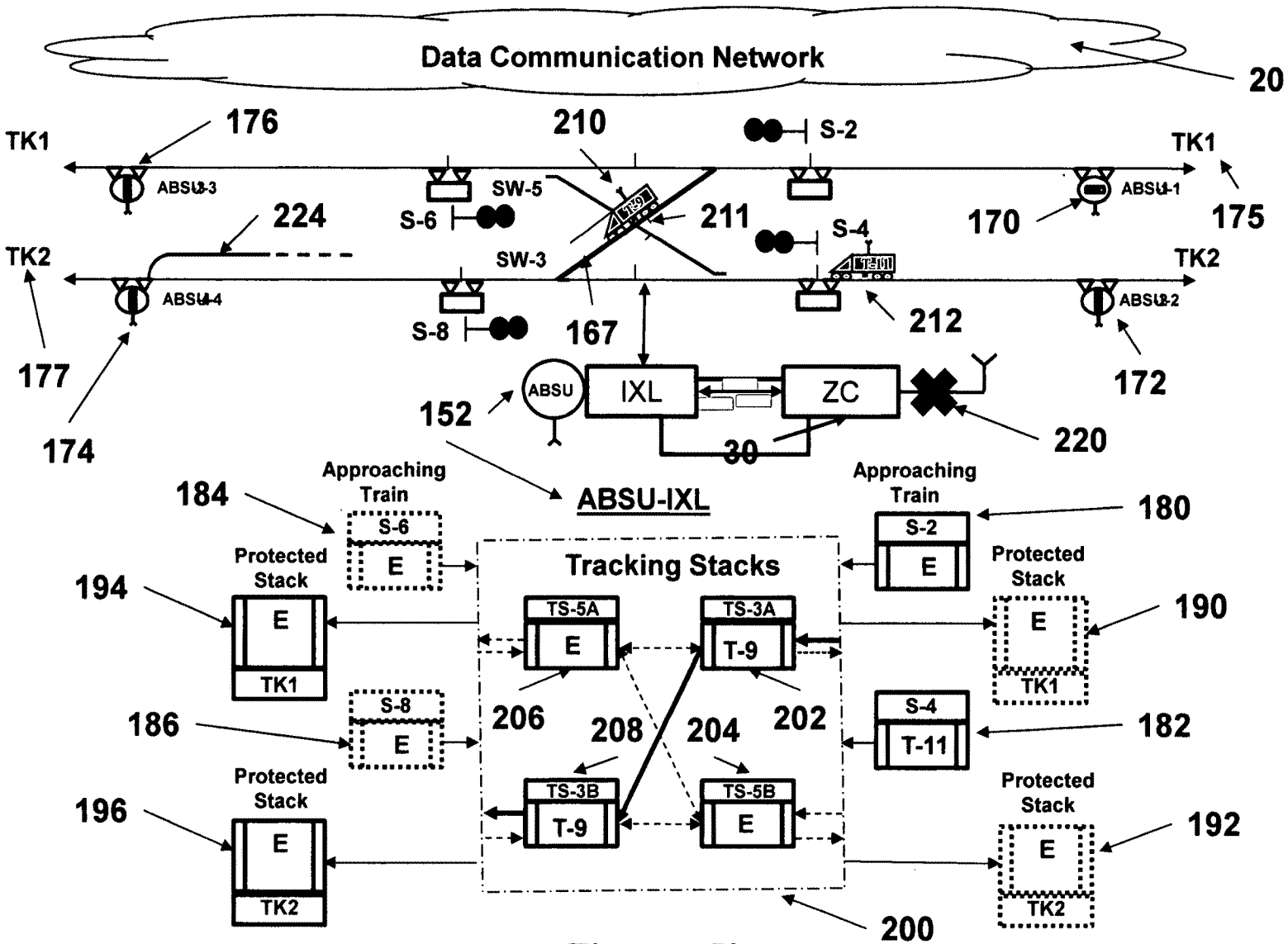
Figure 51:
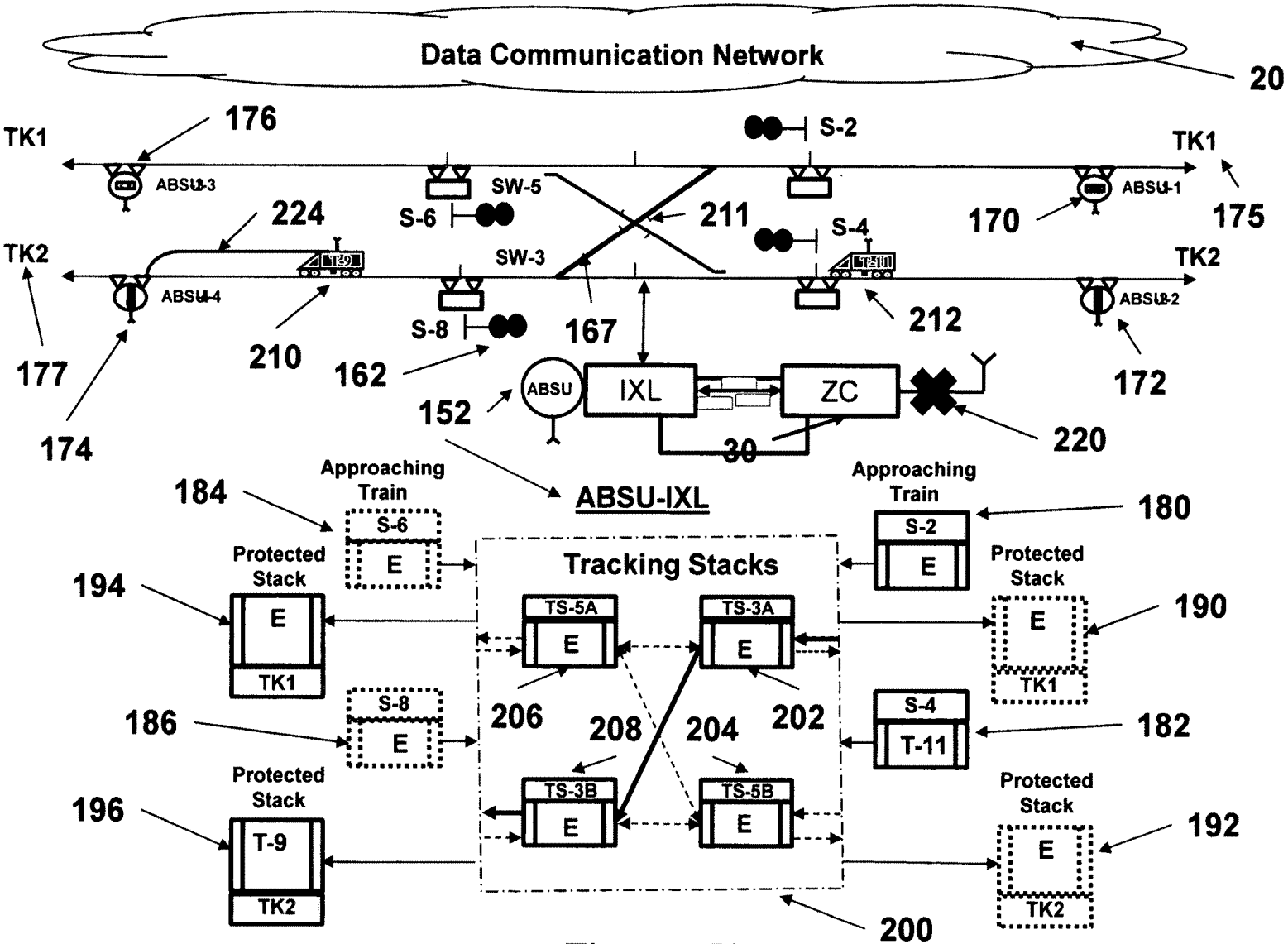

FIG. 50 reflects the movement of train T-9 210 and the interlocking tracking of that train by internal tracking stack TS-3B 208. Then FIG. 51 reflects the movement of train T-9 210 past signal S-8 162 and the clearing of the internal tracking stacks TS-3A 202 and TS-3B 208. Further, the interlocking protected stack for TK2 196 includes train T-9 210.

Figure 52:
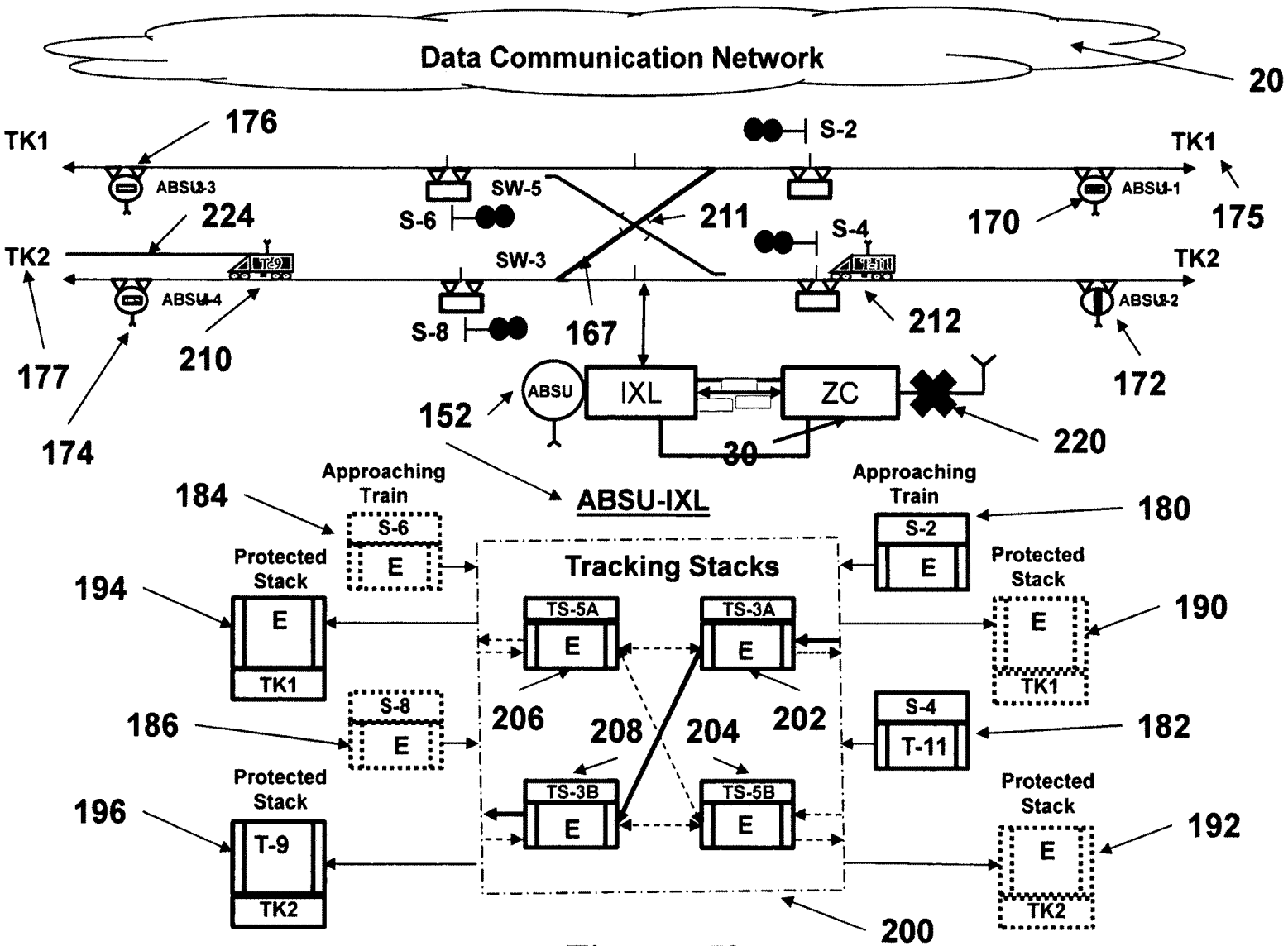
Figure 53:
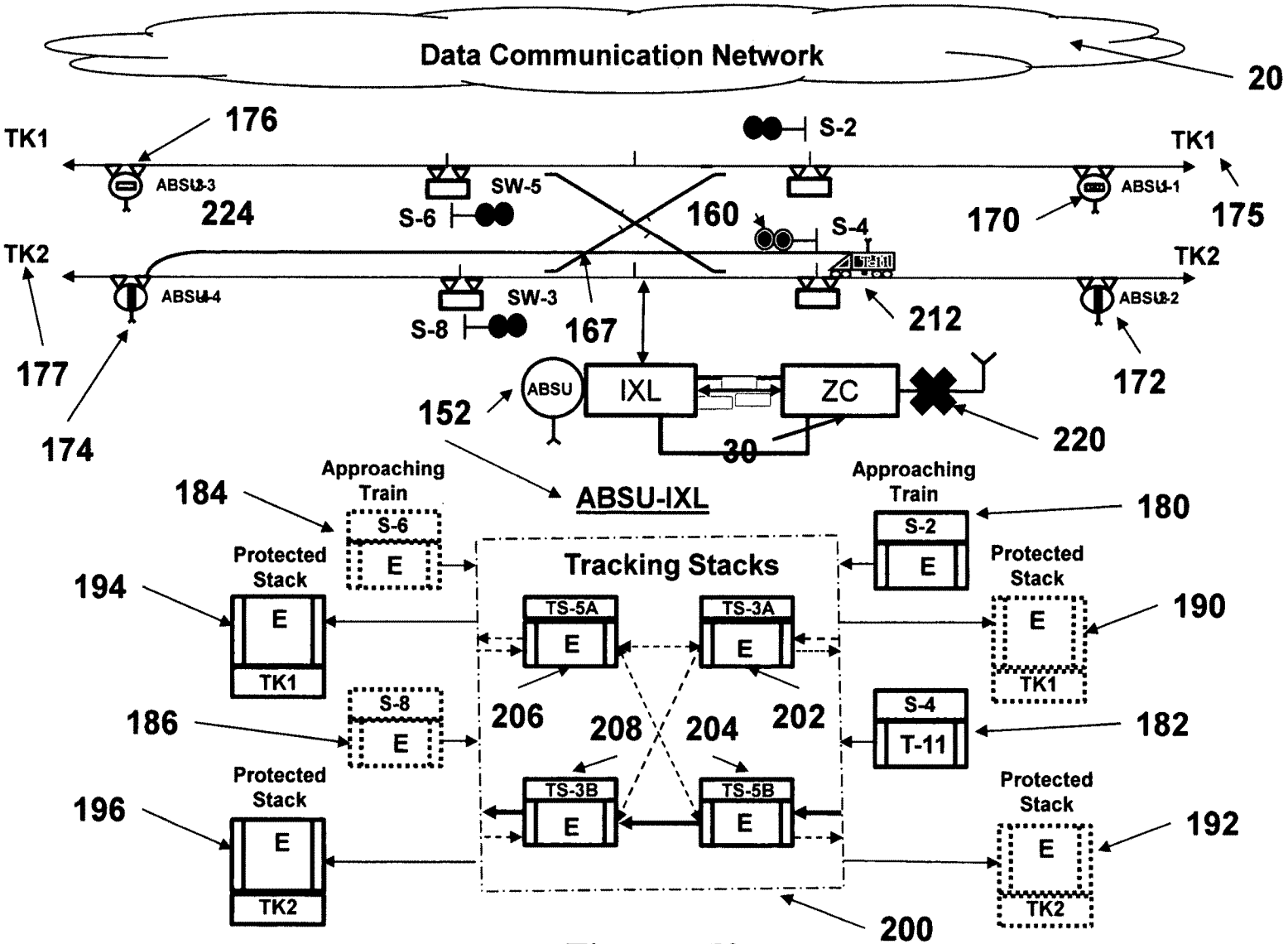

FIG. 52 shows that upon the clearing of ABSU-4 174, the movement authority limit 224 for train T-9 210 is extended past ABSU-4. Then FIG. 53 reflects the movement of train T-9 210 past ABSU-4 174, the resulting clearing of the interlocking protected stack for TK2 196, the subsequent clearing of signal S-4 160, and the transmission of a movement authority limit from ABSU-IXL 152 to train T-11 212 to proceed past signal S-4 160 over switch SW-3 167 normal.

Figure 54:
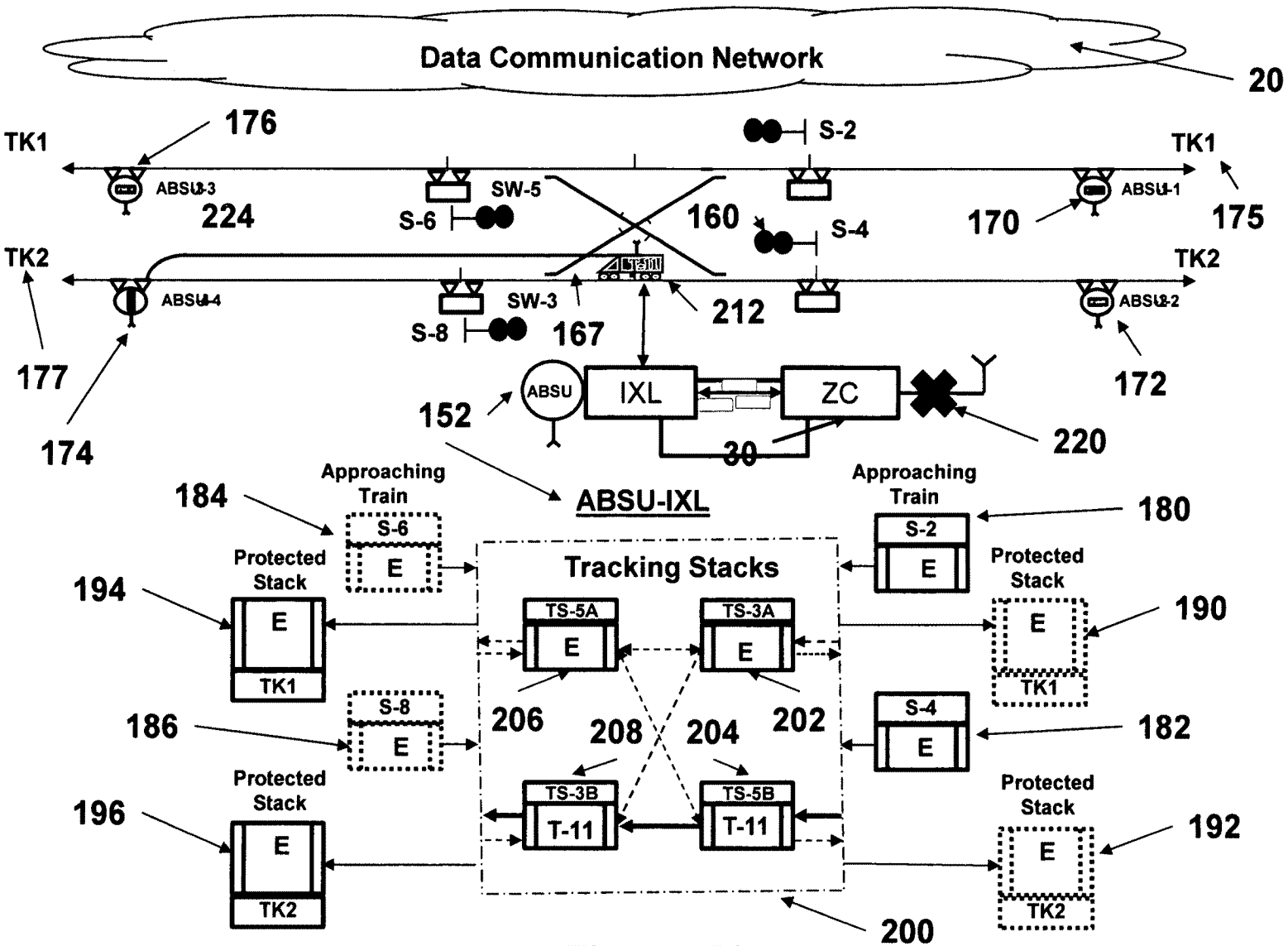
Figure 55:
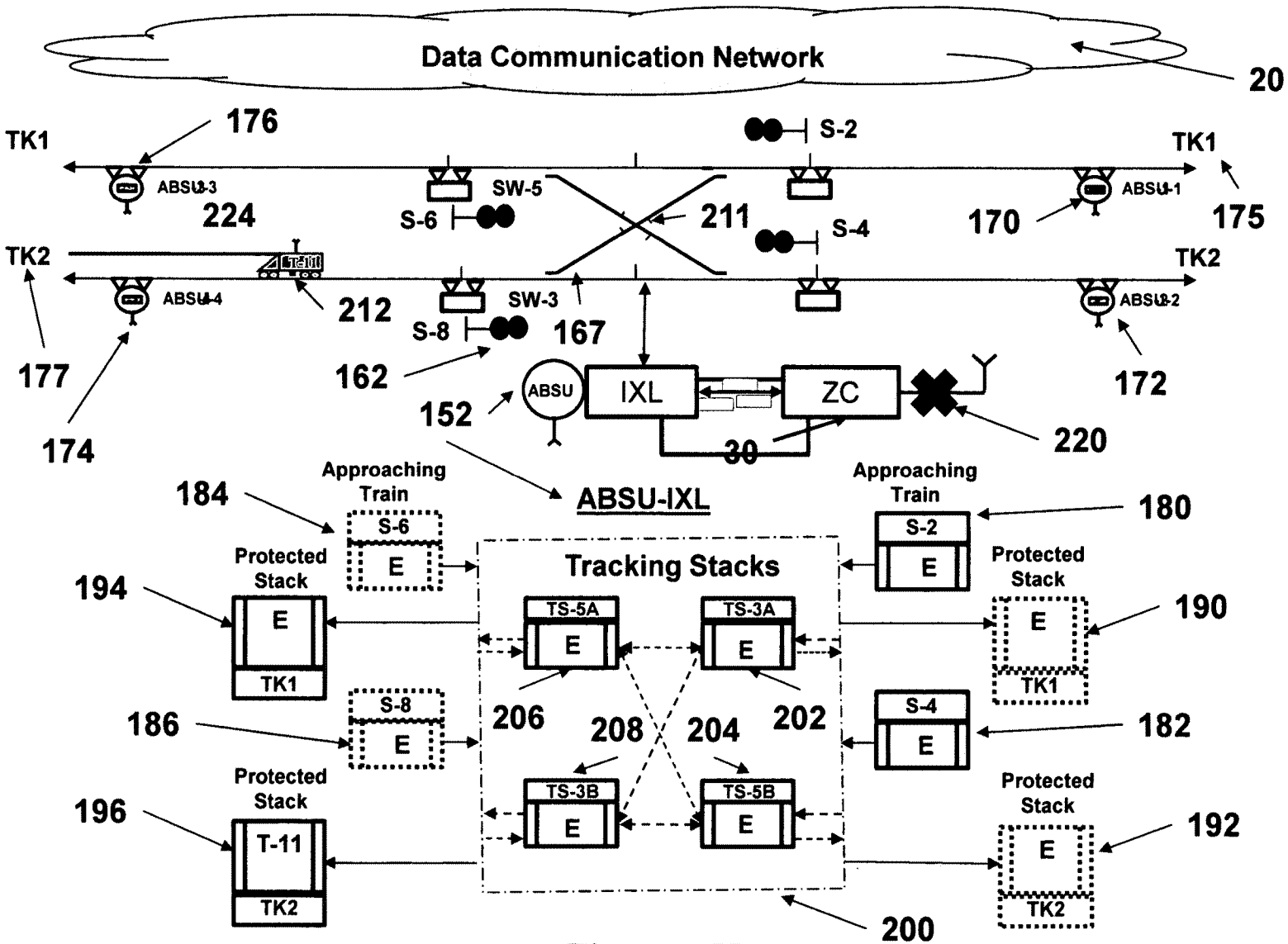

FIG. 54 reflects the movement of train T-11 212 into the interlocking past signal S-4 160, and the tracking of train T-11 212 by internal tracking stacks TS-5B 204 and TS-3B 208. Then FIG. 55 reflects the movement of train T-11 212 past signal S-8 162, the clearing of the interlocking internal tracking stacks TS-5B 204 and TS-3B 208, and the status of the interlocking protected stack for TK2 196 that now includes train T-11 212.

It should be noted that the demonstrations shown in FIGS. 37-55 are set forth herein for the purpose of describing the preferred embodiment and are not intended to limit the invention hereto. As would be understood by a person with ordinary skills in the art, a different architecture to track trains within the interlocking limits could be devised. For example, a different design choice is to provide an internal tracking stack for each internal interlocking route, and to select the appropriate stack based on switch positions. It should also be noted that the proper tracking of trains within an interlocking is based on the established premise that switches are locked by a switch detector circuit, and cannot change position as long as the detector circuit is occupied by a train.

Figure 56:
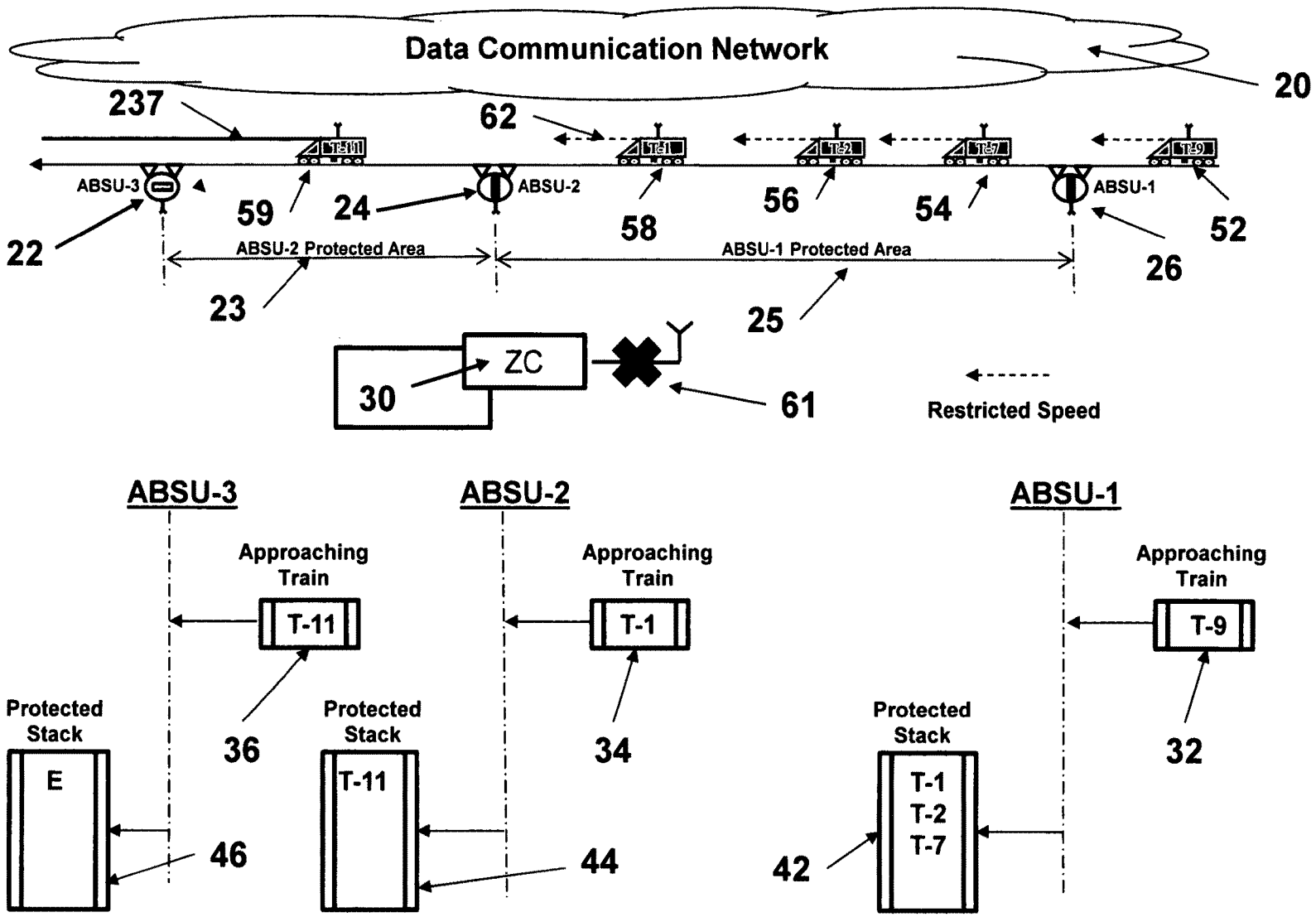
FIGS. 56-61 demonstrate the process to initialize a failed zone controller using data from the ABSUs in accordance with the preferred embodiment of the invention.

FIGS. 56-61 demonstrate the process to initialize a failed zone controller using data from the ABSUs. FIG. 56 shows the initial operating conditions prior to the restoration and initialization of the failed zone controller 30, wherein the AWS in the zone controller territory includes ABSU-1 26, ABSU-2 24 and ABSU-3 22, and wherein five (5) trains operate in the territory. This figure shows the initial conditions for the ABSUs, wherein ABSU-1 26 and ABSU-2 24 are displaying a stop aspect, while ABSU-3 22 is displaying a "clear" aspect. The figure also shows trains T-1 58, T-2 56, T-7 54 and T-9 52 operating with a speed restriction 62, while train T-11 59 is operating with a movement authority limit 237.

Figure 57:
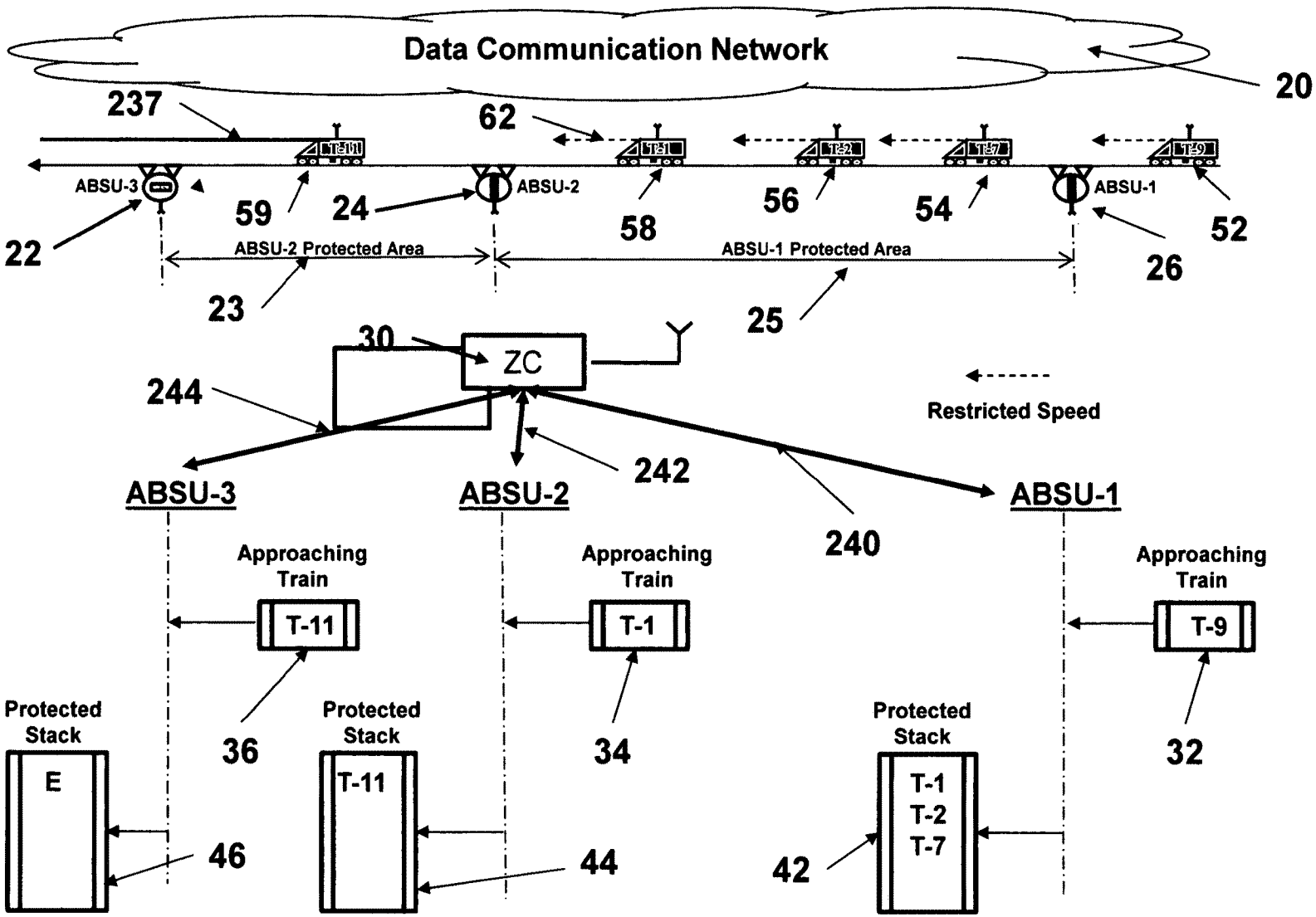

FIG. 57 indicates that upon the restoration of the zone controller 30, it establishes communications 240, 242 and 244 with ABSU-1 26, ABSU-2 24 and ABSU-3 22. Then upon the establishment of such communications, each ABSU communicates the sequence of trains (i.e. relative train positions) within its protected stack 42, 44 & 46, as well as the signatures of these trains. As such, ABSU-1 26 communicates to the zone controller 30 the signatures for trains T-1 58, T-2 56 and T-7 54. Similarly, ABSU-2 24 communicates to the zone controller 30 the signature for train T-11 59. Also, ABSU-3 22 communicates to the zone controller 30 that its absolute block territory has no trains. The signature for train T-9 52 is provided to the zone controller 30 by the ABSU in the approach to ABSU-1 26.

Figure 58:
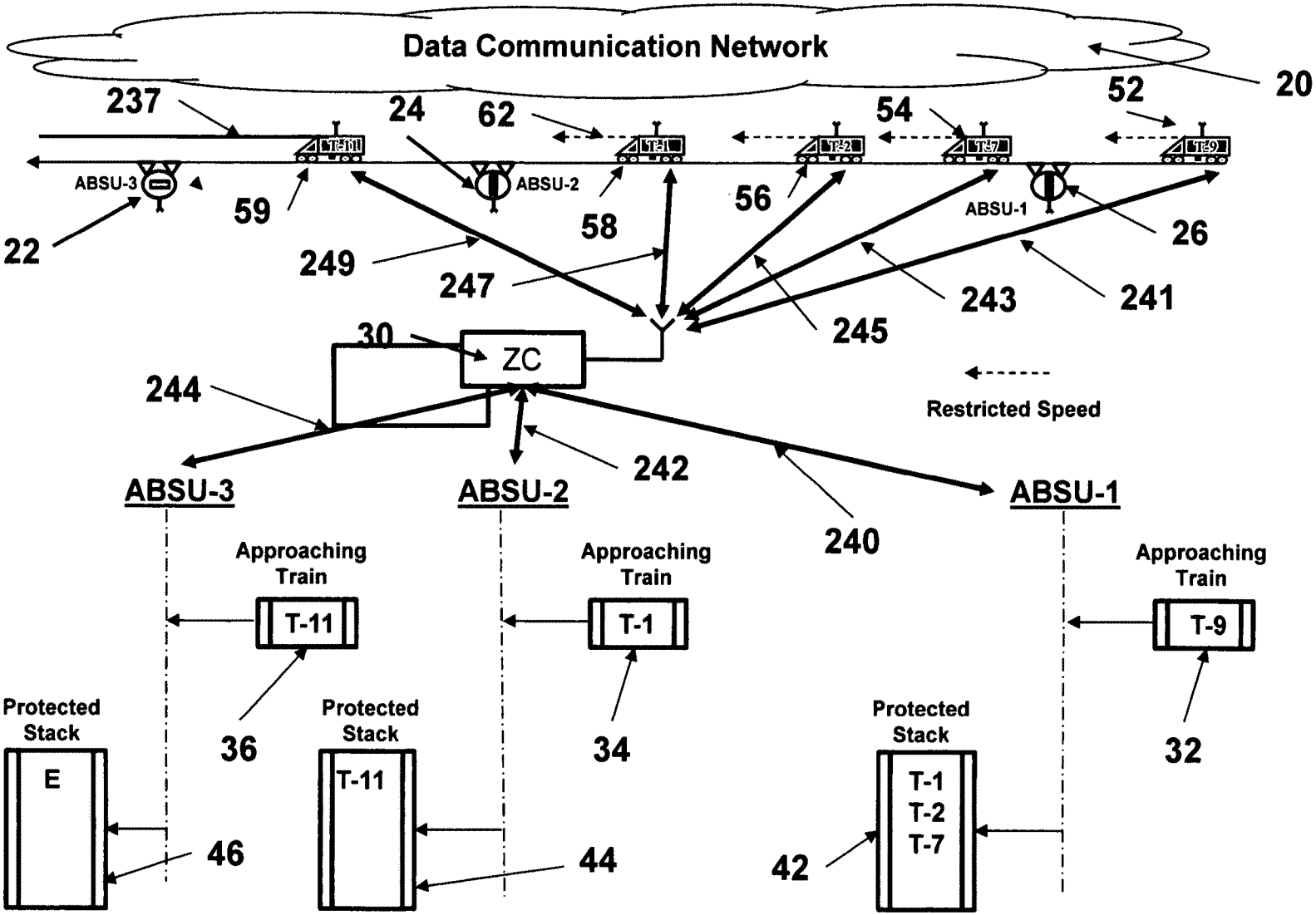
Figure 59:
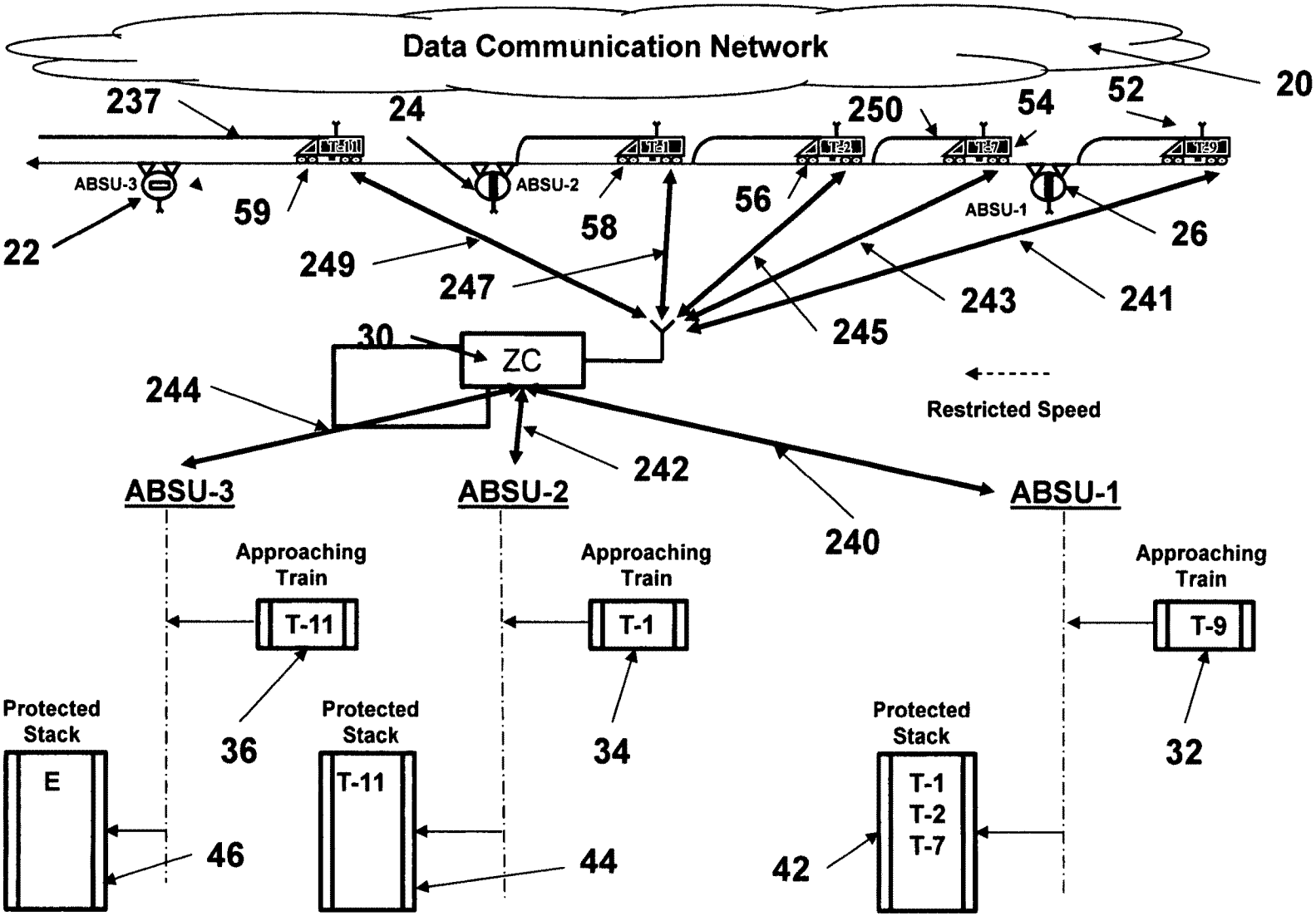
Figure 60:
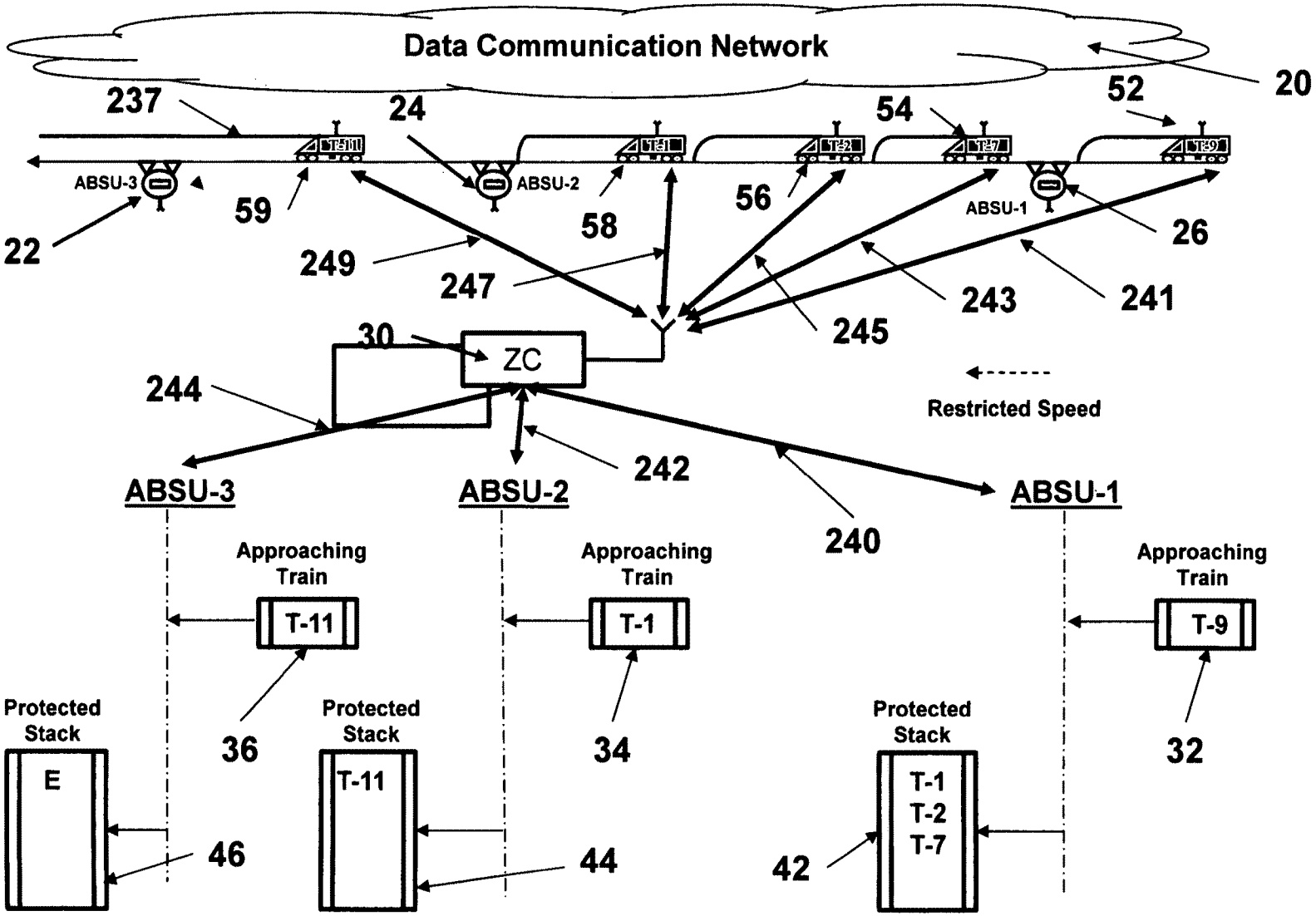
Figure 61:
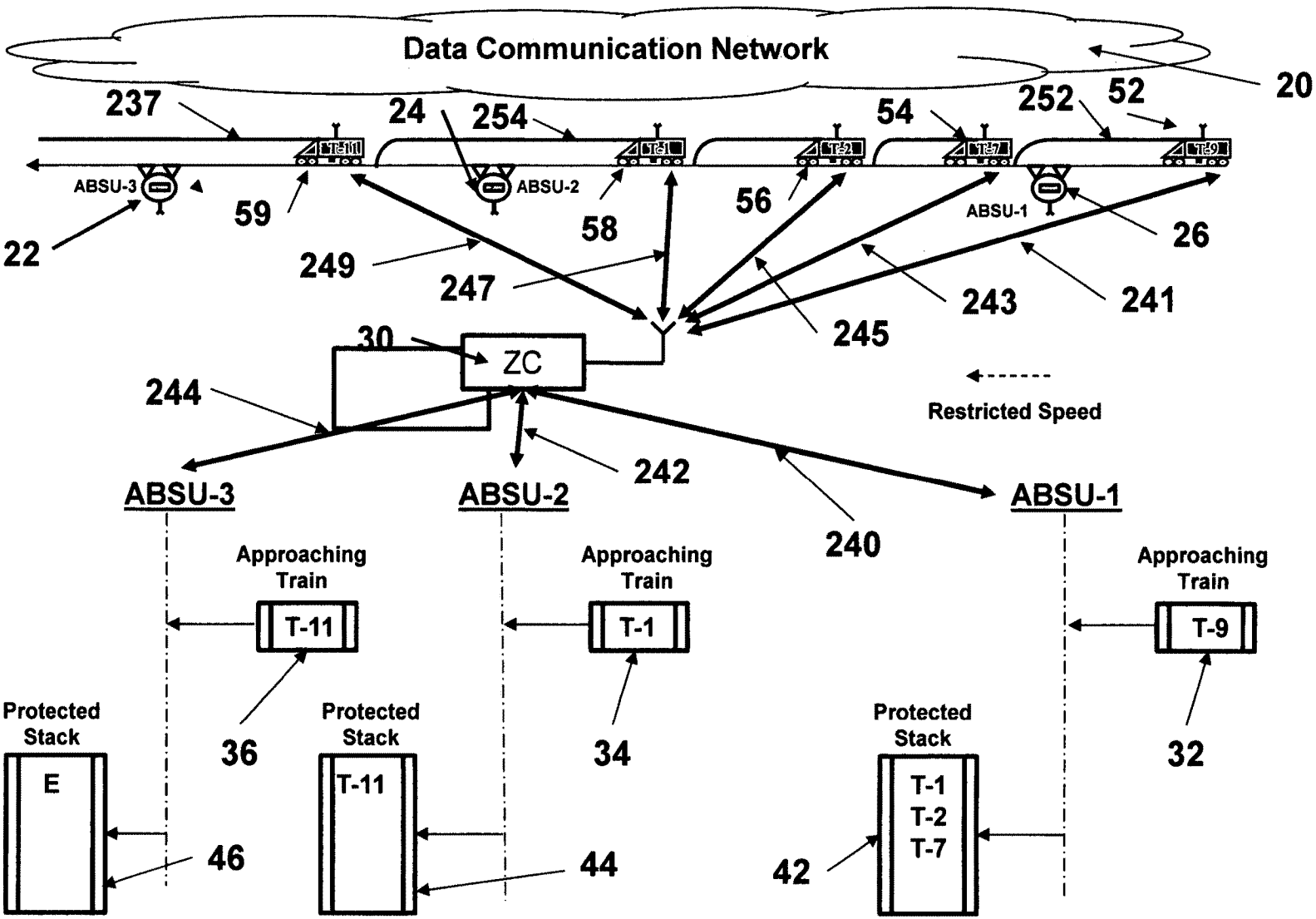

FIG. 58 shows that upon receiving train signature information from the various ABSUs, the zone controller 30 establishes communications with each of the identified trains. As such the zone controller establishes communications 241, 243, 245, 247 & 249 with trains T-9 52, T-7 54, T-2 56, T-1 58 and T-11 59. Then FIG. 59 shows that, upon establishing communication with a train, the zone controller 30 receives the train's location and evaluates traffic conditions to determine if it can issue a movement authority to the train. More specifically, the zone controller employs the relative train positions received from the ABSU's to determine if a movement authority can be issued to a train. For example, if the zone controller 30 is evaluating traffic condition ahead of train T-7 54, it confirms that it has established communication with train T-2 56 and has received its current location before it issues a movement authority 250 to train T-7 54. Alternatively, if the zone controller 30 fails to establish communication with a train, it cannot issue a movement authority to a following train. For example, if the zone controller 30 fails to communicate with train T-2 56, then it cannot issue a movement authority to train T-7 54. In such a case, train T-7 54 will continue to operate with a restricted speed until the zone controller establishes communication with train T-2 56 and ascertains its location.

As such, FIG. 59 reflects the condition that the zone controller 30 has established communications with all the identified trains. It should be noted that the movement authority issued to a train is limited by the location of a train ahead, or the location of an ABSU that is displaying a "stop" aspect. In this case, the movement authority for train T-9 52 is limited by the stop aspect of ABSU-1 26. Similarly, the movement authority for train T-1 58 is limited by the stop aspect of ABSU-2 24.

Upon receiving communication from an approaching train that it was issued a movement authority by the zone controller, the associated ABSU displays a clear aspect, and switches its mode of operation to the "standby" mode. As such, FIG. 60 reflects the condition that both ABSU-1 26 and ABSU-2 24 have switched to the standby mode after receiving communications from approaching trains T-9 52 and T-1 58. Then FIG. 61 demonstrates that upon receiving communications from ABSU-1 26 and ABSU-2 24 that they have switched to the "standby" mode, the zone controller 30 extends the movement authorities 252 & 254 for trains T-9 52 and T-1 58 to the location of the train ahead. This concludes the initialization process for the zone controller 30.

It should be noted that the zone controller initialization process demonstrated in FIGS. 56-62 is set forth herein for the purpose of describing the preferred embodiment, and is not intended to limit the invention hereto. As would be understood by a person with ordinary skills in the art, various changes in the disclosed process could be utilized to initialize the zone controller after a failure condition. For example, upon establishing communications with all identified trains and ascertaining their locations, the zone controller can communicate to the ABSUs to switch to the "standby" mode. It should also be noted that in the event a train fails to communicate with a zone controller, it will be continue to be tracked by the ABSUs as demonstrated in FIGS. 22-33.

Figure 62:
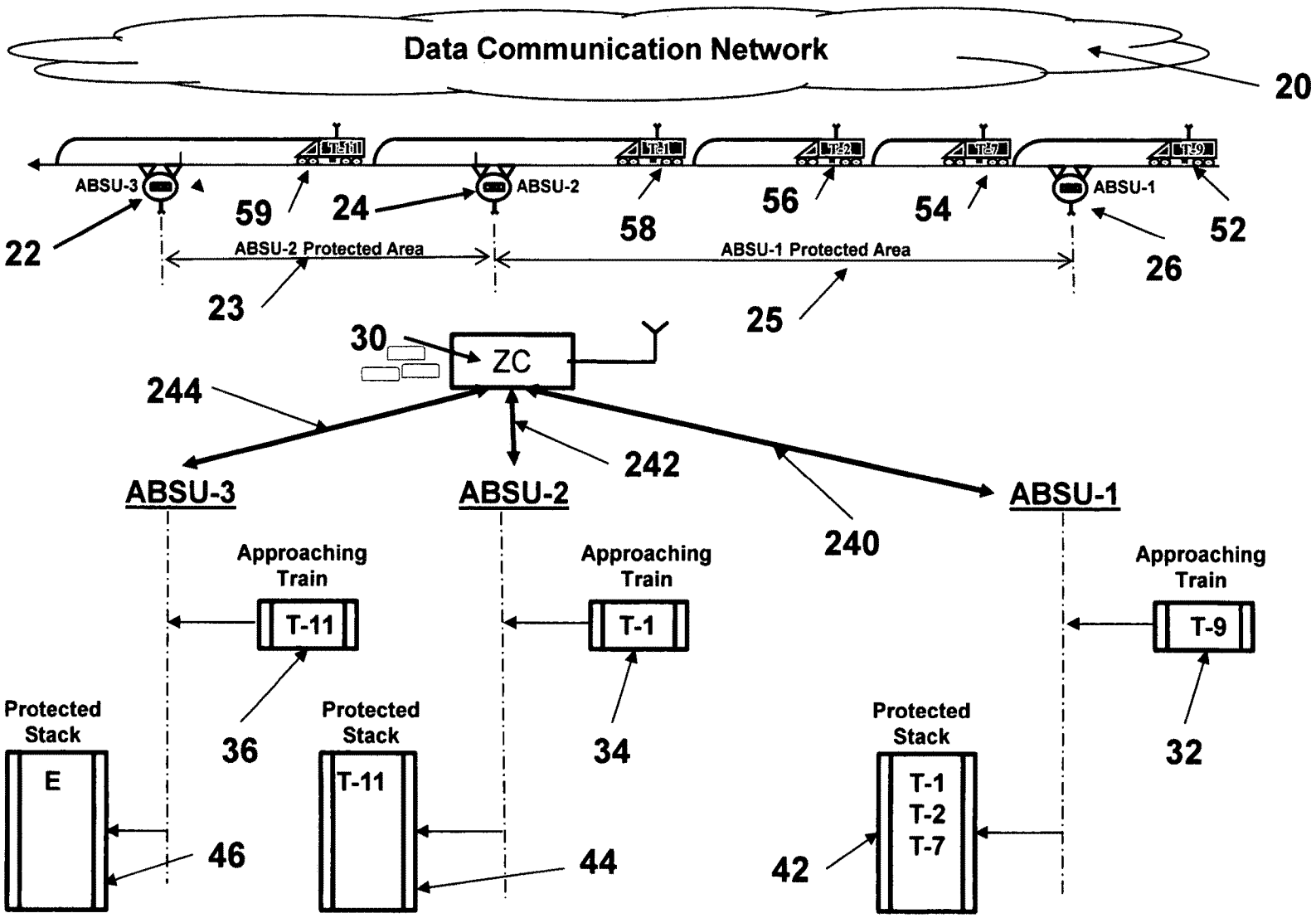
FIG. 62 shows the traffic conditions prior to an ABSU failure, wherein CBTC operation is in progress and the ABSUs are operating in a "standby" mode.
Figure 63:
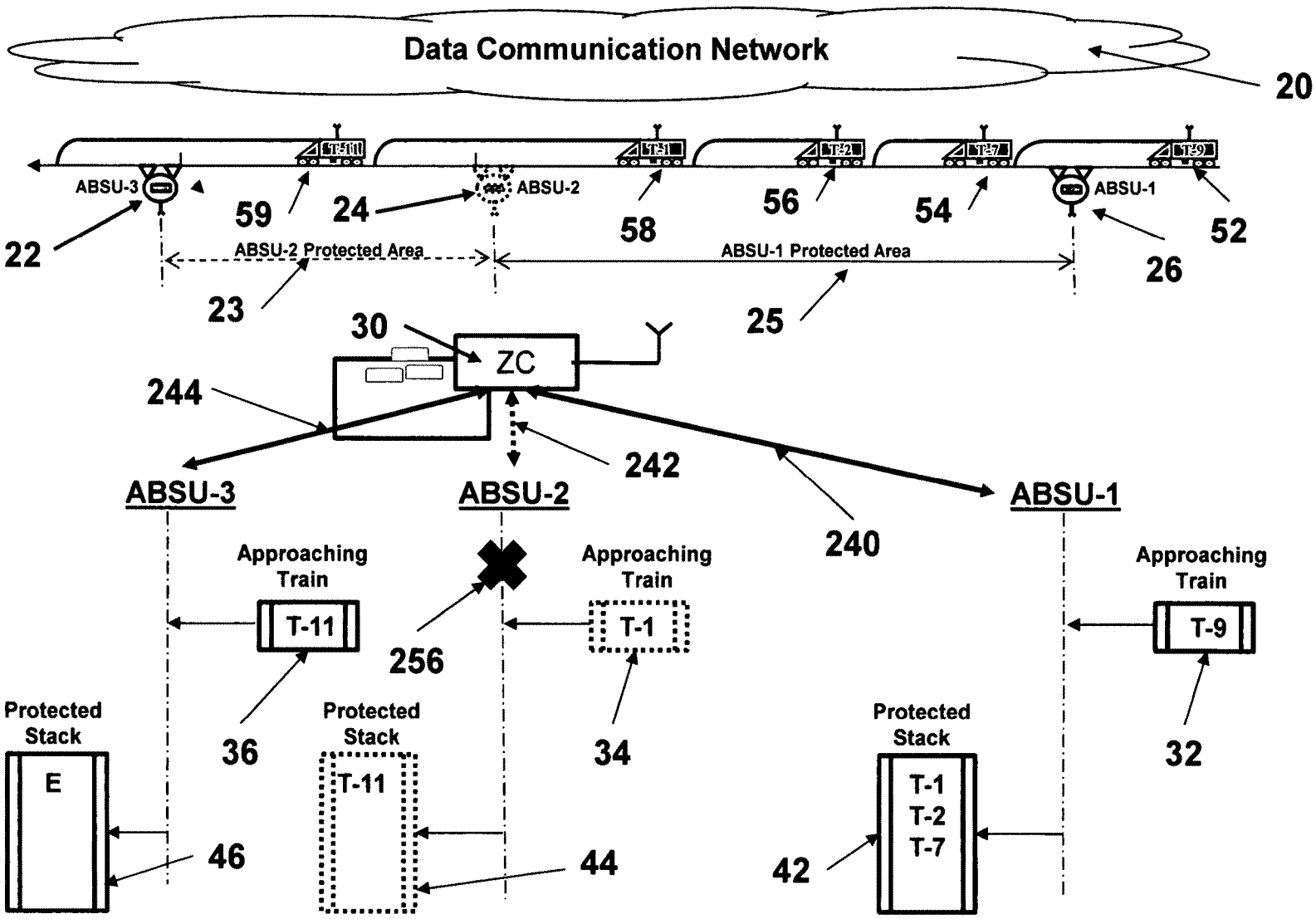
FIGS. 63 & 64 demonstrate a step by step standby mode operation of the ABSUs during a single ABSU failure, and the reconfiguration of the AWS in accordance with the preferred embodiment of the invention.
Figure 64:
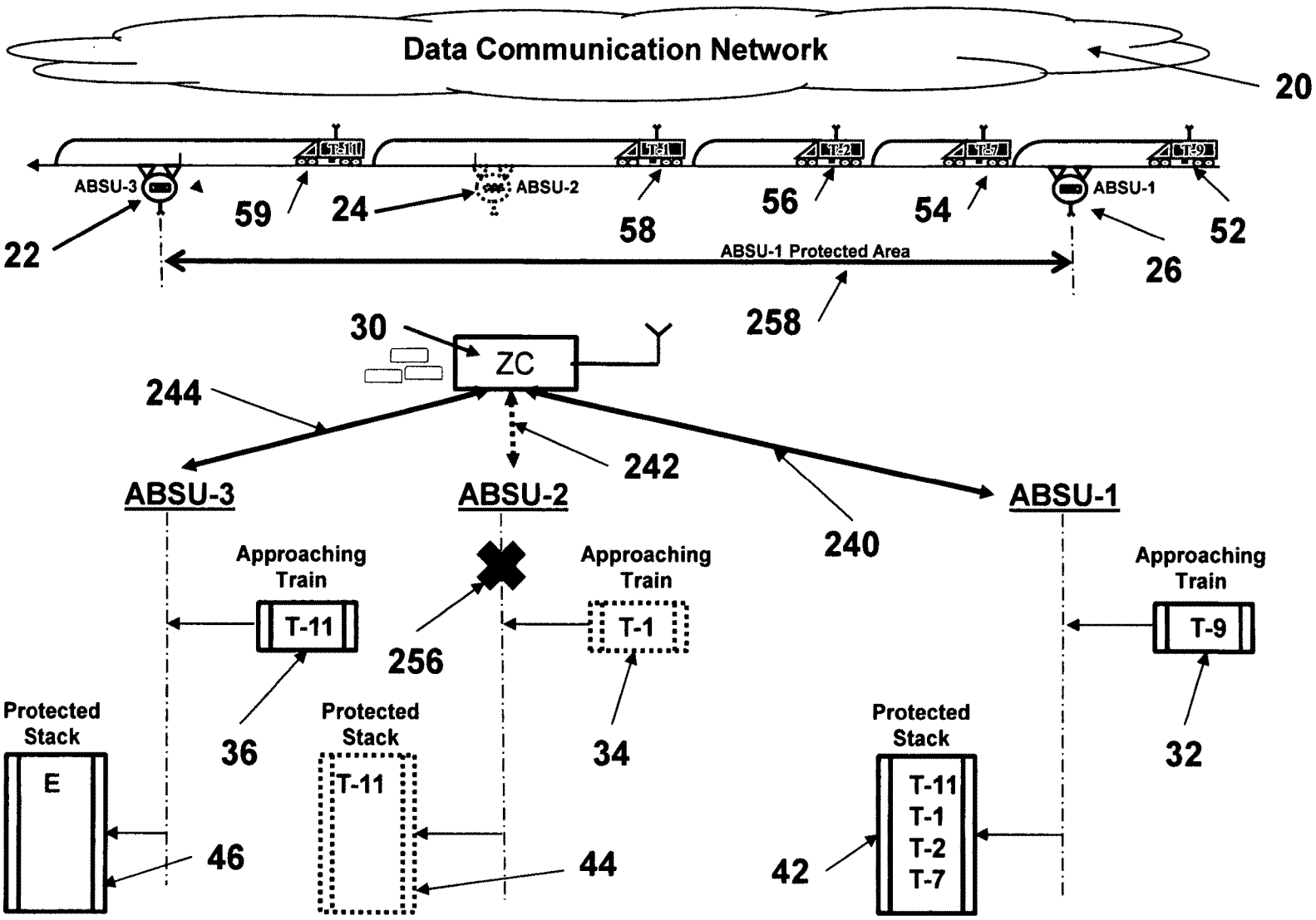
Figure 65:
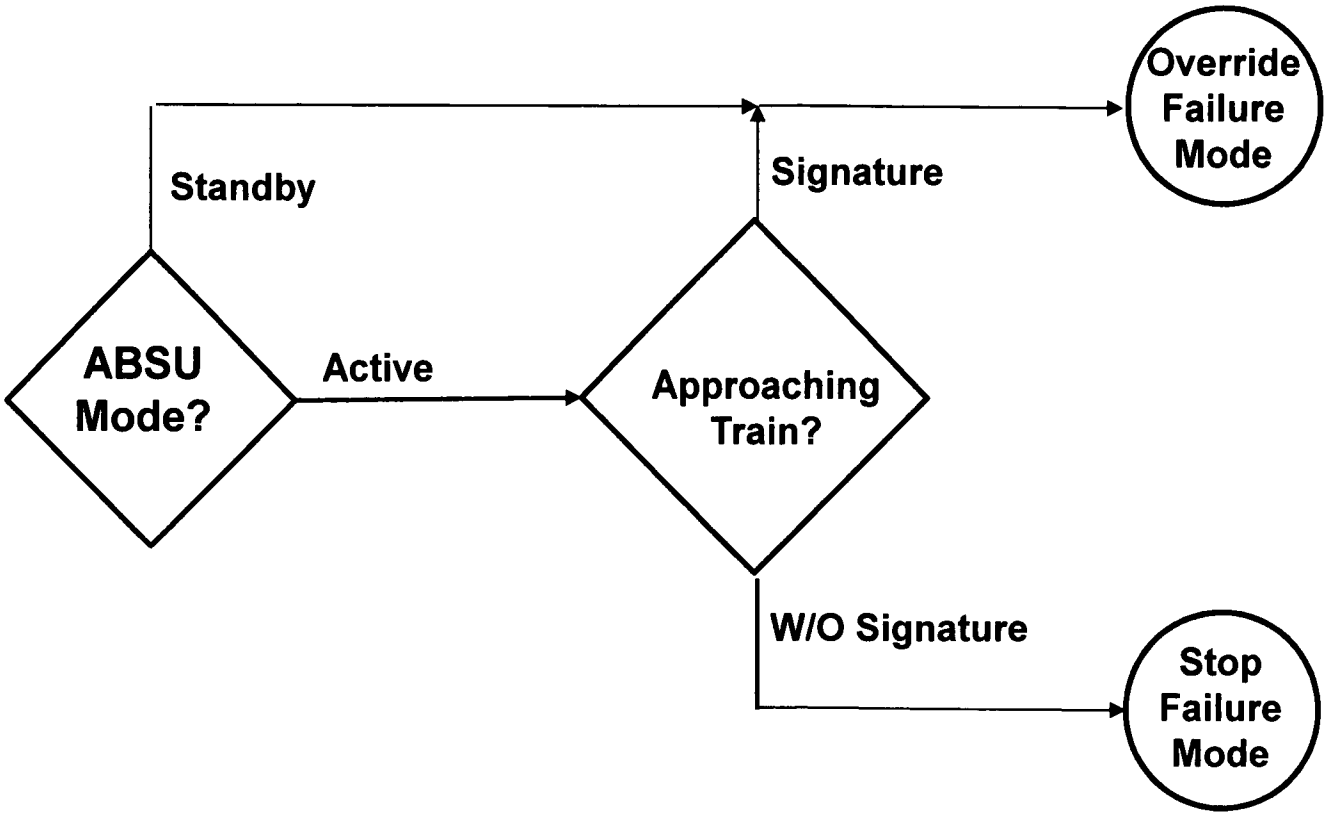
FIG. 65 shows the logic diagram used to precondition an ABSU to fail in one of two failure states based on the operating condition of an approaching train in accordance with the preferred embodiment of the invention.

As indicated in the summary section herein, in the event an ABSU fails while it is operating in a standby mode, the CBTC system detects such failure, and removes the failed ABSU from the AWS configuration. FIG. 62 shows the traffic conditions prior to an ABSU failure, wherein CBTC operation is in progress and ABSU-1 26, ABSU-2 24 and ABSU-3 22 are operating in a "standby" mode. Under this operating scenario, protected stack 42 for ABSU-1 26 includes trains T-1, T-2 and T-7, while the protected stack 44 for ABSU-2 24 includes train T-11. Then FIG. 63 indicates that ABSU-2 24 has failed 256. The zone controller 30 detects this failure either through a loss of communication 242 with ABSU-2 24, or by receiving an error message from ABSU-2 24. FIG. 64 demonstrates that upon detecting a failure in ABSU-2 24, the zone controller 30 communicates the failure condition 240 & 244 to ABSU-1 26 and ABSU-3 22, and augments the protected stack 42 of ABSU-1 by adding train T-11. In effect, the protected stack 44 of the failed ABSU-2 24 is combined with the protected stack 42 of ABSU-1 26, which is the "Approach ABSU" to the failed ABSU-2. This ABSU reconfiguration results in a longer absolute permissive block 258 that combines the territories of the two permissive absolute blocks in the approach to and ahead of failed ABSU-2 24. Also, upon receiving communication from the zone controller that ABSU-2 24 has failed, ABSU-1 26 and ABSU-3 22 establish communication together as adjacent ABSUs. Further, as shown in FIG. 65, since train operation is under CBTC protection and because the ABSUs do not provide any train protection while operating in the "standby" mode, ABSU-2 24 is designed to fail into an overridden failure state, wherein a special override aspect is displayed and the automatic train stop is set to a clear position. It should be noted that this reconfiguration process is transparent to, and has no impact on CBTC operation. It should be noted that the use of zone controller to manage the failure of an ABSU that is operating in the "standby" mode is set forth herein for the purpose of describing the preferred embodiment and is not intended to limit the invention hereto. As would be appreciated by a person of ordinary skills in the art, the management of the ABSU failure could be achieved without the zone controller. For example, and as disclosed in the summary section herein, and upon a failure of an ABSU, the Approach ABSU and the ABSU ahead can establish communication together and form a longer absolute permissive block to reconfigure the AWS system around the failed ABSU. The Approach ABSU will use "provisional" trains as place holders during a transition period until the AWS system operates normally with the longer absolute permissive block. Since the ABSUs are operating in the "standby" mode, CBTC train service is not affected.

An alternate ABSU failure scenario can occur when the ABSUs are operating in the active mode. In such scenario, the zone controller is not available to affect the reconfiguration of the ABSUs during an ABSU failure. It should be noted that an ABSU failure while operating in the active mode constitutes a double failure (since the ABSU would fail at the same time when the zone controller has also failed), which is very unlikely. It should also be noted that an ABSU failure while operating in active mode would involve multiple operating scenarios related to the operating condition of the train approaching the failed ABSU. For example, an approaching train could be operating with a movement authority limit, operating with a restricted speed, or could be operating manually pursuant to operating rules and procedures. As disclosed above, a data field within the train signature reflects the operating condition of the train (train status). In view of such multiple operating scenarios, the preferred embodiment provides a unique design for the ABSU that controls the failure state of the ABSU if the failure occurs during an active mode operation. This design is related to the aspect that is displayed at the failed ABSU and the status of the automatic train stop.

More specifically, and as shown in FIG. 65, during an active mode of operation, an ABSU is designed to fail in one of two failure states depending on the operating condition of the approaching train. The first failure state is defined as the "override" failure state, and is selected if the train approaching the ABSU is an equipped train with a train signature that indicate that the train is equipped and is operating either with a MAL or a speed restriction. In the "override" state, the ABSU is designed to automatically display an "override" aspect and to drive the automatic stop to a clear position. Further, in the override mode, the active transponder defaults to transmitting a special failure code to an approaching train. This special failure code is ignored under most operating conditions, except when an approaching train has neither a MAL that ends at the failed ABSU location. In such case, the detection of the special failure code authorizes the train to proceed at a restricted speed. The second failure state is identified as "stop" failure state, and is selected if the train approaching the ABSU does not have a train signature or has a train signature that does not reflect a valid train status (in such a case the approaching train is considered unequipped). In the "stop" state, the ABSU is designed to automatically display a "stop" aspect and to drive the automatic stop to a tripping position.

Under normal AWS operating conditions, an equipped train (with a proper train status reflected in its signature) approaching an ABSU is operating under the protection of either a MAL or a restricted speed. Alternatively, a train without a signature or without a proper train status is considered to be a manual train with no speed restrictions. Accordingly, the failure recovery process when an ABSU that fails while operating in the active mode is as follows: Upon the occurrence of an ABSU failure, it is assumed that communication is interrupted between the failed ABSU and the Approach ABSU, as well as with the ABSU Ahead. In accordance with the preferred embodiment, the ABSU is designed to establish communication with the next ABSU in an AWS configuration when communication is lost with an adjacent ABSU. As such, when an ABSU fails, the Approach ABSU and the ABSU ahead establish communication together as adjacent ABSUs. After such communication is established, the Approach ABSU receives from the ABSU Ahead the train signature of the train approaching its location. Then upon receiving such train signature, the Approach ABSU places the received train signature at the top of its protected stack. However, since the Approach ABSU has no current information related to the trains that were included in the protected stack of the failed ABSU, it inserts additional "provisional" train signatures between the train signature received from the ABSU Ahead and the train signature that was originally at the top of its protected stack. The number of provisional train signatures is a design choice, and is resolved when the train that was originally at the top of said protected stack reaches the ABSU Ahead.

Figure 66:
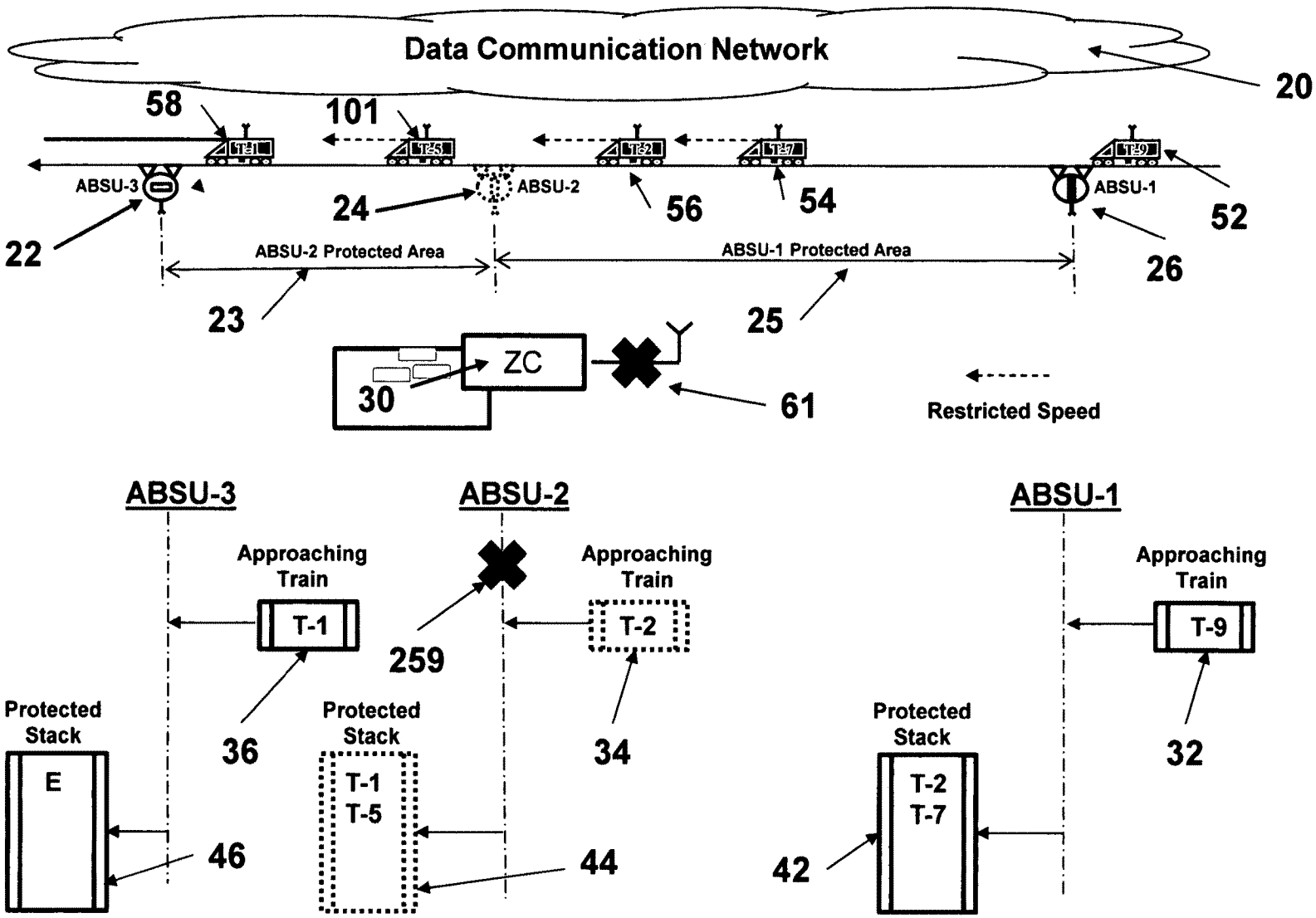
FIGS. 66-71 demonstrate a step by step active mode operation of the ABSUs during a failure of the zone controller as well as a single ABSU failure, and the reconfiguration of the AWS in accordance with the preferred embodiment of the invention.

An example of the above disclosed process is provided in FIG. 66, wherein ABSU-2 24 fails 259 while operating in the active mode. In this operating scenario, the protected stack 44 for ABSU-2 24 includes two trains: T-1 58 and T-5 101. The approaching train to ABSU-3 22 is T-1 58, and the train at the top of the protected stack for ABSU-1 26 is T-2 56. As such, train T-5 101 is not identified to both ABSU-1 26 and ABSU-3 22.

Figure 67:
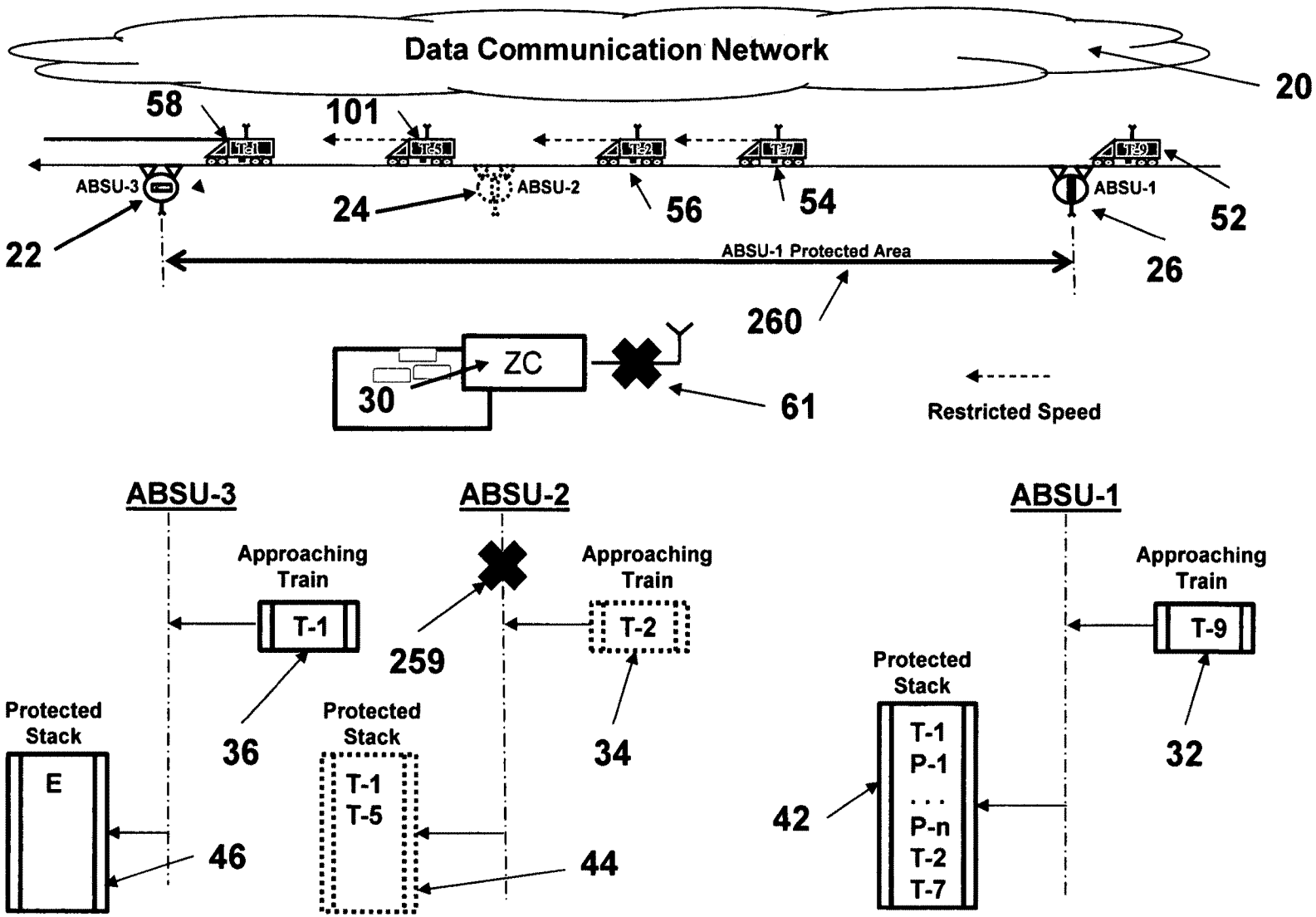
Figure 68:
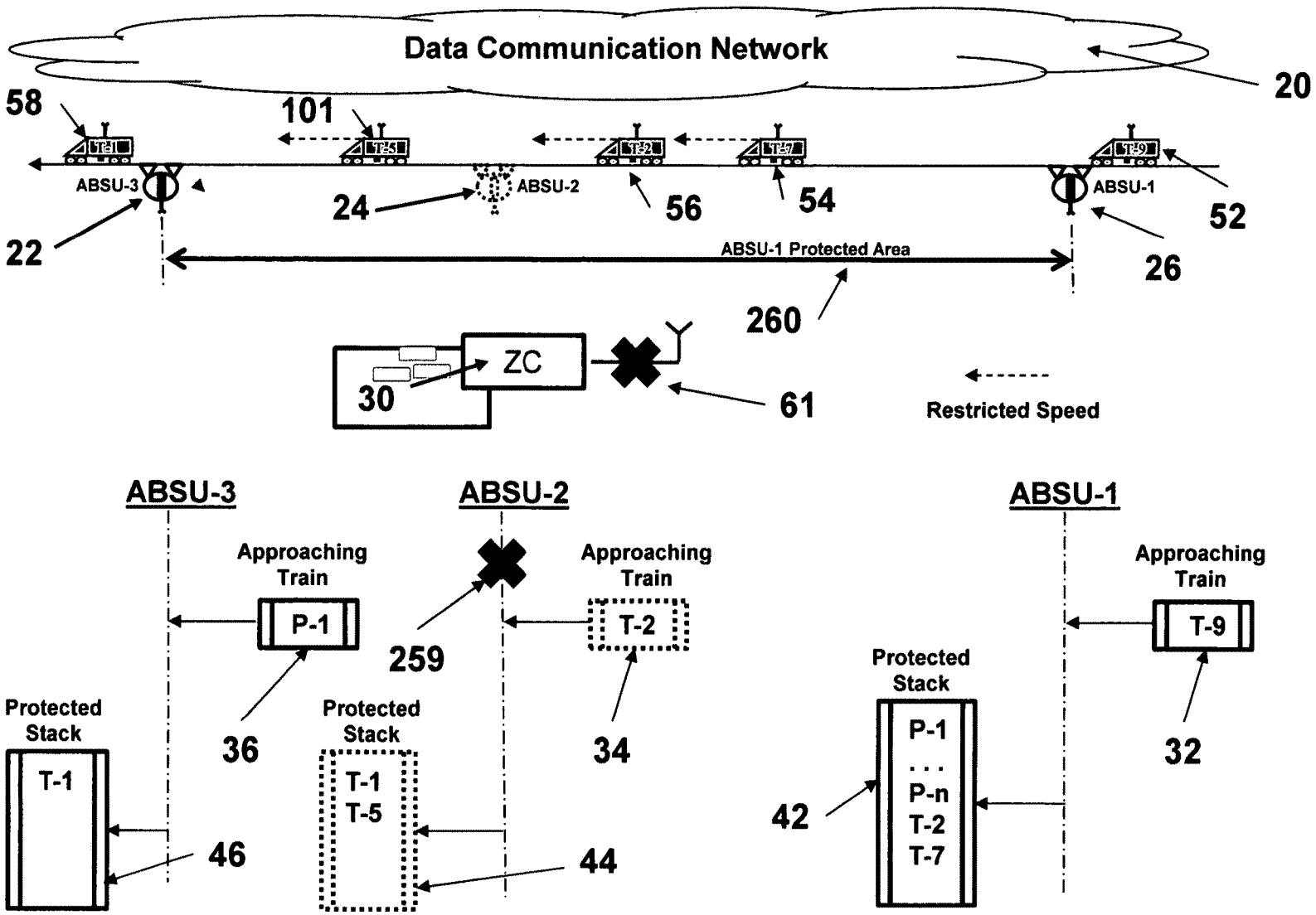
Figure 69:
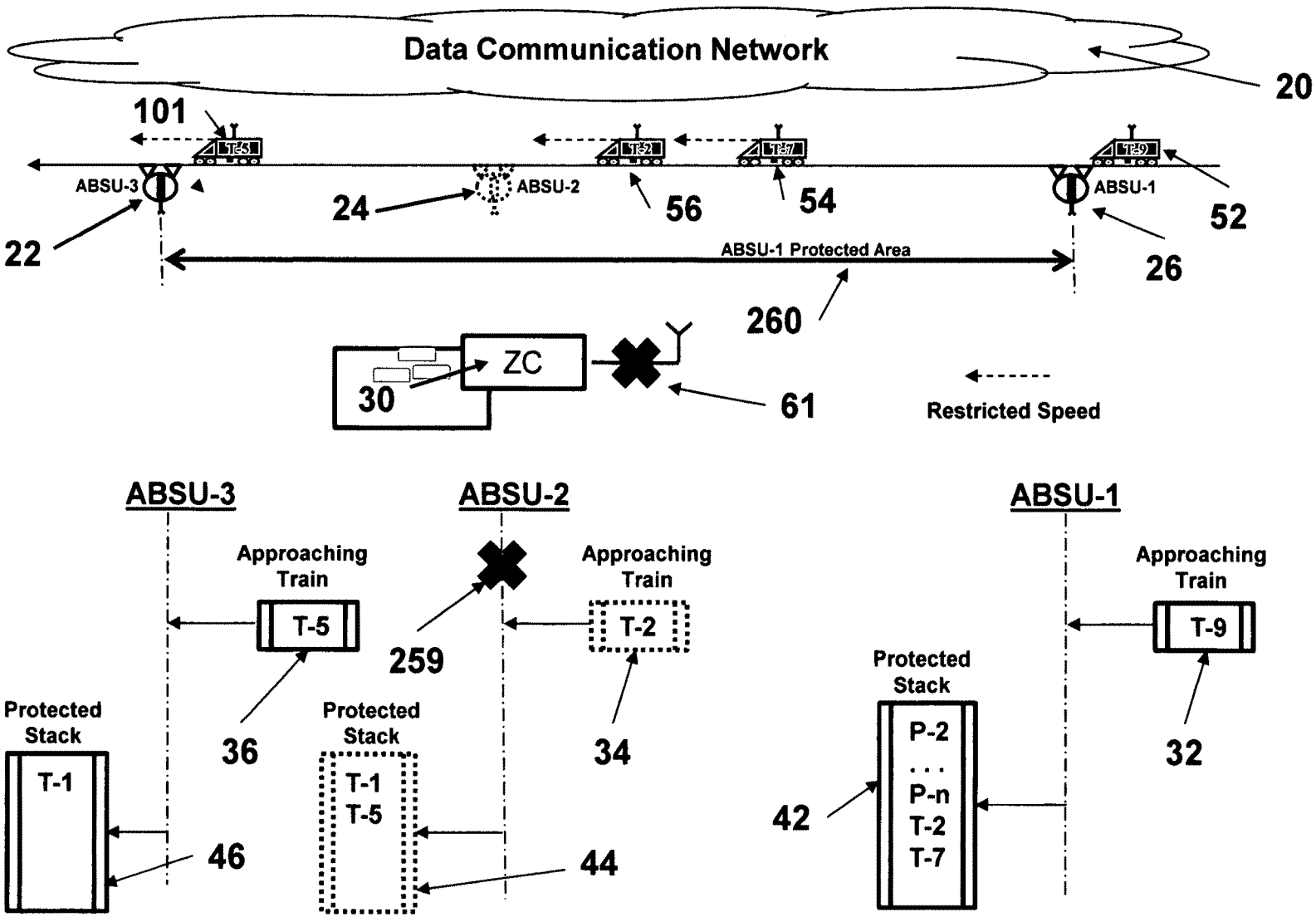

FIG. 67 reflects the expanded protected area 260 for ABSU-1 26, as well as the expanded protected stack 42 for ABSU-1 26 that shows train T-1 58 at the top of the stack, and provisional trains P-1 through P-n between T-1 and train T-2 56. Then FIGS. 68 & 69 reflect the movement of train T-1 58 past ABSU-3 22, the temporary identification of the approaching train to ABSU-3 as P-1, and the detection of train T-5 101 by ABSU-3 (either through radio communication or via the transponder reader for ABSU-3). Train T-5 101 will be processed normally by ABSU-3 22, and will be given a MAL upon the clearing of the protected area of ABSU-3 22.

Figure 70:
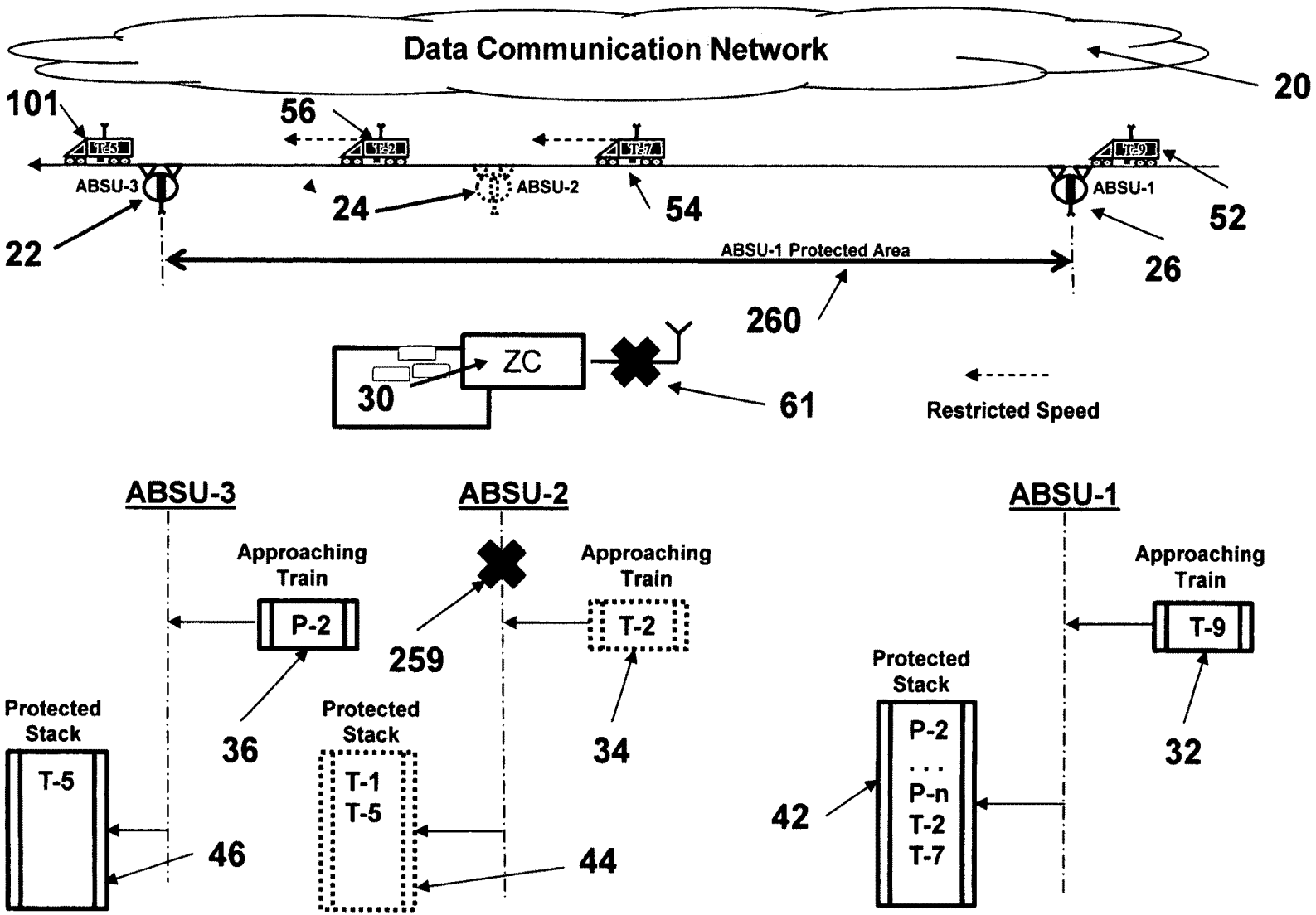
Figure 71:
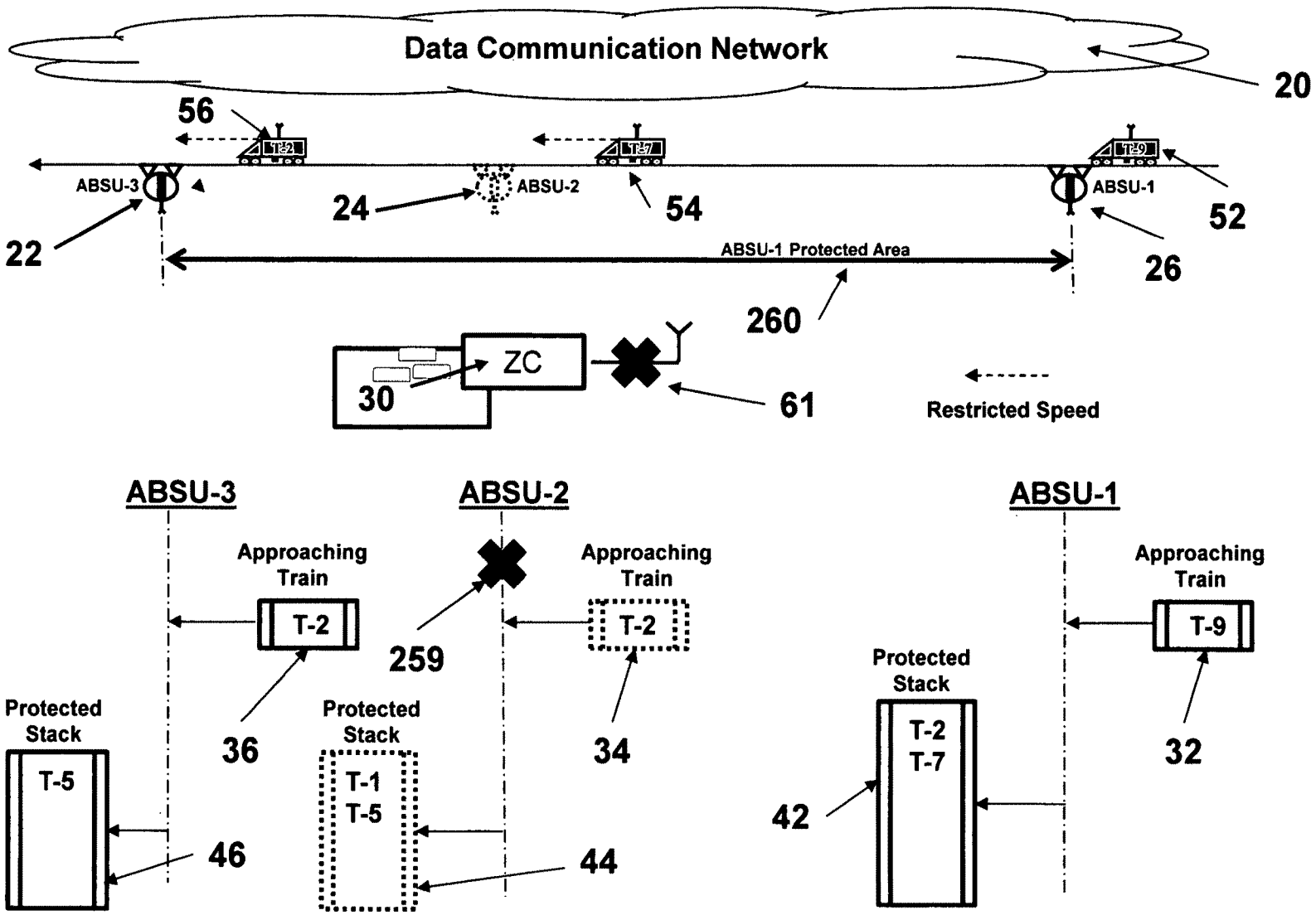

FIGS. 70 & 71 reflect the movement of train T-5 101 past ABSU-3 22, the temporary identification of the approaching train to ABSU-3 as P-2, and the detection of train T-2 56 by ABSU-3 (either through radio communication or via the transponder reader for ABSU-3). Upon the detection of train T-2 56 at ABSU-3 22, and upon communicating this detection to ABSU-1 26, ABSU-1 clears the remaining provisional train signatures from its protected stack 42.

With respect to the failure mode of ABSU-2 24, and because prior to its failure it received data that approaching train T-2 56 is an equipped train with proper status, ABSU-2 has failed in the "override" failure state. This means that train T-2 56 will receive a default code as it reaches the location of ABSU-2, and will continue to operate with speed restriction until it reaches ABSU-3 22. With respect to train T-7 54, it will also continue to operate with speed restriction past ABSU-2 24 until it reaches ABSU-3 22. In effect, the above described failure management process enables the AWS to "self-heal" from the ABSU-2 failure by combining the absolute permissive blocks of ABSU-1 26 and ABSU-2 24 into a longer absolute permissive block.

It should be noted that the premise of selecting an ABSU failure mode based on the operating condition of the approaching train, and without consideration of the operating conditions of trains following the approaching train within the same absolute permissive block, is based on the assumption that the zone controller and the AWS will not permit a manual train (i.e. without speed restriction) to operate following another train within an absolute permissive block. It should also be noted that if a train without a manual train was approaching ABSU-2 prior to its failure, then ABSU-2 will fail in the "stop" failure state. In such case, ABSU-2 24 will require a manual override to permit the train to proceed to ABSU-3.

In general, the AWS system can be designed to provide protection to manual trains that operate within the AWS territory without speed restrictions. This requires each ABSU to provide an overlap past its location to account for the breaking distance for the manual train tripping at the ABSU location at maximum attainable speed. To implement such design without adding more wayside equipment, and to maintain the generic approach for the ABSU design, the overlap distance is provided by a second absolute permissive block. This means that for a manual train to proceed past an ABSU, the protected stack of two consecutive ABSUs must be empty. As such, the operation of a manual train without speed restriction is demonstrated in FIGS. 72-74. It should be noted that to ensure safety of operation, the minimum length of an absolute permissive block must be greater that the longest braking distance based on maximum attainable speed.

Figure 72:
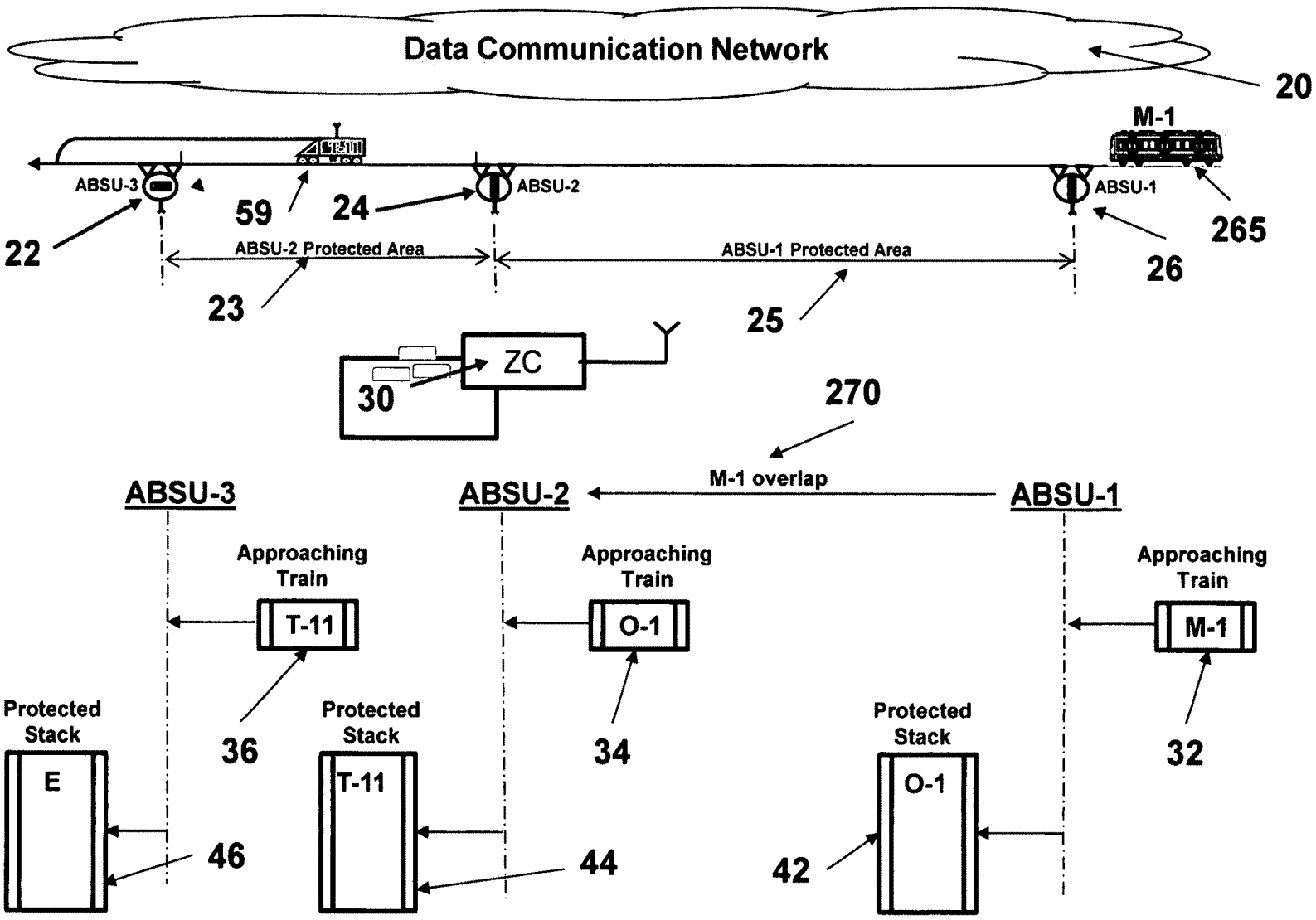
FIGS. 72-74 demonstrate a step by step operation of the ABSUs with an overlap function during the movement of a manual train that is operating without speed restriction through the AWS territory in accordance with the preferred embodiment of the invention.

FIG. 72 shows a manual train M-1 265 approaching ABSU-1 26. The recognition of a manual train is based on the design assumption that a manual train does not have a proper train status. However, a manual train is still being tracked by the AWS using the number of axles in the train. Upon the detection that M-1 265 is approaching its location, and despite the operating condition that its protected stack has no trains, ABSU-1 26 displays a stop aspect, and its automatic train stop is in the tripping position. ABSU-1 26 requests 270 ABSU-2 24 to reserve its absolute permissive block as an overlap distance for M-1 265. In effect, for this operating scenario, ABSU-1 protects 42 the required overlap ("O-1") for M-1 265, and O-1 is considered an approach to 34 ABSU-2 24.

Figure 73:
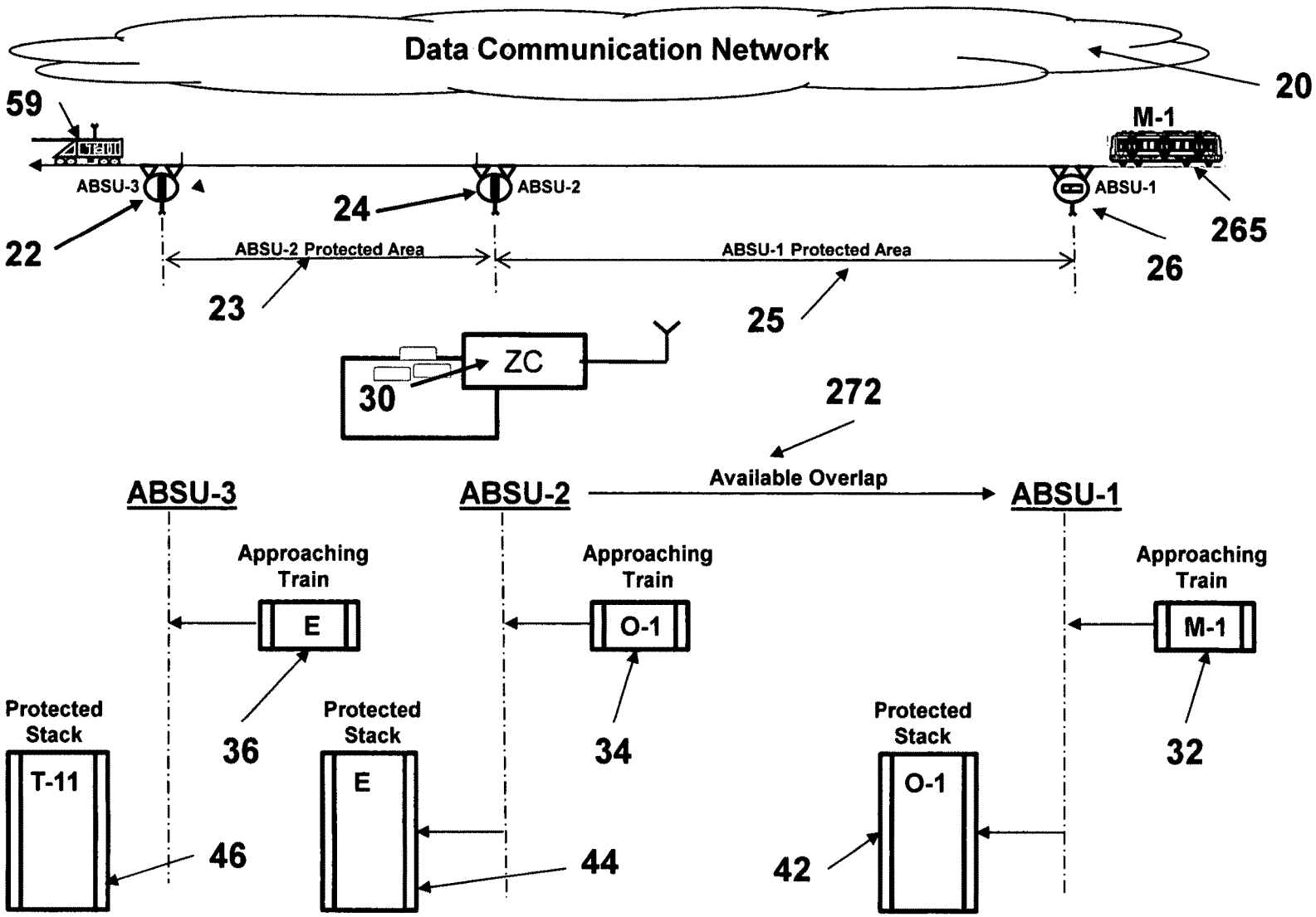
Figure 74:
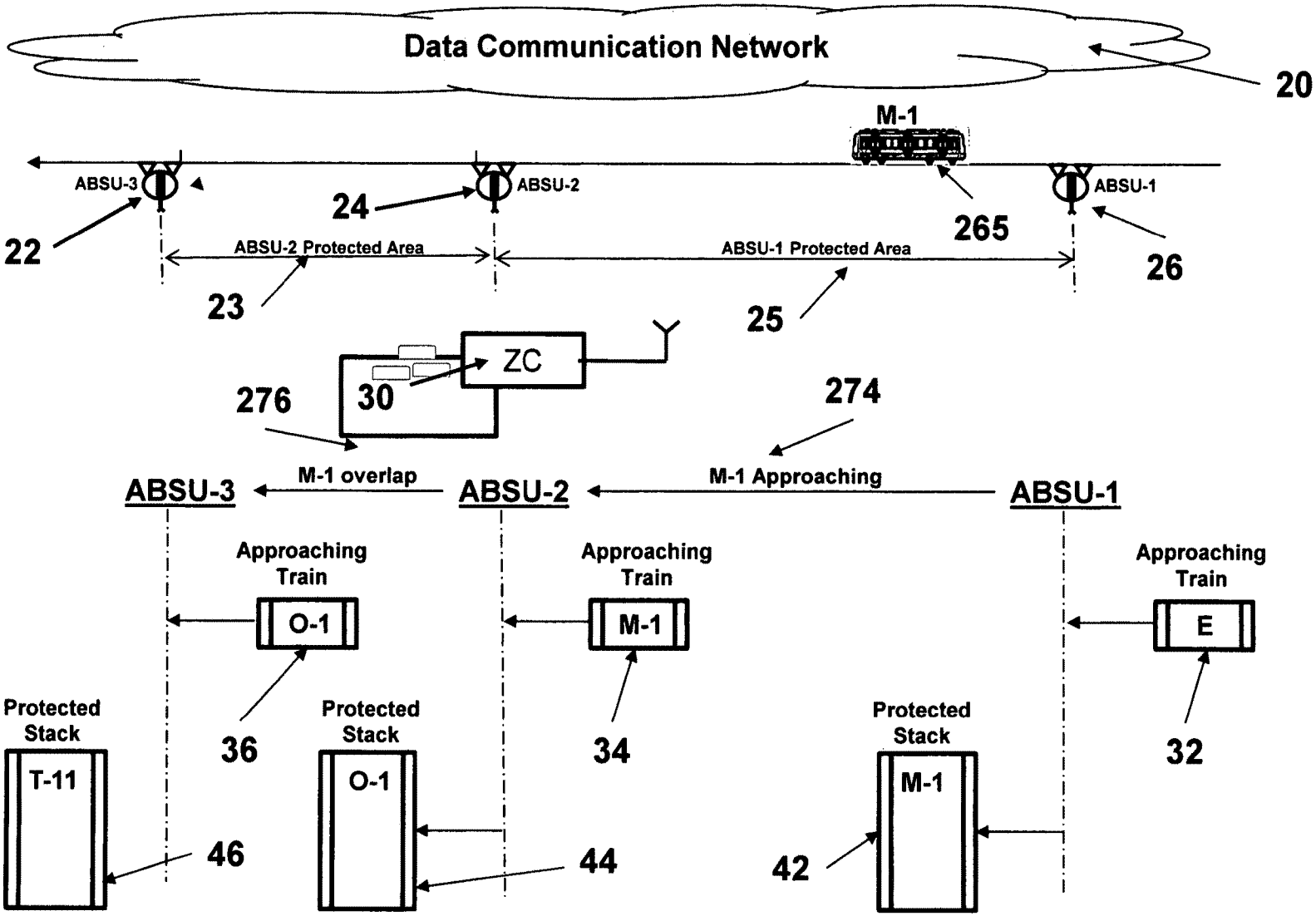

FIG. 73 reflects the crossing of train T-11 59 past ABSU-3 22, and the availability of an overlap block 23 for train M-1 265. ABSU-2 24 communicates 272 this availability to ABSU-1 26. In turn, ABSU-1 26 displays a clear aspect and controls its automatic train stop to the clear position. Then FIG. 74 shows the movement of train M-1 265 past ABSU-1 26, the communication 274 from ABSU-1 to ABSU-2 24 that M-1 265 is approaching the ABSU-2 location, and the communication 276 from ABSU-2 to ABSU-3 22 to reserve an overlap distance to M-1 265. For this operating condition, the protected stack 42 for ABSU-1 and the approaching train data field 34 for ABSU-2 reflect train M-1. Also, the protected stack 44 for ABSU-2 and the approaching train data field 36 for ABSU-3 reflect overlap requirement O-1. This ABSU operation continues as described to control the movement of a manual train throughout the AWS territory. Although the disclosure of the AWS architecture presented herein is focused on providing a train control installation as a backup to a CBTC system, the proposed train control architecture can be used as a primary train control system on a line, or a section of a line, that does not require high throughput. Since the proposed architecture provides a distance-to-go operation compatible with CBTC, it could be installed on a branch line that feeds a high capacity corridor equipped with CBTC.

As would be understood by those skilled in the art, alternate embodiments could be provided to implement an auxiliary train control system based on the absolute permissive block concept, and using the new concepts described herein. For example, each ABSU can communicate all the signatures data of the trains within its protected stack to the ABSU Ahead. This will simplify the AWS reconfiguration process in the event of an ABSU failure. Further, the overlap function could be provided via the installation of an auxiliary set of axle counter ahead of the ABSU location to ensure that sufficient braking distance is provided at each ABSU for the operation of a manual train. It is also to be understood that the foregoing detailed description of the preferred embodiment has been given for clearness of understanding only, and is intended to be exemplary of the invention while not limiting the invention to the exact embodiments shown.

Also, it should be noted that the ABSU and the interlocking control device can utilize alternate vital programs to implement the described train control functions. Obviously these programs will vary from one another in some degree. However, it is well within the skill of the signal engineer to provide particular programs for implementing vital algorithms to achieve the functions described herein. In addition, it is to be understood that the foregoing detailed description has been given for clearness of understanding only, and is intended to be exemplary of the invention while not limiting the invention to the exact embodiment shown. Obviously certain subsets, modifications, simplifications, variations and improvements will occur to those skilled in the art upon reading the foregoing. It is, therefore, to be understood that all such modifications, simplifications, variations and improvements have been deleted herein for the sake of conciseness and readability, but are properly within the scope and spirit of the following claims.

The invention claimed is:

1. A wayside train control installation that includes a plurality of signal control devices that operate in conjunction with a Communication Based Train Control (CBTC) system, wherein each signal control device controls the movement of a train into an associated track section, wherein said plurality of signal control devices operate autonomously of the CBTC system to provide at least one degraded mode of operation during CBTC failure, and wherein a failure in said wayside train control installation has no impact on normal CBTC operation.

2. A wayside train control installation that includes a plurality of signal control devices, wherein each signal control device controls the movement of a train into an associated absolute permissive block, and wherein a signal control device comprises:

a communication module to communicate with a train approaching the location of the associated absolute permissive block, wherein the approaching train communicates its operating state to the device, means for determining the operating state of the approaching train, and control means to precondition the device to fail in a plurality of failure states based on the operating state of the approaching train.

3. A train control system that includes a configuration of a plurality of signal control devices, wherein each signal control device controls the movement of a train into an associated absolute permissive block, wherein a signal control device communicates with at least one adjacent signal control device, wherein upon the failure of one of said plurality of signal control devices, the train control system is reconfigured without the failed device and by combining the absolute permissive block associated with the failed device with the absolute permissive block associated with the device in the approach to the failed device.

4. A train control system that includes a plurality of signal control devices, wherein each signal control device controls the movement of a train into an associated absolute permissive block, wherein a signal control device communicates with at least one adjacent signal control device, wherein the signal control device acquires data from a train crossing into the associated absolute permissive block, and wherein the signal control device communicates the acquired data to at least one adjacent signal control device.

5. A train control system that includes a plurality of wayside signal control devices, wherein a signal control device tracks the number of trains operating in an associated track section, wherein each train is identified by a train signature that includes the number of axles in the train, and wherein a signal control device comprises:

an axle counter located at the entrance of said track section for detecting the number of axles of a train passing its location, at least one of a radio communication module and a data communication module for exchanging data with at least one adjacent signal control device, a processor module with a computer-readable medium encoded with a computer program, a computer program segment that tracks the trains operating within said track section, and a computer program segment that generates and transmits a movement authority limit to a train approaching the entrance location of said track section.

6. A train control system as recited in claim 5, wherein a wayside signal control device further comprises a transponder reader.

7. A train control system as recited in claim 5, wherein a wayside signal control device further comprises at least one of a wayside signal and an automatic train stop.

8. A train control system as recited in claim 5, wherein said movement authority limit is transmitted to the approaching train via a transponder.

9. In a train control system that includes a plurality of train control devices, wherein each train control device controls the movement of a train into an associated track section, wherein each train control device includes at least one of a radio module and a transponder reader to receive train operating status from a train approaching the associated track section, wherein each train control device includes a processor module with a computer-readable medium encoded with a computer program to control the operation of the device, and wherein at least one of said plurality of train control devices controls a wayside signal, a method to control the failure state of the at least one of said train control devices comprising the following steps:

receiving the operating status of the approaching train, preconditioning the device to fail into a first failure state upon receiving a first operating status from the approaching train, wherein during the first failure state the wayside signal displays a permissive aspect, and preconditioning the device to fail into a second failure state upon receiving a second operating status from the approaching train, wherein during the second failure state the wayside signal display a stop aspect.

10. In a train control system that includes a plurality of signal control devices and a zone controller, wherein each signal control device is associated with a track section and includes a communication module for the device to communicate with the zone controller and with at least one adjacent signal control device, wherein a signal control device further includes at least one of an axle counter and a transponder reader to receive operational data from trains crossing into the associated track section, a method for initializing the zone controller comprising the following steps:

monitoring the movement of trains entering and exiting the track sections associated with said signal control devices, tracking the operational data of trains operating within the track sections, establishing communication between the zone controller and signal control devices upon the recovery of the zone controller from a failure, and communicating operational data of trains operating within track sections from signal control devices to the zone controller.

* * * * *